US005174111A

United States Patent [19]

Nomura et al.

[11] Patent Number: 5,174,111

[45] Date of Patent: Dec. 29, 1992

[54] EXHAUST GAS PURIFICATION SYSTEM FOR AN INTERNAL COMBUSTION ENGINE

[75] Inventors: Hiroshi Nomura; Katsuhiko Hirose, both of Susono; Takeshi Kotani, Mishima; Souichi Matsushita; Kiyoshi Nakanishi, both of Susono; Eishi Ohno; Kenichi Nomura, both of Mishima, all of Japan

[73] Assignee: Toyota Jidosha Kabushiki Kaisha, Toyota, Japan

[21] Appl. No.: 738,194

[22] Filed: Jul. 30, 1991

[30] Foreign Application Priority Data

Jan. 31, 1991 [JP] Japan ..... 3-29081
Feb. 14, 1991 [JP] Japan ..... 3-40693

[51] Int. Cl.[5] ..... F01N 3/28
[52] U.S. Cl. ..... 60/285; 60/301
[58] Field of Search ..... 60/274, 285, 299, 276, 60/301

[56] References Cited

U.S. PATENT DOCUMENTS 4,206,599 6/1980 Sumiyoshi ..... 60/285
4,297,328 10/1981 Ritscher ..... 60/301
4,617,794 10/1986 Fujitani ..... 60/285
5,050,551 9/1991 Morikawa ..... 60/285

*Primary Examiner*—Douglas Hart
*Attorney, Agent, or Firm*—Kenyon & Kenyon

[57] ABSTRACT

An exhaust gas purification system for an internal combustion engine includes an engine capable of fuel combustion at lean air-fuel ratios, a catalyst constructed of zeolite carrying at least one kind of metal selected from transition metals and noble metals to reduce NOx under oxidizing conditions and in the presence of HC, engine operating condition detecting means for detecting the current engine operating condition, engine operating range determining means for determining whether or not the current engine operating condition is within an insufficient HC amount range, and an HC amount control means for controlling the amount of HC included in the exhaust gas when the engine operating range determining means determines that the engine operating condition is within the insufficient HC amount range. The HC amount control means degrades automization or evaporation of fuel injected from a fuel injection valve to thereby generate unburned fuel and to increase the HC amount in the exhaust gas, so that the NOx purification rate of the catalyst is improved.

27 Claims, 41 Drawing Sheets

FIG. 12
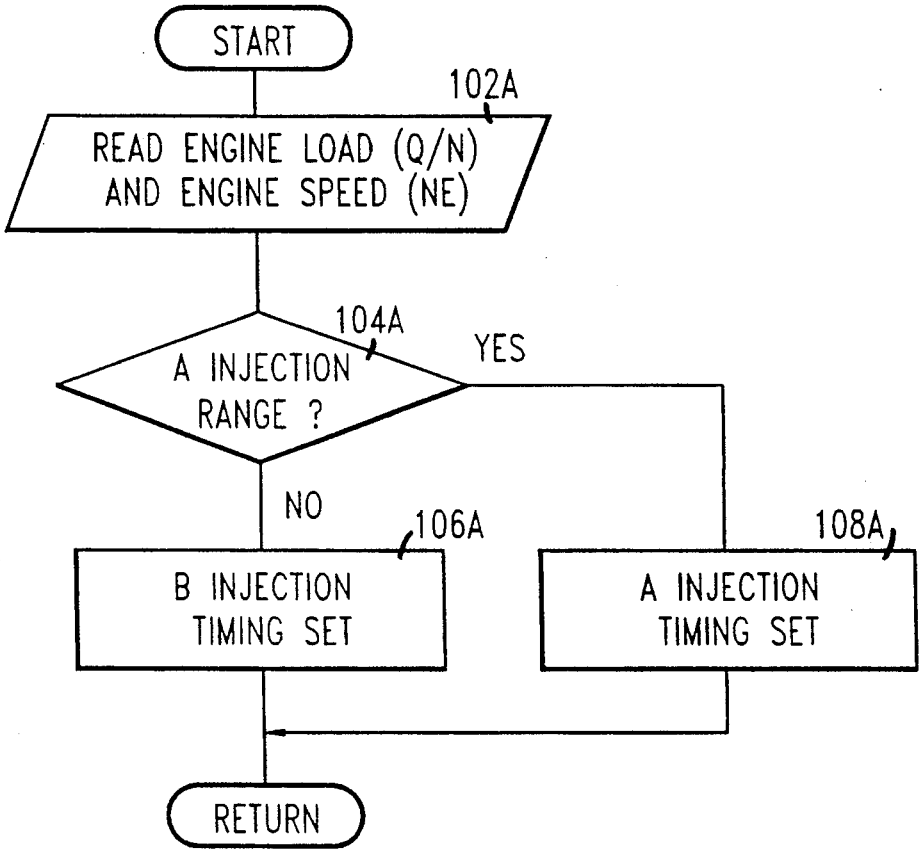
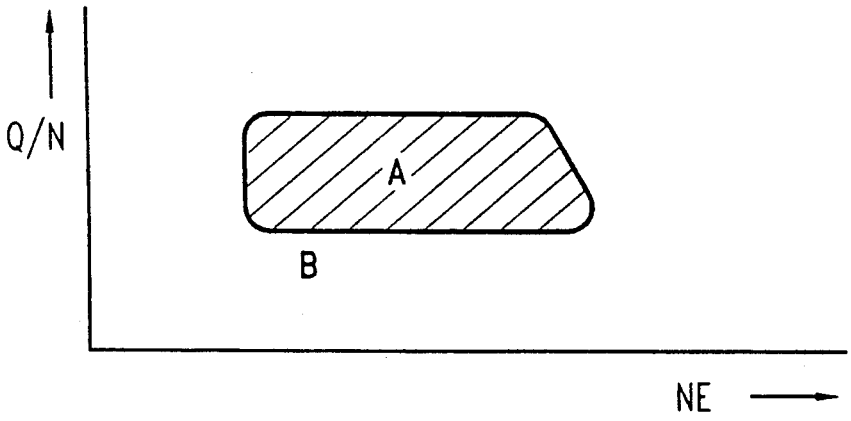
FIG. 13

(A INJECTION)

(B INJECTION)

FIG. 56
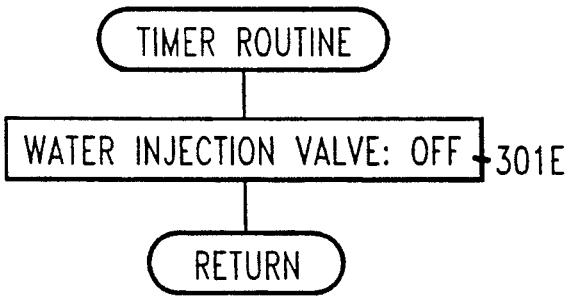
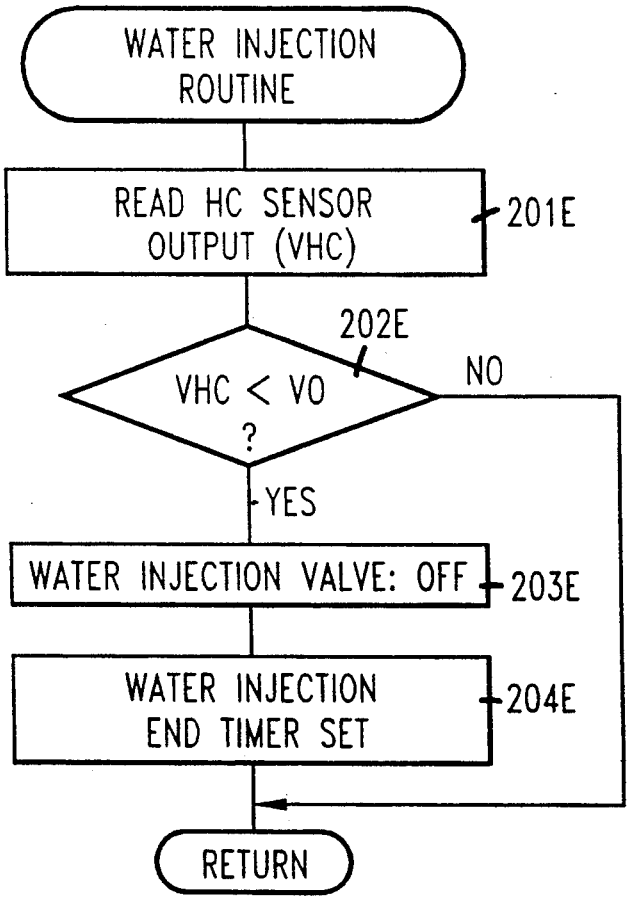
FIG. 59

EXHAUST GAS PURIFICATION SYSTEM FOR AN INTERNAL COMBUSTION ENGINE

BACKGROUND OF THE INVENTION

1. Field of the Invention

The present invention relates to an exhaust gas purification system for an internal combustion engine provided with a catalyst capable of reducing nitrogen oxides (hereinafter, NOx) under oxidizing conditions and in the presence of hydrocarbons.

2. Description of the Prior Art

Combustion at lean air-fuel ratios is effective to improve fuel economy of automobile internal combustion engines, and such lean air-fuel combustion (lean burn) is actually used in diesel engines and some types of gasoline engines. However, in the lean burn engine, NOx reduction by a three-way catalyst cannot be expected, and therefore, an alternative means for reducing NOx needs to be developed.

As a catalyst capable of reducing NOx under oxidizing conditions of the lean burn engine, Japanese Patent Publication HEI 1-130735 discloses a zeolite catalyst carrying transition metals which can reduce NOx in the presence of hydrocarbons (HC). To supply hydrocarbons to the catalyst, Japanese Patent Publication SHO 63-283727 proposes to provide a particular HC source different from a fuel source and a particular device which introduces hydrocarbons from the HC source into exhaust gas of the engine.

However, provision of such particular HC source and such HC introduction device would increase cost, make the system complicated, and degrade reliability of the system.

SUMMARY OF THE INVENTION

An object of the invention is to provide an exhaust gas purification system for an internal combustion engine with a NOx reduction zeolite catalyst wherein even when an engine operating condition is in a range of insufficient HC amount, an amount of hydrocarbons included in exhaust gas is increased by utilizing engine fuel to increase a NOx purification rate of the catalyst without installing a separate HC source or HC introduction device.

This object can be attained by an exhaust gas purification system for an internal combustion engine in accordance with the present invention. The system includes an internal combustion engine capable of fuel combustion at lean air-fuel ratios, a catalyst installed in an exhaust conduit of the engine and constructed of zeolite carrying at least one kind of metal selected from transition metals and noble metals to reduce nitrogen oxides included in exhaust gas from the engine under oxidizing conditions and in the presence of hydrocarbons (hereinafter, a lean NOx catalyst), engine operating condition detecting means for detecting a current engine operating condition, engine operating range determining means for determining whether or not the current engine operating condition is within a range of insufficient HC amount where an amount of hydrocarbons included in the exhaust gas from the engine is insufficient for the catalyst to reduce the nitrogen oxides included in the exhaust gas, and HC amount control means for momentarily degrading atomization or evaporation of fuel entering the engine to thereby increase the amount of hydrocarbons included in the exhaust gas when the engine operating range determining means determines that the current engine operating condition is within the insufficient HC amount range.

When the engine operating range determining means determines that the engine operating condition is within the insufficient HC amount range, the HC amount control means momentarily degrades atomization or evaporation of fuel so that fuel combustion is momentarily degraded and a portion of fuel is unburned in a cylinder and exhausted to the exhaust conduit to increase the HC amount in the exhaust gas. Therefore, hydrocarbons are sufficiently supplied to the catalyst, without installing a separate HC source and HC introduction device, so that the NOx purification rate of the catalyst is increased to effectively purify the exhaust gas.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which:

FIG. 12 is a flow chart of fuel injection rate control for an exhaust gas purification system for an internal combustion engine in accordance with a third embodiment of the present invention;

FIG. 13 is a graphical representation of a map of engine load versus engine speed used in calculation by the flow chart of FIG. 12;

FIG. 56 is a flow chart for water injection stopping used in the control by the flow chart of FIG. 55;

FIG. 59 is a control flow chart for the exhaust gas purification system for an internal combustion engine in accordance with the twelfth embodiment of the present invention.

DETAILED DESCRIPTION OF THE PREFERRED EMBODIMENTS

Twelve embodiments of the present invention will be explained.

First and Second Embodiments

FIGS. 1-11 correspond to first and second embodiments wherein a fuel injection valve comprises an air assist-type fuel injection valve and an HC amount is increased by stopping supply of assist air to the fuel injection valve or decreasing the amount of assist air supplied to the fuel injection valve to degrade atomization of injected fuel.

Figure 5:
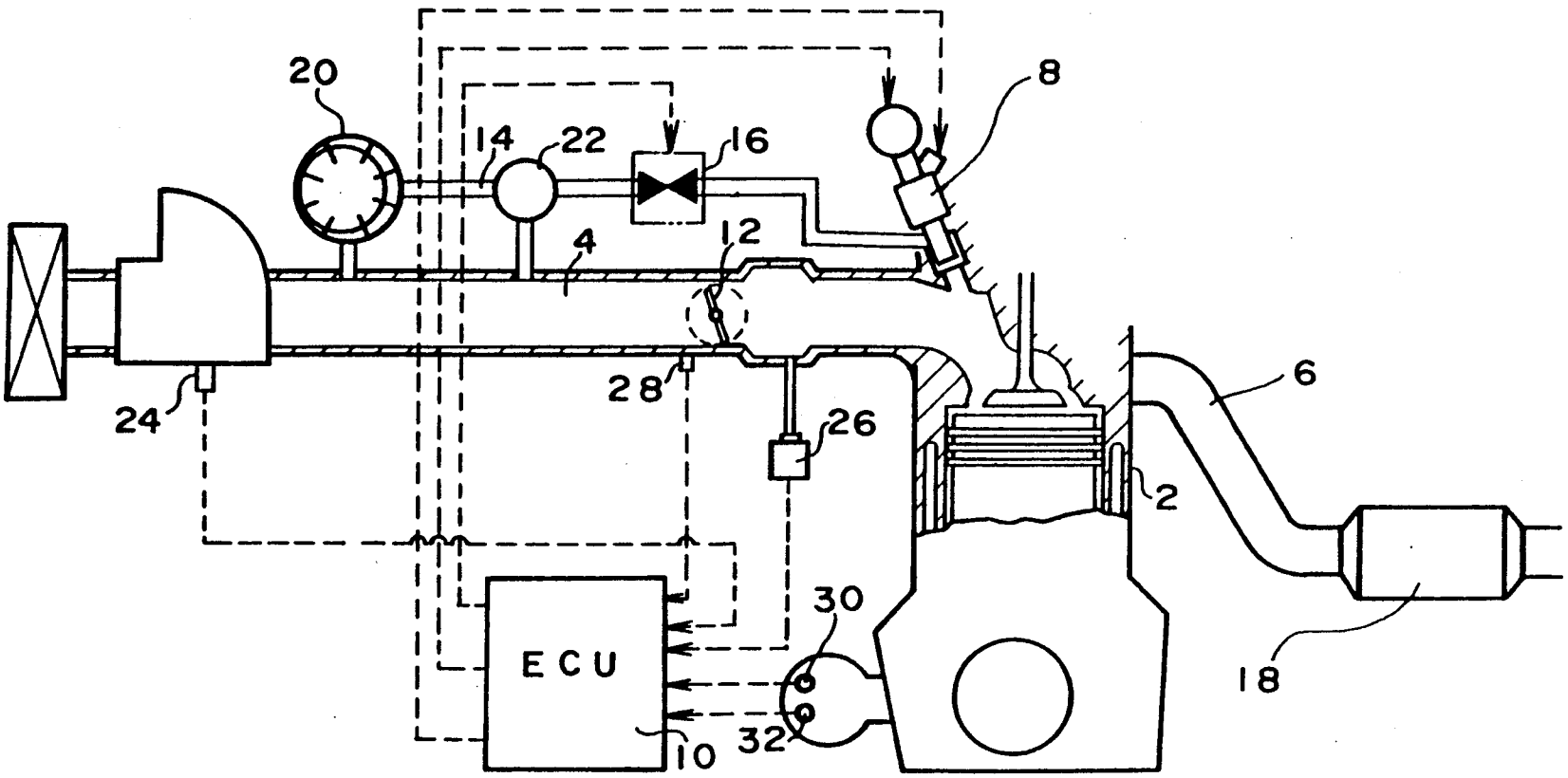
FIG. 5 is a schematic system diagram of an exhaust gas purification system for an internal combustion engine in accordance with the first and second embodiments of the present invention.

As illustrated in FIG. 5, an exhaust gas purification system for an internal combustion engine in accordance with first and second embodiments includes an internal combustion engine 2 capable of fuel combustion at lean air-fuel ratios, an air assist-type fuel injection valve 8 installed in an intake conduit 4 of the engine 2, and a lean NOx catalyst 18 installed in an exhaust conduit 6 of the engine. The exhaust gas purification system further includes engine operating condition detecting means for detecting a current engine operating condition, engine operating range determining means for determining whether or not the engine operating condition is within an insufficient HC amount range where an amount of HC included in the exhaust gas is insufficient for the lean NOx catalyst 18 to effectively reduce NOx, and assist air amount control means for decreasing the amount of the assist air or stopping supply of the assist air supplied to the air assist-type fuel injection valve when the engine operating range determining means determines that the current engine operating condition is within the HC amount insufficient range. The assist air amount control means constitutes the HC amount control means for the first and second embodiments.

Fuel injection and air injection of the air assist-type fuel injection valve 8 are controlled by an electronic control unit (hereinafter, ECU) 10. Air is supplied to the air assist-type fuel injection valve 8 through an assist air conduit 14 from a portion of the intake conduit 4 upstream of a throttle valve 12. An air pump 20, a pressure regulator 22, and an assist air control valve 16 are installed in the assist air conduit 14 so that air is pressurized by the air pump 20 and is regulated to a constant pressure by the pressure regulator 22. When the assist air control valve 16 is made "ON", the air is supplied to the air assist-type fuel injection valve 8. Supply and supply stopping of the assist air are controlled by the ECU 10.

Figure 11:
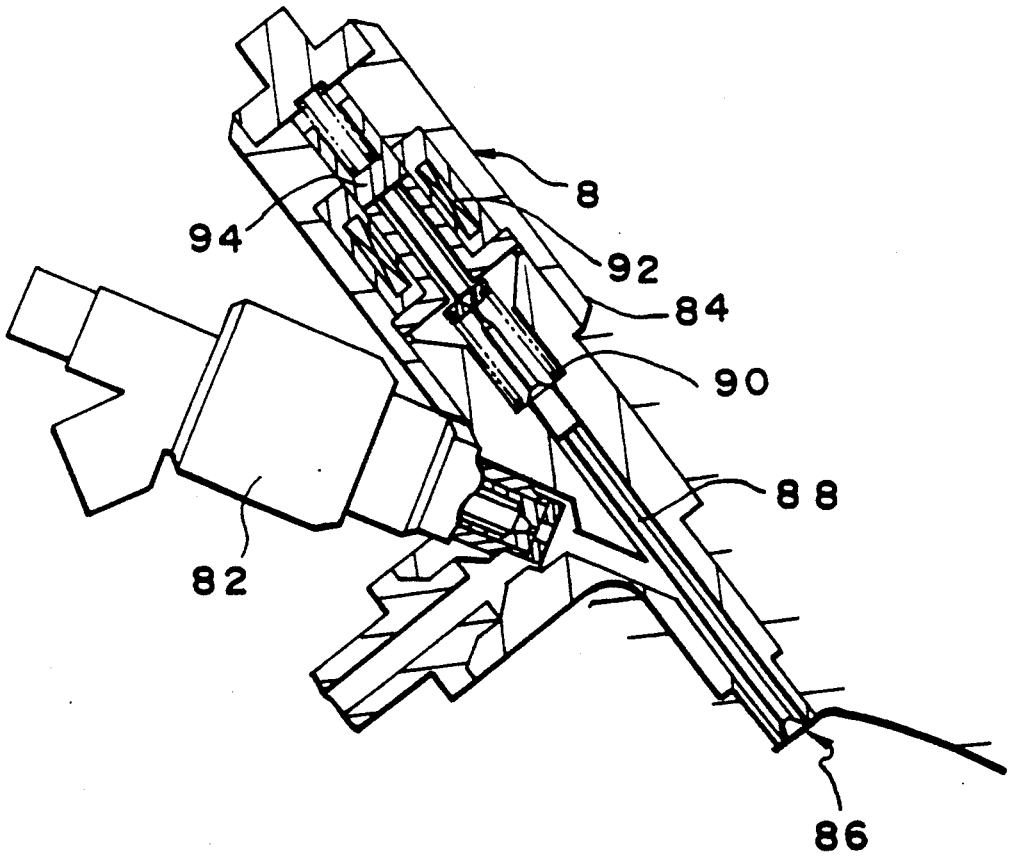
FIG. 11 is a cross-sectional view of the air assist-type fuel injection valve of the exhaust gas purification system for an internal combustion engine in accordance with the first and second embodiments of the present invention.
Figure 14:
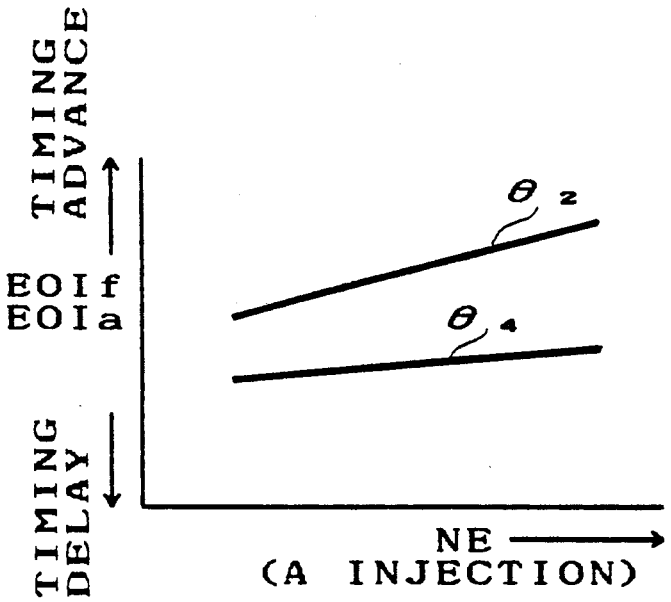
FIG. 14 is a graphical representation of a map of end of fuel injection (EOIf) and end of air injection (EOIa) versus engine speed (NE) used in calculation by the flow chart of FIG. 12 in the case of a first injection (an A injection pattern)
Figure 15:
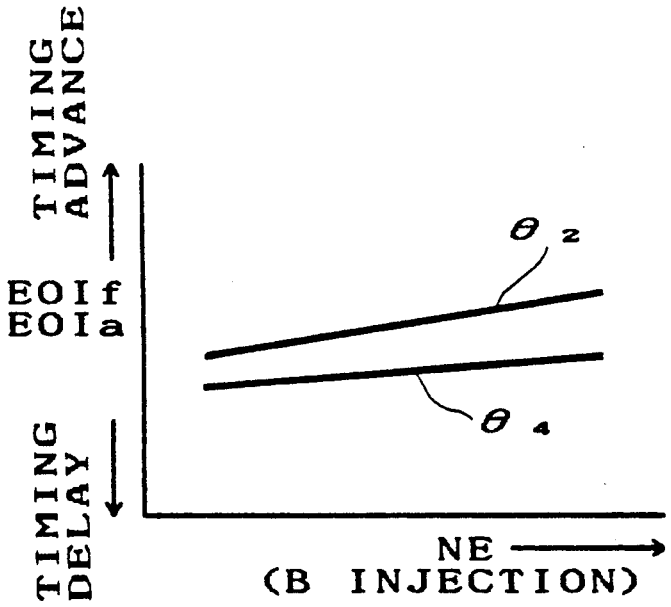
FIG. 15 is a graphical representation of a map of end of fuel injection (EOIf) and end of air injection (EOIa) versus engine speed (NE) used in calculation by the flow chart of FIG. 12 in the case of a second injection (a B injection pattern)

As illustrated in FIG. 11, the air assist-type fuel injection valve 8 includes a fuel injection portion 82 and an air injection portion 84. The air injection portion 84 includes a nozzle hole 86, a needle 88 for opening and closing the nozzle hole 86, a compression spring 90 for biasing the needle 88 in a valve closing direction, a solenoid 92, and a movable core 94 for moving the needle 88 in a valve opening direction when the core is magnetically excited. Fuel injection timing and assist air injection timing are controlled by the ECU 10.

Figure 45:
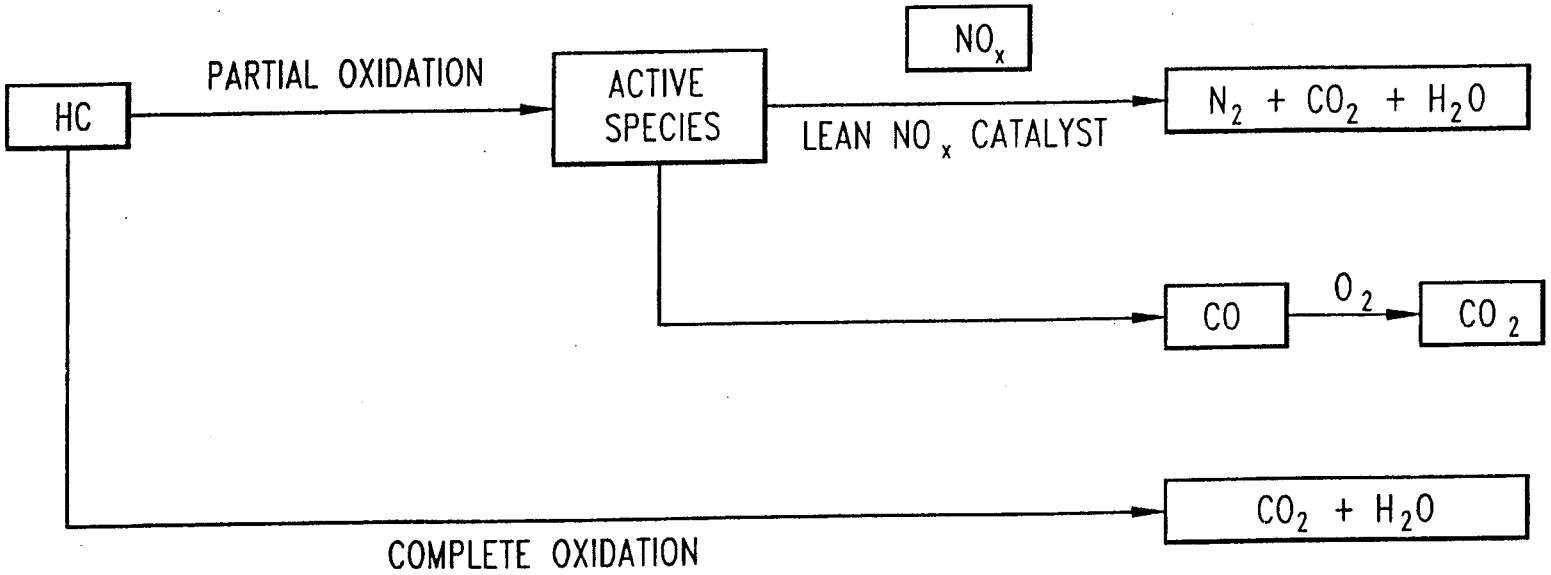
FIG. 45 is a block diagram illustrating a NOx reduction mechanism of a lean NOx catalyst.

A NOx reduction mechanism of the lean NOx catalyst 18 installed in the exhaust conduit 6 of the engine is presumed to be a reaction of some active species or radicals (for example, species like $CO^-$) generated through partial oxidation of hydrocarbons and NOx (see FIG. 45). Therefore, the more hydrocarbons that are included in the exhaust gas and the more that partial oxidation of hydrocarbons is promoted, the higher is the NOx purification rate of the lean NOx catalyst 18.

In the first and second embodiments, the amount of HC included in the exhaust gas is controlled by controlling the amount of assist air supplied to the air assist-type fuel injection valve 8, without providing a special HC supply device. The control of the amount of assist air includes stopping supply of assist air to the air assist-type fuel injection valve 8 and decreasing the amount of the assist air supplied to the air assist-type fuel injection valve 8. When supply of the assist air is stopped or decreased, atomization in the air assist-type fuel injection valve 8 is degraded and combustion in the cylinder also is degraded to thereby increase unburned hydrocarbons generated in the cylinder and exhausted into the exhaust conduit. In contrast, when sufficient assist air is supplied to the air assist-type fuel injection valve 8, atomization of fuel in the air assist-type fuel injection valve 8 is promoted so that the amount of hydrocarbons included in the exhaust gas is decreased. However, since suppression of the assist air amount degrades the fuel economy and increases HC emissions of the engine, the assist air amount should be suppressed only when the engine operating condition is within the insufficient HC amount range. Supply of the assist air is controlled by controlling operation of the assist air control valve 16 by the ECU 10.

Figure 6:
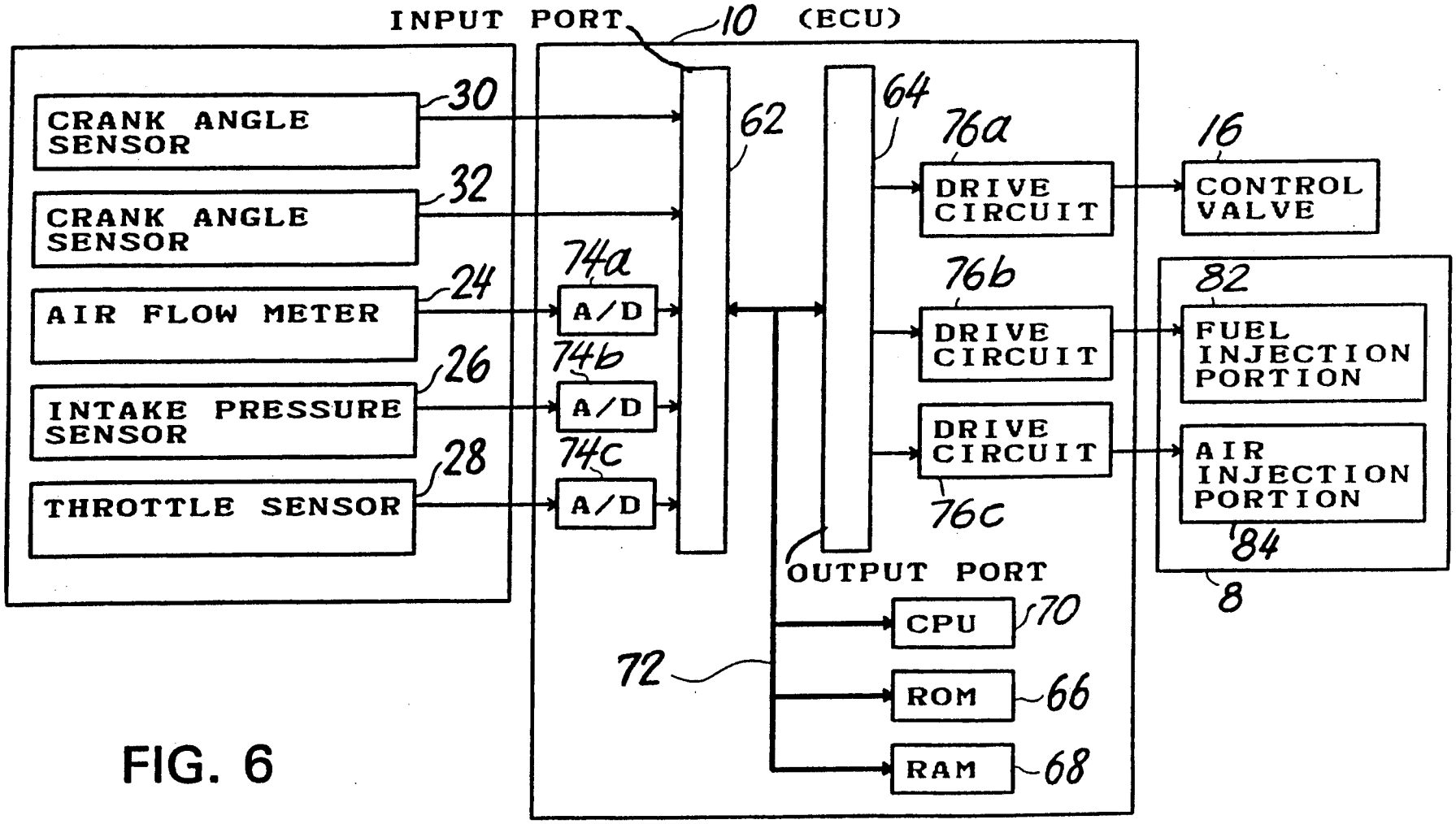
FIG. 6 is a block diagram illustrating an ECU and control elements connected to the ECU of the exhaust gas purification system for an internal combustion engine of FIG. 5.

The ECU 10 comprises a micro computer. As illustrated in FIG. 6, the ECU 10 includes an input port or input interface 62, an output port or output interface 64, a read-only memory (ROM) 66, a random access memory (RAM) 68, and a central processor unit (CPU) 70 which are connected to each other by a circuit 72. Analog signals from an air flow meter 24, an intake pressure sensor 26, and a throttle sensor 28 are converted to digital signals by analog/digital converters 74a, 74b, and 74c and then are fed to the input port 62. Digital signals from a first crank angle sensor 30 and a second crank angle sensor 32 are fed directly to the input port 62. A drive circuit 76a for driving the assist air control valve 16, a drive circuit 76b for driving the fuel injection portion 82 of the air assist-type fuel injection valve 8, and a drive circuit 76c for driving the air injection portion 84 of the air assist-type fuel injection valve 8 are connected to the output port 64. At least one of the above-described sensors constitutes engine operating condition detecting means for detecting the operating condition (for example, engine speed and engine load) of the internal combustion engine 2.

The ECU 10 stores programs and maps of FIGS. 7-10 in the ROM 66, and these are called by the CPU 70 where calculation is executed.

Figure 7:
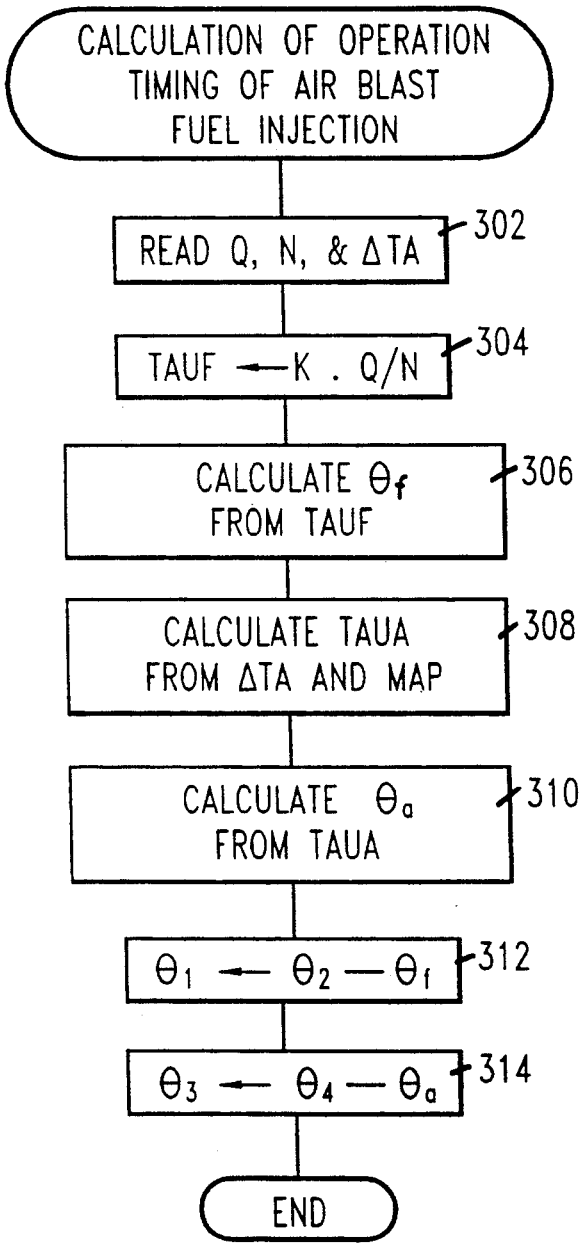
FIG. 7 is a calculation flow chart of operation timing of an air assist-type fuel injection valve for the exhaust gas purification system for an internal combustion engine of FIG. 5.

FIG. 7 illustrates a routine for calculating an operation timing of the air assist-type fuel injection valve 8. This routine is entered at intervals of predetermined periods of time. At step 302, an intake air amount Q (an output of the air flow meter 24), an engine speed NE (calculated from an output of the crank angle sensor 30), and a throttle valve opening and closing speed delta TA (calculated from an output of the throttle sensor 28) are entered. In this instance, a positive value of delta TA corresponds to opening the throttle valve 12. Then, at step 304, a period of time of an opened state of the fuel injection portion 82 (a period of time of fuel supply) TAUF is calculated from the following equation:

$$TAUF = K \times Q/N$$

where, K is a modification factor.

Figure 8:
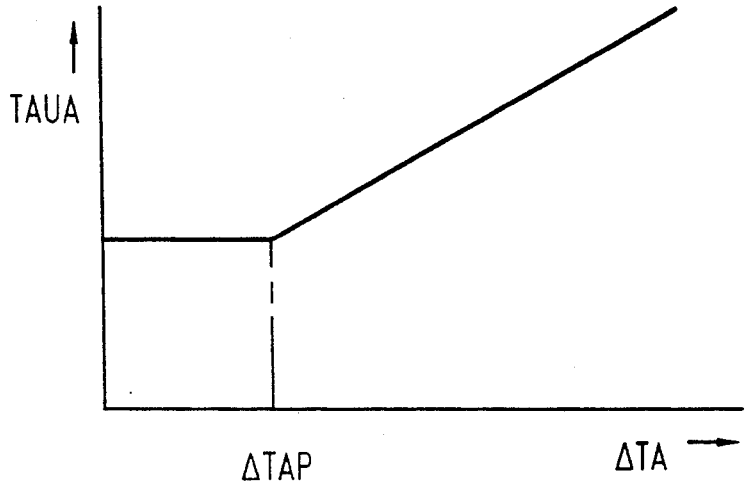
FIG. 8 is a graphical representation of a map of air injection amount versus throttle valve opening and closing speed used in calculation by the flow chart of FIG. 7.

Then, at step 306, the period of time of fuel supply is converted to a fuel supply crank angle $\theta_f$. Then, at step 308, a nozzle hole opening period of time (air injection period of time) TAUA is calculated from the throttle valve opening and closing speed delta TA using a map of FIG. 8. As illustrated in FIG. 8, a relationship between delta TA and TAUA is predetermined such that TAUA is constant when delta TA is smaller than a predetermined throttle valve opening and closing speed delta TAP, and TAUA substantially linearly increases when delta TA is equal to or larger than delta TAP, that is, when the engine is accelerated.

Figure 9:
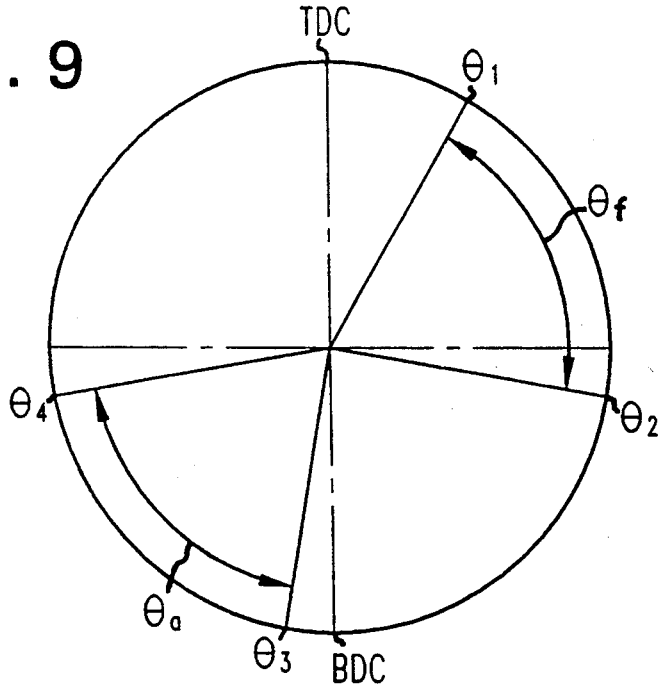
FIG. 9 is a timing chart of fuel injection and assist air injection of an air assist-type fuel injection valve for the exhaust gas purification system for an internal combustion engine in accordance with the first and second embodiments of the present invention.

At step 310, the air injection period of time TAUA is converted to an air injection crank angle $\theta_a$. Then, at step 312, a fuel supply beginning crank angle $\theta_1$ is calculated by the following equation:

$$\theta_1 = \theta_2 - \theta_f$$

where, $\theta_2$ is a fuel supply stop crank angle which is a predetermined, fixed angle (see FIG. 9).

Then, at step 314, a nozzle hole opening crank angle $\theta_3$ is calculated by the following equation:

$$\theta_3 = \theta_4 - \theta_a$$

where, $\theta_4$ is a nozzle hole closing crank angle which is a predetermined, fixed angle (see FIG. 9).

Figure 10:
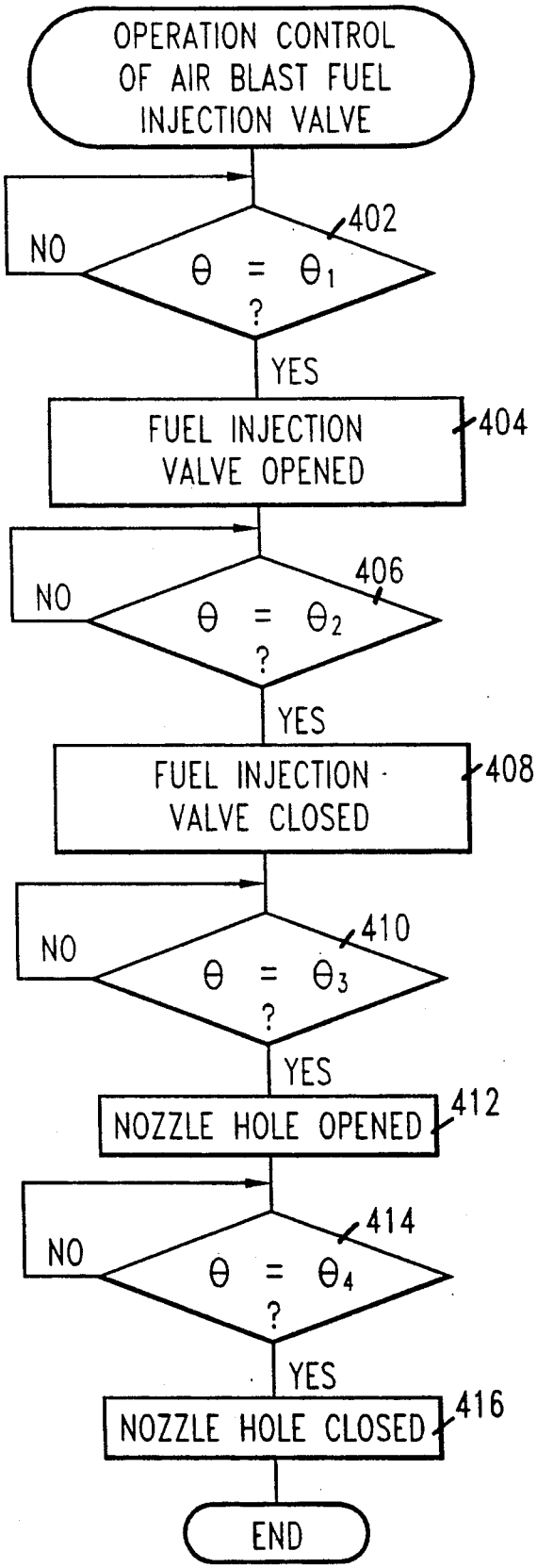
FIG. 10 is a control flow chart of fuel injection and assist air injection of the air assist-type fuel injection valve for the exhaust gas purification system for an internal combustion engine in accordance with the first and second embodiments of the present invention.

FIG. 10 illustrates a routine for controlling operation of the air injection portion 84 of the air assist-type fuel injection valve 8. This routine is entered at intervals of predetermined periods of time, as counted by the output of the second crank angle sensor 32.

At step 402, it is determined whether or not the current crank angle $\theta$ has reached the fuel supply beginning crank angle $\theta_1$. When $\theta$ has reached $\theta_1$, the routine proceeds to step 404 where the fuel injection portion 82 is opened. Then, at step 406, it is determined whether or not the current crank angle $\theta$ has reached the fuel supply stopping crank angle $\theta_2$. When $\theta$ is has reached $\theta_2$, the routine proceeds to step 408 where the fuel injection portion 82 is closed. Then, at step 410, it is determined whether or not the current crank angle $\theta$ has reached the nozzle hole opening crank angle $\theta_3$. When $\theta$ has reached $\theta_3$, the routine proceeds to step 412 where the nozzle hole 86 is opened and air is injected to blow the injected fuel into the intake conduit or the combustion chamber of the engine. Then, at step 414, it is determined whether or not the current crank angle $\theta$ has reached the nozzle hole closing crank angle $\theta_4$. When $\theta$ has reached $\theta_4$, the routine proceeds to step 416 where the nozzle hole 86 is closed. This ends the routine.

Figure 1:
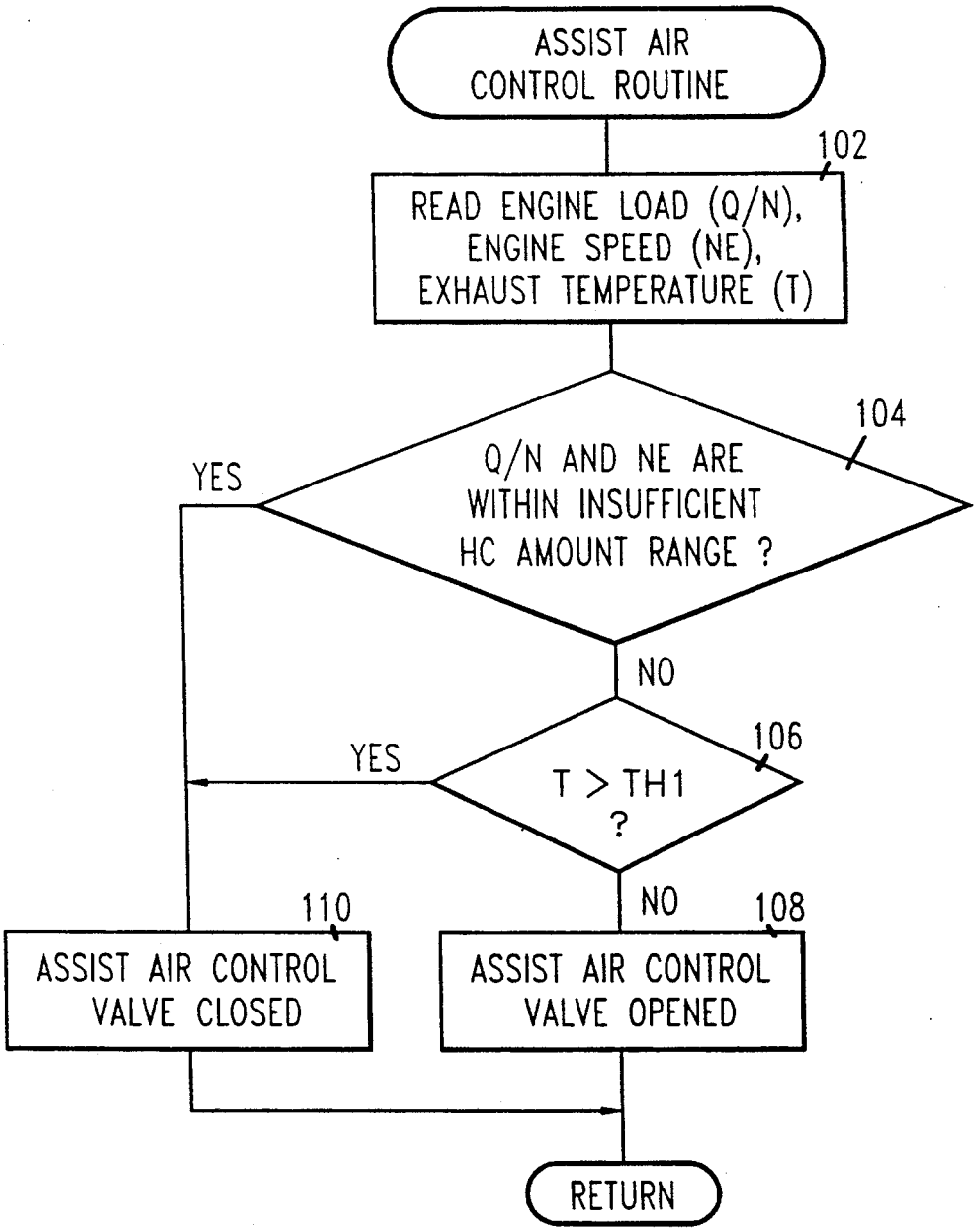
FIG. 1 is a flow chart of assist air control for an exhaust gas purification system for an internal combustion engine in accordance with a first embodiment of the present invention.
Figure 2:
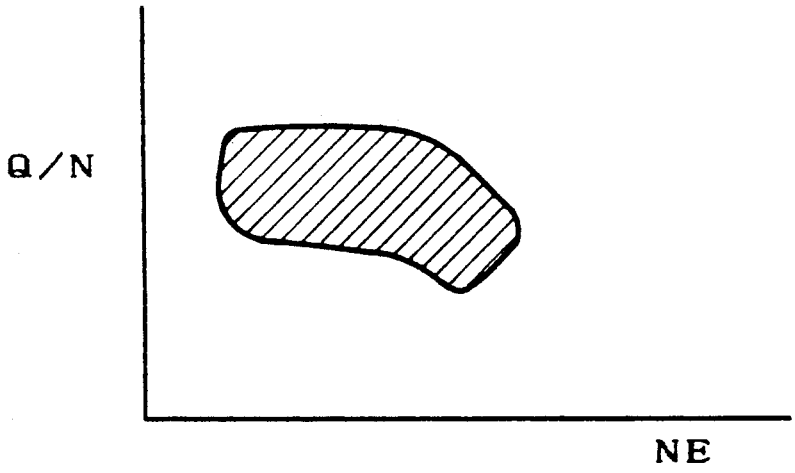
FIG. 2 is a graphical representation of a map of engine load versus engine speed used in calculation by the flow chart of FIG. 1.

Next, structures specific to each of the first and second embodiments will be explained. FIGS. 1 and 2 correspond to the first embodiment of the present invention and illustrate an assist air supply control routine and a map used in the calculation, respectively.

The routine of FIG. 1 is entered at intervals of predetermined periods of time, for example, at 50 msec intervals. At step 102, the current engine operating conditions including an engine load Q/N, an engine speed NE, and an exhaust gas temperature T are entered. The exhaust gas temperature may be calculated from the current engine load Q/N and the current engine speed NE using a map or may be detected from a temperature sensor installed in the exhaust conduit of the engine.

Then, at step 104, it is determined whether or not the current engine operating condition (the condition entered at step 102) is within a range where a hydrocarbon amount included in the exhaust gas is insufficient for the lean NOx catalyst 18 to effectively reduce NOx (such a range will be called an insufficient HC amount range hereinafter). A medium engine load and medium engine speed range is a typical example of such insufficient HC amount range.

A hatched portion of FIG. 2 shows such range. More particularly, at low engine loads and low engine speeds, little NOx is generated and exhausted from the engine, and therefore, HC is sufficient for the lean NOx catalyst 18 to purify NOx included in the exhaust gas. At high engine loads and high engine speeds, the air-fuel ratio is maintained rich (but still leaner than the theoretical air-fuel ratio), and therefore a relatively large amount of HC is included in the exhaust gas. The remaining engine operating range, that is, a medium engine load and medium engine speed range constitutes the insufficient HC amount range.

When it is determined that the engine operating condition is within the insufficient HC amount range at step 104, the routine proceeds to step 110 where the assist air control valve 16 is closed. In contrast, when it is determined that the engine operating condition is not within the insufficient HC amount range at step 104, the routine proceeds to step 106, where it is determined whether or not the exhaust gas temperature (the inlet gas temperature to the lean NOx catalyst 18) T is higher than a predetermined exhaust gas temperature TH1 (for example, 550° C.).

When the exhaust gas temperature T is higher than the temperature TH1, direct oxidation of HC to $H_2O$ and $CO_2$ is promoted, that is, partial oxidation of HC is suppressed. As a result, the range where T is higher than TH1 should be counted as an insufficient HC (radicals) amount range.

In the above, the steps 104 and 106 constitute engine operating range determining means for determining whether or not the current engine operating condition is within the insufficient HC amount range in the first embodiment of the invention.

When it is determined that T is higher than TH1 at step 106, the routine proceeds to step 110 where the assist air control valve 16 is closed, and when it is determined that T is equal to or lower than TH1 at step 106, the routine proceeds to step 108 where the assist air control valve 16 is opened. In this instance, the steps 110 and 108 constitute assist air amount control means for decreasing the amount of the assist air or stopping supply of the assist air when the engine operating range determining means determines that the current engine operating condition is within the insufficient HC amount range. Since stopping supply of the assist air degrades atomization of injected fuel and increases unburned fuel (HC) in the exhaust gas, the steps 110 and 108 constitute the HC amount control means of the first embodiment for momentarily degrading atomization of fuel injected from the fuel injection valve to thereby increase the amount of HC included in the exhaust gas when the engine operating range determining means determines that the current engine operating condition is within the insufficient HC amount range.

Figure 4:
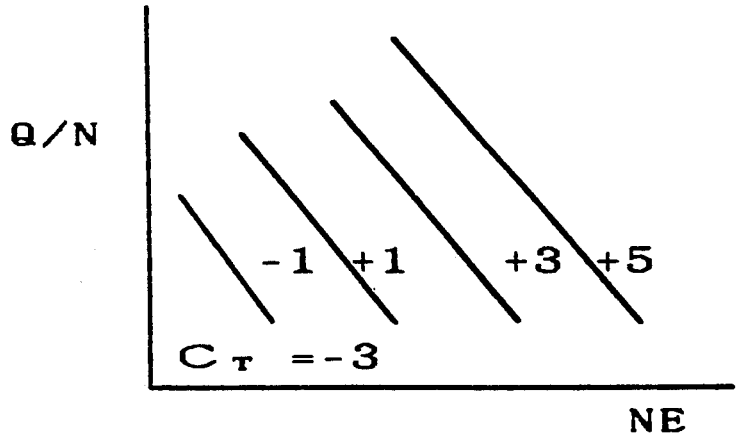
FIG. 4 is a graphical representation of a map of engine load versus engine speed used in calculation by the flow chart of FIG. 3.
Figure 3:
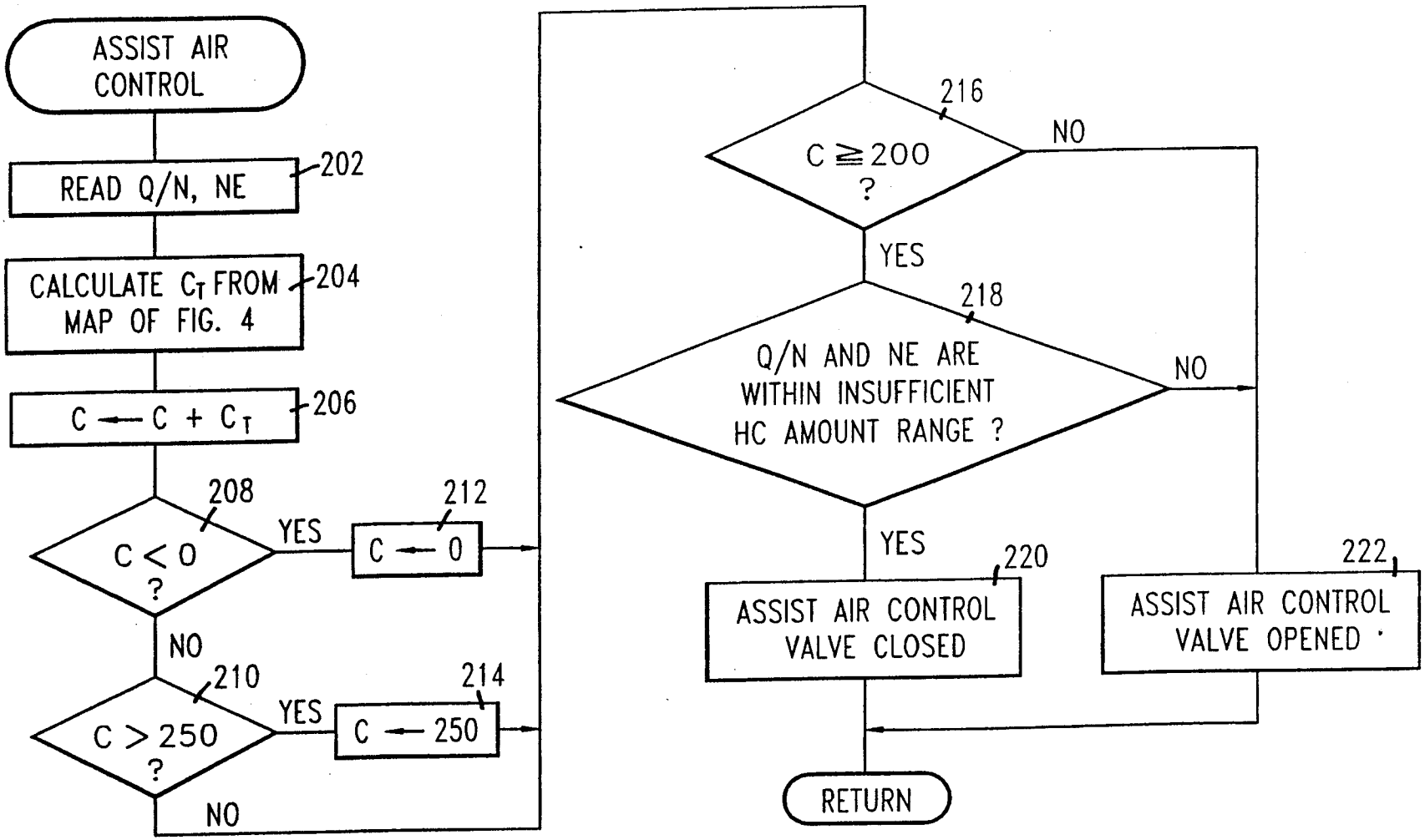
FIG. 3 is a flow chart of assist air control for an exhaust gas purification system for an internal combustion engine in accordance with a second embodiment of the present invention.

FIGS. 3 and 4 correspond to the second embodiment of the present invention and illustrate an assist air supply control routine and a map used in the calculation by the routine, respectively. In the second embodiment, when the engine operating condition enters the hatched portion of FIG. 2 from a low engine load and low engine speed side, closing of the assist air control valve 16 is delayed by a predetermined period of time. The reason for the delay is that since little NOx is generated at low engine loads and low engine speeds and since the NOx amount would not increase soon due to a time lag when the engine operating condition enters the hatched portion of FIG. 2, it would be better to give good combustion characteristics and fuel economy priority over NOx reduction.

The routine of FIG. 3 is entered at intervals of predetermined periods of time, for example, at 50 msec intervals. At step 202, the current engine load Q/N and engine speed NE are entered. Then, at step 204, a count value $C_T$ corresponding to the Q/N and NE is calculated from a map of FIG. 4. The value $C_T$ is a count value for changing a temperature condition C. More particularly, the value is large at high engine loads and high engine speeds, and the value is small at low engine loads and low engine speeds. Then, at step 206, the condition C for the instant cycle is calculated by adding the count value $C_T$ to the condition C of the previous cycle. Therefore, when the C value is large, the exhaust gas temperature is high, and when the C value is small, the exhaust gas temperature is low.

Then, at steps 208–214, it is determined whether or not the C value is within a predetermined range. When the C value is smaller than a lower limit of the predetermined range, the C value is set to the lower limit value, and when the C value is larger than an upper limit of the predetermined range, the C value is set to the upper limit value, so that the excessive divergence of the C value is prevented.

Then, the routine proceeds to step 216. Steps 216–222 control a time when the assist air control valve 16 is closed.

At step 216, it is determined whether or not the C value is equal to or larger than a predetermined value (for example, 200) which corresponds to a high temperature condition of the exhaust gas and the catalyst. When it is determined that the C value is smaller than the predetermined value, the exhaust gas temperature is presumed to be not high and a usual fuel injection is executed.

When it is determined at step 216 that the C value is equal to or larger than the predetermined value, the exhaust gas temperature is presumed to be high and the routine proceeds to step 218. At step 218, it is determined whether or not the current engine operating condition (the current engine load Q/N and the current engine speed NE) is within the hatched portion of FIG. 2. When the engine operating condition is outside the hatched portion, the routine proceeds to step 222 where the assist air control valve 16 is opened, and when the engine operating condition is within the hatched portion, the routine proceeds to step 220 where the assist air control valve 16 is closed. Therefore, when the engine operating condition enters the hatched portion of FIG. 2 from the high temperature side, the routine proceeds through steps 216 and 218 to step 220 so that the assist air control valve 16 is closed in a short period of time. In contrast, when the engine operating condition enters the hatched portion from the low temperature side, the routine proceeds through step 216 to step 222, and the assist air control valve 16 is not closed before the C value has reached the predetermined value so that closure of the assist air control valve 16 is delayed.

In the above, the steps 216 and 218 constitute the engine operating range determining means of the second embodiment for determining whether or not the current engine operating condition is within the HC amount insufficient range. Also, the steps 220 and 222 constitute the assist air amount control means of the second embodiment for decreasing the assist air amount or stopping supply of assist air when the engine operating condition is determined to be within the insufficient HC amount range. Therefore, the steps 220 and 222 constitute the HC amount control means of the second embodiment for momentarily degrading atomization of fuel injected from the fuel injection valve to thereby increase the amount of hydrocarbons included in the exhaust gas from the engine.

Operation of the first and second embodiments will now be explained.

When the engine operating condition is determined to be within the insufficient HC amount range, the assist air control valve 16 is closed so that supply of assist air is stopped or the supply amount of assist air is decreased. As a result, atomization of fuel and combustion in the cylinder are degraded and unburned fuel is exhausted to increase the HC amount included in the exhaust gas. The increased HC helps the lean NOx catalyst 18 to reduce NOx, and the NOx purification rate of the lean NOx catalyst 18 is improved.

When the engine operating condition is not within the insufficient HC amount range, atomization of fuel and combustion in the cylinder do not need to be degraded. Therefore, assist air is usually supplied.

In accordance with the first and second embodiments of the present invention, assist air supply is momentarily stopped or decreased when the engine operating condition is within the insufficient HC amount range, so that the HC amount included in the exhaust gas is increased by degrading the atomization of fuel, and the NOx purification rate of the lean NOx catalyst is improved.

Third Embodiment

FIGS. 12–25 correspond to a third embodiment wherein an internal combustion engine comprises a direct fuel injection-type two-stroke engine having an air blast fuel injection valve with a variable fuel injection rate and an HC amount is increased by changing the fuel injection rate of the air blast fuel injection valve.

Figure 23:
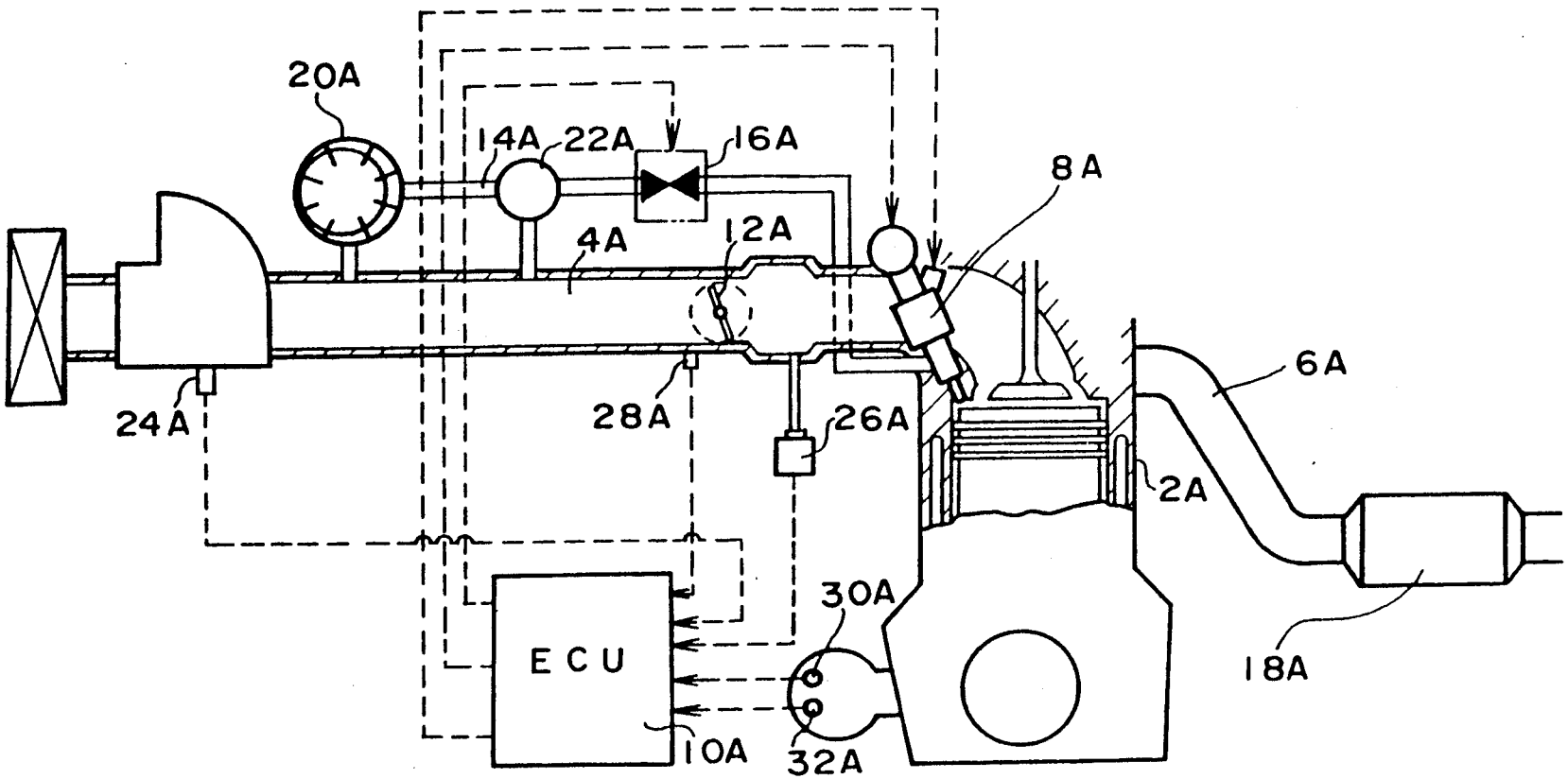
FIG. 23 is a schematic system diagram of the exhaust gas purification system for an internal combustion engine in accordance with the third embodiment of the invention.

As illustrated in FIG. 23, an exhaust gas purification system for an internal combustion engine in accordance with the third embodiment includes a direct fuel injection-type two-stroke engine 2A with an air blast fuel injection valve 8A which is installed in an intake conduit 4A of the engine 2A, a lean NOx catalyst 18A installed in an exhaust conduit 6A of the engine 2A, engine operating condition detecting means for detecting a current engine operating condition, engine operating range determining means for determining whether or not the current engine operating condition is in an insufficient HC amount range, and fuel injection rate changing means for changing a fuel injection rate of the air blast fuel injection valve 8A to a fuel injection rate which promotes thermal cracking of fuel in a cylinder when the engine operating range determining means determines that the engine operating condition is within the insufficient HC amount range. The fuel injection rate changing means constitutes the HC amount control means for the third embodiment.

Fuel injection and air injection of the air blast fuel injection valve 8A are controlled by an electronic control unit (hereinafter, ECU) 10A. Air is supplied to the air blast fuel injection valve 8A through an assist air conduit 14A from a portion of the intake conduit 4A upstream of a throttle valve 12A. An air pump 20A, a pressure regulator 22A, and an assist air control valve 16A are installed in the assist air conduit 14A so that air is pressurized by the air pump 20A and is regulated to a constant pressure by the pressure regulator 22A. When the assist air control valve 16A is switched "ON", the air is supplied to the air blast fuel injection valve 8A. Supply and supply stopping of the assist air are controlled by the ECU 10A.

Figure 24:
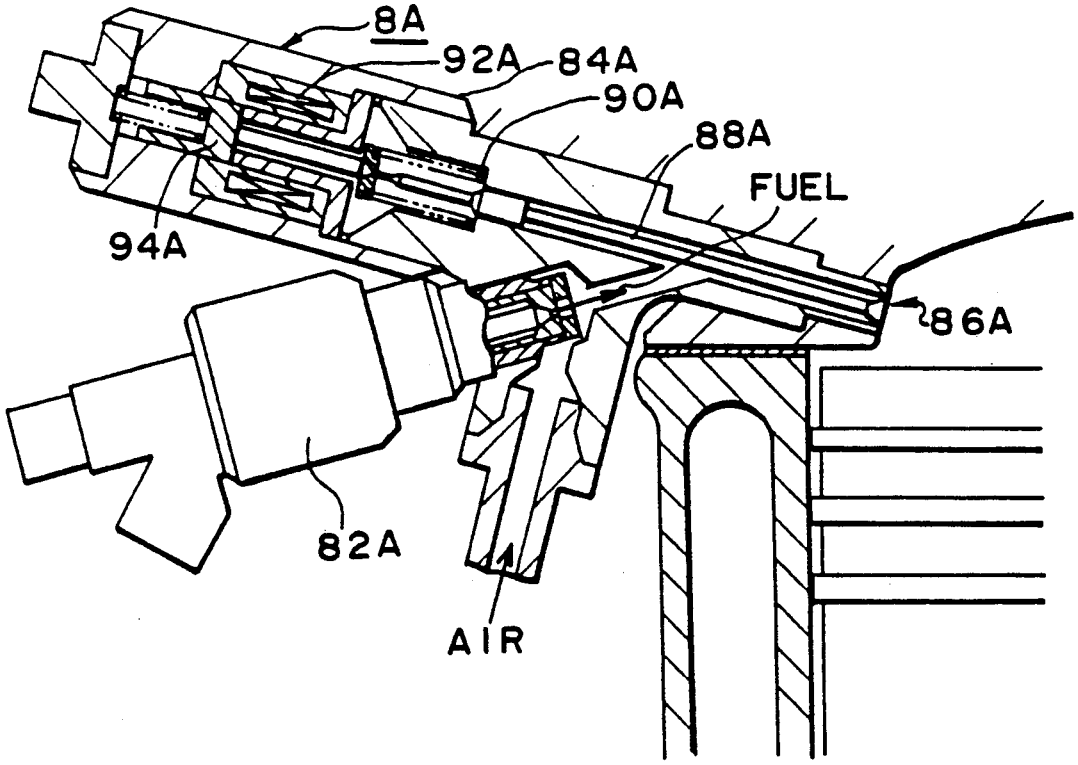
FIG. 24 is a side elevational, partially cross-sectioned view of an air blast fuel injection valve for the exhaust gas purification system for an internal combustion engine of FIG. 23.

As illustrated in FIG. 24, the air blast fuel injection valve 8A includes a fuel injection portion 82A and an air injection portion 84A. The air injection portion 84A includes a nozzle hole 86A, a needle 88A for opening and closing the nozzle hole 86A, a compression spring 90A for biasing the needle 88A in a valve closing direction, a solenoid 92A, and a movable core 94A for moving the needle 88A in a valve opening direction when the core is magnetically excited. Fuel injection timing and assist air injection timing are controlled by the ECU 10A.

The lean NOx catalyst 18A needs HC to reduce NOx. An HC amount is controlled by changing a fuel injection rate or fuel injection pattern of the air blast fuel injection valve 8A (control of FIGS. 12–19), without requiring a special HC supply device. When the fuel injection pattern is changed to a first injection pattern of FIG. 16 (an A injection pattern with an A fuel injection rate) where fuel is injected first and then air is injected, atomization of fuel is degraded and fuel penetrates a combustion chamber to flow deeply into the burned gas remaining in a bottom portion of the cylinder so that the injected fuel is not burned but cracked by heat of the remaining burned gas to HC molecules of medium size, and the amount of HC (unburned fuel) included in the exhaust gas is increased. In contrast, when the fuel injection pattern is changed to a second injection pattern of FIG. 17 (a B injection pattern with a B fuel injection rate) where fuel and air are injected at the same time, atomization of fuel is promoted so that the injected fuel is substantially completely burned, and the amount of HC included in the exhaust gas is decreased. However, since the A injection pattern degrades the fuel economy and increases HC emissions, execution of the A injection pattern should be limited to a time when the engine operating condition is within an insufficient HC amount range. Changing of the fuel injection rate is controlled by controlling operation of the air blast fuel injection valve 8A by the ECU 10A.

Figure 25:
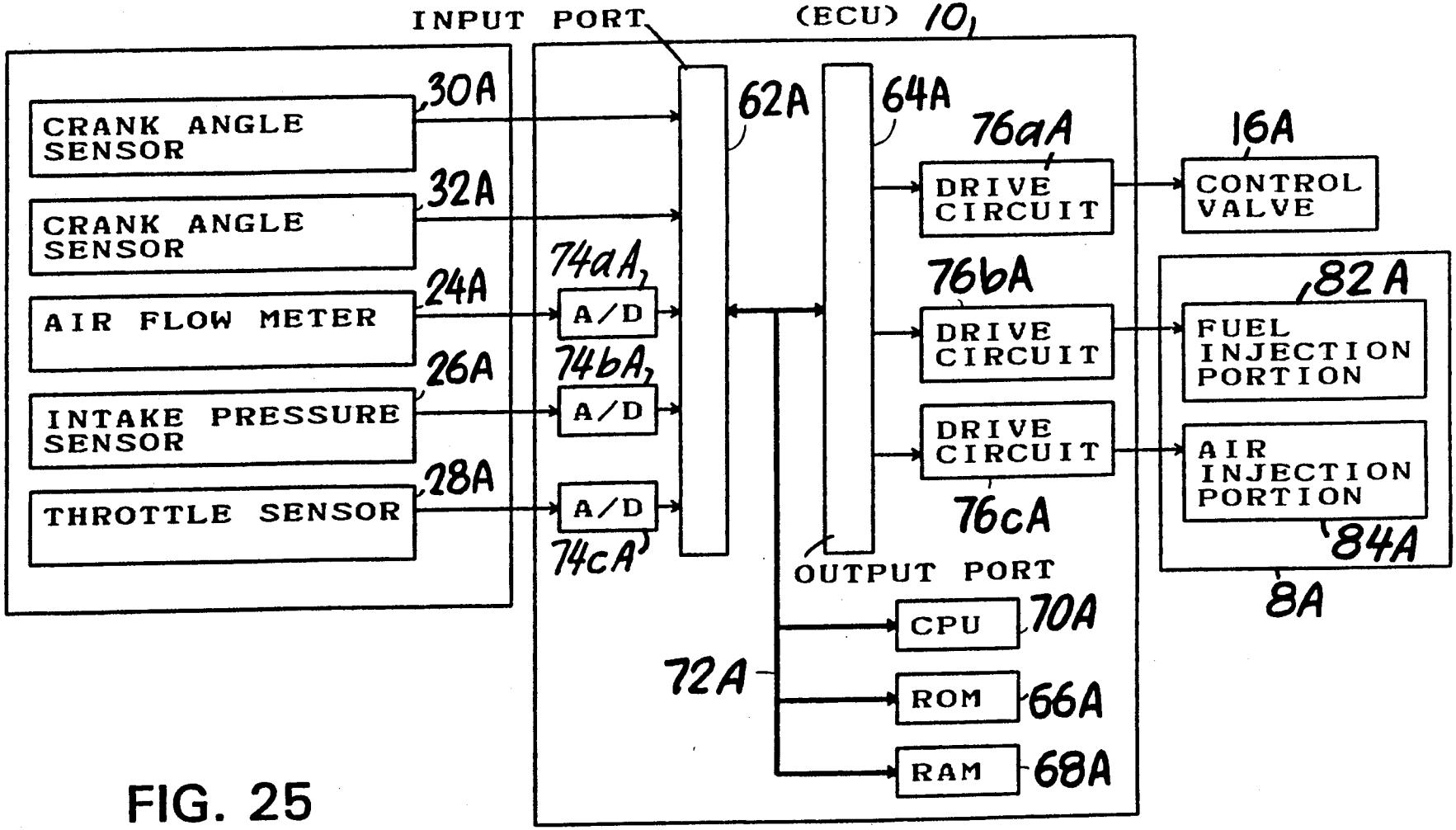
FIG. 25 is a block diagram of an ECU for the exhaust gas purification system for an internal combustion engine of FIG. 23.

The ECU 10A comprises a micro computer. As illustrated in FIG. 25, the ECU 10A includes an input port or input interface 62A, an output port or output interface 64A, a read-only memory (ROM) 66A, a random access memory (RAM) 68A, and a central processor unit (CPU) 70A which are connected to each other by a circuit 72A. Analog signals from an air flow meter 24A, an intake pressure sensor 26A, and a throttle sensor 28A are converted to digital signals by analog/digital converters **74*a*A, 74*b*A, and 74*c*A, respectively, and then are fed to the input port 62A. Digital signals from a first crank angle sensor 30A and a second crank angle sensor 32A are fed directly to the input port 62A. A drive circuit 76*a*A for driving the assist air control valve 16A, a drive circuit 76*b*A for driving the fuel injection portion 82A of the air blast fuel injection valve 8A, and a drive circuit 76*c*A for driving the air injection portion 84A of the air blast fuel injection valve 8A are connected to the output port 64A. At least one of the above-described sensors 24A, 26A, 28A, 30A, and 32A constitutes the engine operating condition detecting means for detecting the operating condition (for example, engine speed and engine load) of the internal combustion engine 2A**.

Figure 20:
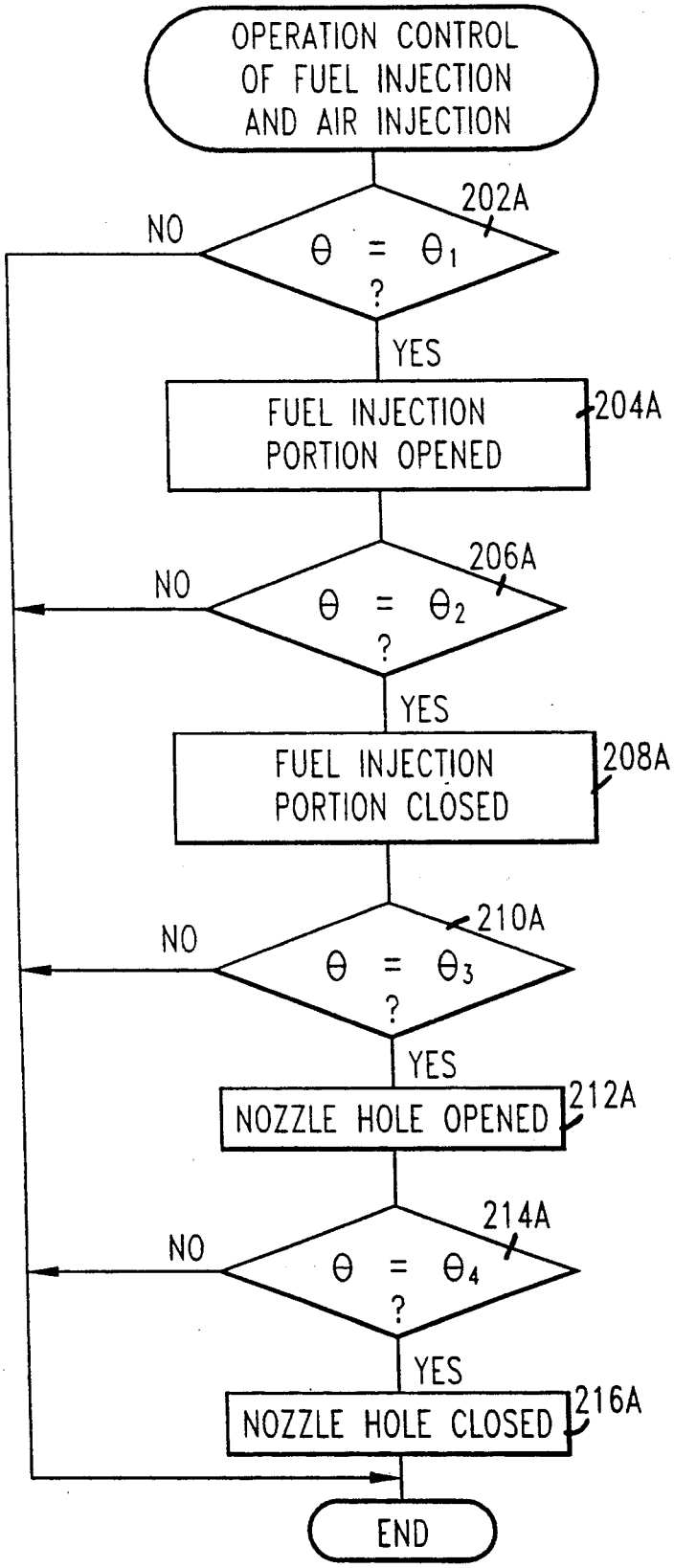
FIG. 20 is a flow chart of fuel injection control and air injection control for the exhaust gas purification system for an internal combustion engine in accordance with the third embodiment of the invention.
Figure 21:
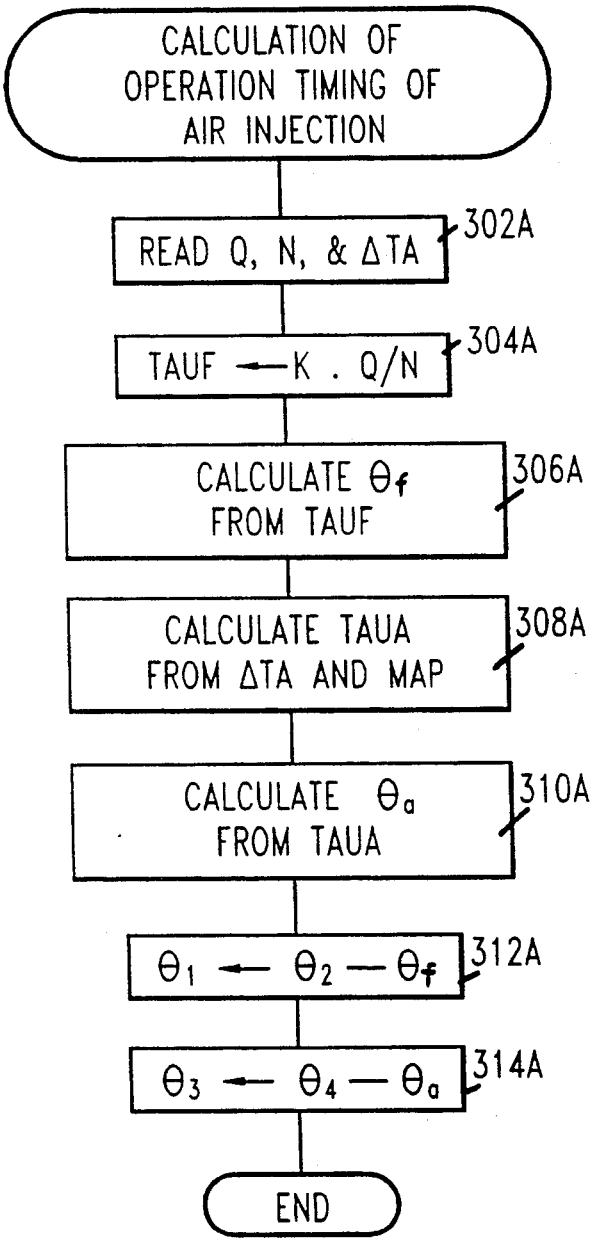
FIG. 21 is a flow chart of calculation of air injection timing and fuel injection timing for the exhaust gas purification system for an internal combustion engine in accordance with the third embodiment of the invention.
Figure 22:
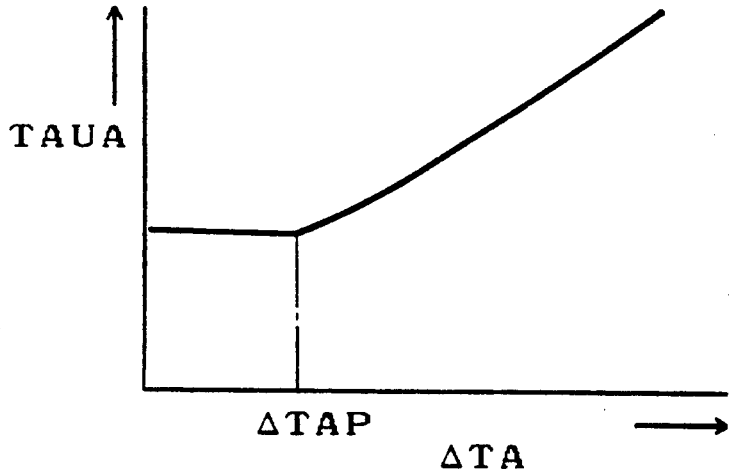
FIG. 22 is a graphical representation of a map of air injection amount versus throttle valve opening and closing speed used in calculation by the flow chart of FIG. 21.

The ECU 10A stores programs and maps of FIGS. 20–22 in the ROM 66A and these are called by the CPU 70A where calculation is executed.

FIG. 21 illustrates a routine for calculating a operation timing of the air blast fuel injection valve 8A. This routine is entered at intervals of predetermined periods of time. At step 302A, an intake air amount Q (an output of the air flow meter 24A), an engine speed NE (calculated from an output of the crank angle sensor 30A), and a throttle valve opening and closing speed delta TA (calculated from an output of the throttle sensor 28A) are entered. In this instance, a positive value of the delta TA corresponds to opening the throttle valve 12A. Then, at step 304A, a period of time of an opened state of the fuel injection portion 82A (a period of time of fuel supply) TAUF is calculated from the following equation:

$$TAUF = K \times Q/N$$

where, K is a modification factor.

Then, at step 306A, the period of time of fuel supply is converted to a fuel supply crank angle $\theta_f$. Then, at step 308A, a nozzle hole opening period of time (air injection period of time) TAUA is calculated from the throttle valve opening and closing speed delta TA using a map of FIG. 22. As illustrated in FIG. 22, a relationship between delta TA and TAUA is predetermined such that TAUA is constant when delta TA is smaller than a predetermined throttle valve opening and closing speed delta TAP, and TAUA substantially linearly increases when delta TA is equal to or larger than delta TAP, that is, when the engine is accelerated.

Figure 18:
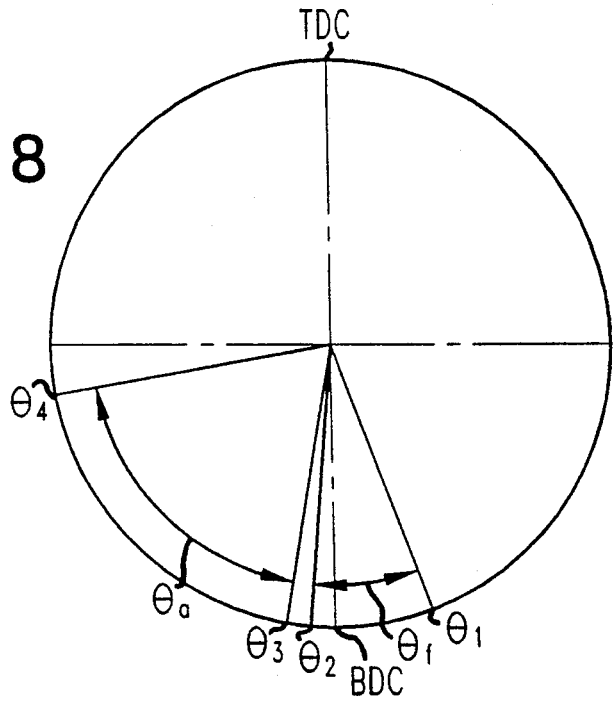
FIG. 18 is a chart illustrating a fuel injection period of time and an air injection period of time in the form of a crank angle in the case of the A injection pattern.
Figure 19:
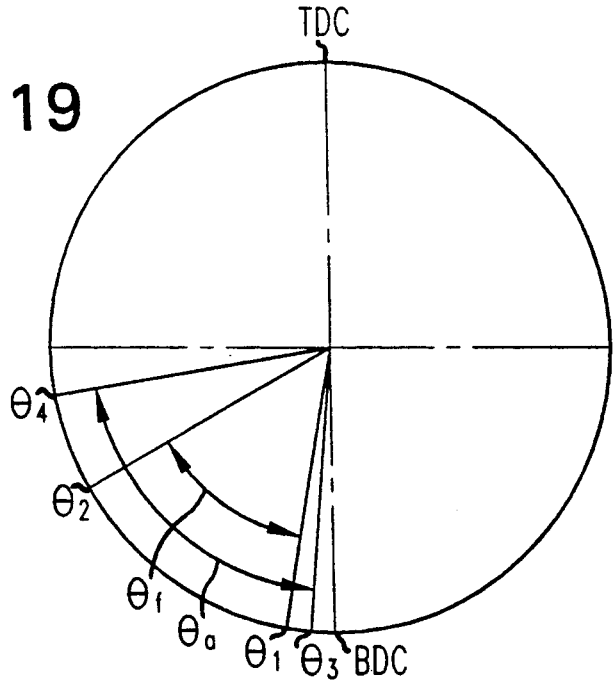
FIG. 19 is a chart illustrating a fuel injection period of time and an air injection period of time in the form of a crank angle in the case of the B injection pattern.

At step 310A, the air injection period of time TAUA is converted to an air injection crank angle $\theta_a$. Then, at step 312A, a fuel supply beginning crank angle $\theta_1$ is calculated by the following equation:

$$\theta_1=\theta_2-\theta_f$$

where, $\theta_2$ is a fuel supply stop crank angle which is a fixed angle predetermined for each of the A injection pattern and the B injection pattern (see FIGS. 18 and 19).

Then, at step 314A, a nozzle hole opening crank angle $\theta_3$ is calculated by the following equation:

$$\theta_3=\theta_4-\theta_a$$

where, $\theta_4$ is a nozzle hole closing crank angle which is a fixed angle predetermined for each of the A injection pattern and the B injection pattern (see FIGS. 18 and 19).

FIG. 20 illustrates a routine for controlling operation of the air injection portion 84A of the air blast fuel injection valve 8A. This routine is entered at intervals of predetermined periods of time, as counted by the output of the second crank angle sensor 32A.

At step 202A, it is determined whether or not the current crank angle $\theta$ has reached the fuel supply beginning crank angle $\theta_1$. When $\theta$ has reached $\theta_1$, the routine proceeds to step 204A where the fuel injection portion 82A is opened. Then, at step 206A, it is determined whether or not the current crank angle $\theta$ has reached the fuel supply stopping crank angle $\theta_2$. When $\theta$ has reached $\theta_2$, the routine proceeds to step 208A where the fuel injection portion 82A is closed. Then, at step 210A, it is determined whether or not the current crank angle $\theta$ has reached the nozzle hole opening crank angle $\theta_3$. When $\theta$ has reached $\theta_3$, the routine proceeds to step 212A where the nozzle hole 86A is opened and air is injected to blow the injected fuel into the intake conduit or the combustion chamber of the engine. Then, at step 214A, it is determined whether or not the current crank angle $\theta$ has reached the nozzle hole closing crank angle $\theta_4$. When $\theta$ has reached $\theta_4$, the routine proceeds to step 216A where the nozzle hole 86A is closed. Then, the routine ends.

Control in accordance with the routine of FIG. 12 is executed so that a fuel injection rate optimum to the current engine operating condition is elected before control in accordance with the routines of FIGS. 21 and 20 are executed.

The routine of FIG. 12 is entered at intervals of predetermined periods of time. At step 102A, the current engine operating conditions including an engine load Q/N and an engine speed NE are entered. Then, at step 104A, it is determined using a map of FIG. 13 whether or not the current engine operating condition is within an insufficient HC amount range. A medium engine load and medium engine speed range is a typical example of such insufficient HC amount range. The step 104A constitutes an engine operating range determining means.

Figure 16:
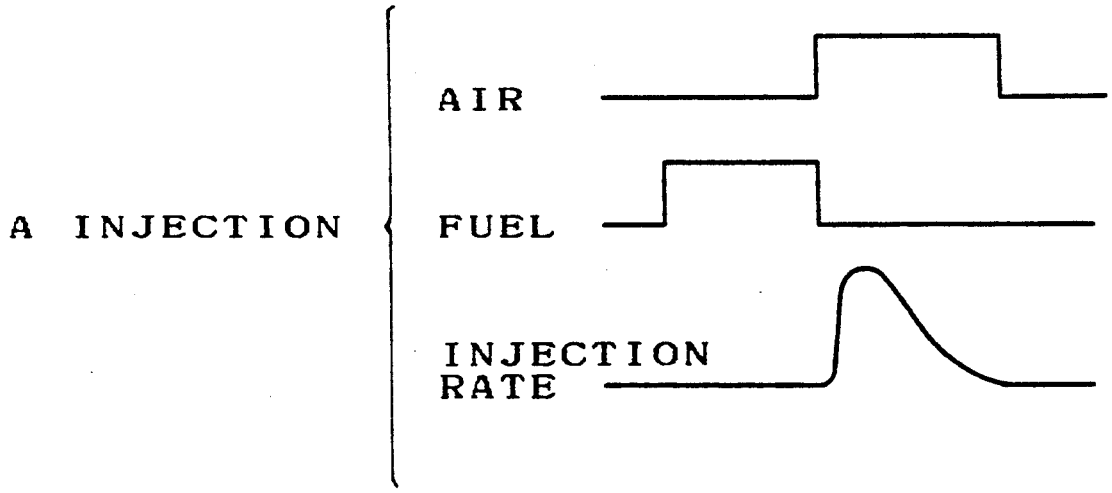
FIG. 16 is a chart illustrating relationships between an air injection, a fuel injection, and a fuel injection rate in the case of the A injection pattern.

When it is determined at step 104A that the engine operating condition is within the insufficient HC amount range, that is, that the engine operating condition is within a range where the A injection should be executed, the routine proceeds to step 108A. At step 108A, using the map of FIG. 14 of $EOI_f$ (end of injection, fuel) and $EOI_a$ (end of injection, air) versus NE (engine speed), a fuel injection end time crank angle $\theta_2$ and an air injection end time crank angle $\theta_4$ corresponding to the current engine speed NE are calculated, and these values are stored in the RAM 68A. In the A injection pattern, the crank angle $\theta_2$ is advanced to the crank angle $\theta_4$ so that the fuel injection period of time and the air injection period of time do not overlap one another, as shown in FIGS. 16 and 18. Therefore, when injection is executed in accordance with the routines of FIGS. 21 and 20, the fuel injected from the fuel injection portion 82A stays in the vicinity of the needle 88A and then is injected into the cylinder in the form of a lump when the nozzle hole 86A is opened. FIG. 16 illustrates the A injection pattern where a main portion of fuel is injected in the form of a lump at an early stage of the injection period of time. Since the injected fuel is not atomized, the injected fuel has a strong penetration and flows deeply into a lower end portion of the cylinder where burned gas of the previous cycle tends to stay. The fuel flowing into the lower end portion of the cylinder is heated and is thermally cracked to generate HC molecules of medium size. The step 108A constitutes a fuel injection rate changing means which corresponds to the HC amount control means of the third embodiment.

Figure 17:
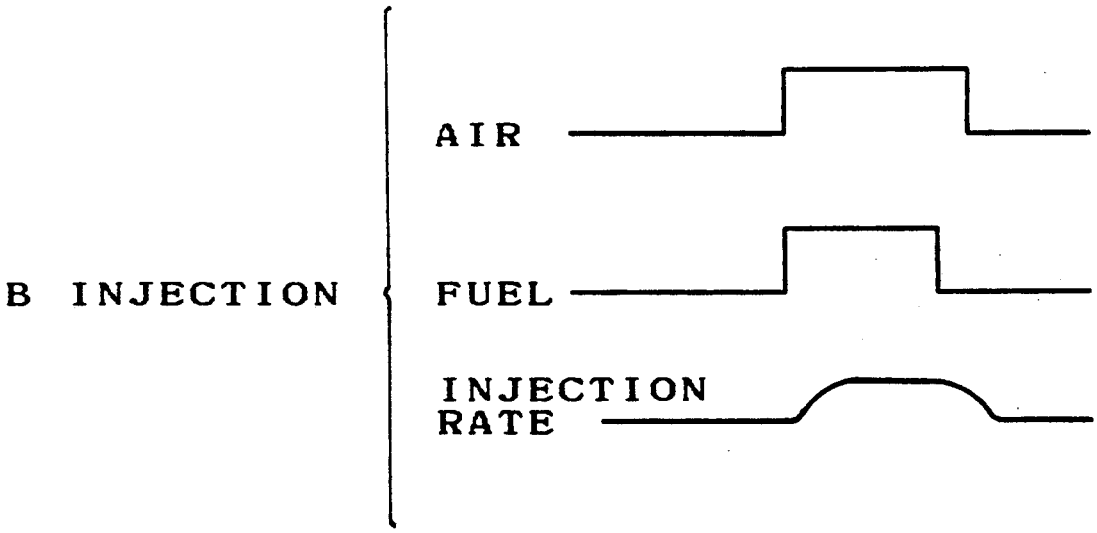
FIG. 17 is a chart illustrating relationships between an air injection, a fuel injection, and a fuel injection rate in the case of the B injection pattern.

When it is determined at step 104A that the current engine operating condition is not within the range where much NOx is generated and exhausted, that is, is within a range where the B injection should be executed, the routine proceeds to step 106A. At step 106A, a fuel injection end time $\theta_2$ and an air injection end time $\theta_4$ corresponding to the current engine speed NE are calculated based on a map of $EOI_f$ and $EOI_a$ versus NE of FIG. 15 and are stored in the RAM. In the B injection, the advance crank angle of $\theta_2$ to $\theta_4$ is small, and therefore the fuel injection period of time and the air injection period of time overlap one another as shown in FIGS. 17 and 19. As a result, the B injection shows a flat fuel injection rate as shown in FIG. 17. In such fuel injection, atomization of fuel is promoted and fuel is well burned in the cylinder so that the HC amount in the exhaust gas is decreased. However, since the B injection is executed when a NOx generation amount is small, no problem occurs from the viewpoint of NOx purification. In the B injection, good combustion and good fuel economy are obtained.

Operation of the exhaust gas purification system of the third embodiment will now be explained. In the operation range where NOx is little generated and exhausted, the lean NOx catalyst 18A can smoothly reduce NOx using a blow-by fuel (HC) which is specifically obtained in a two-stroke engine. In contrast, when the engine operating range determining means determines at step 104A that the engine operating condition is within the insufficient HC amount range, the fuel injection rate changing means (step 108A) changes the current fuel injection pattern to the A injection pattern. In the A injection pattern, utilizing the phenomenon specific to a two-stroke engine that burned gas tends to stay in the lower portion of the cylinder, fuel is injected into the lower portion of the cylinder where the injected fuel is thermally cracked to HC molecules of medium sizes without being burned. The medium size HC is especially effective in reducing NOx.

In accordance with the third embodiment, when the engine operating range determining means 104A determines that the current engine operating condition is within the insufficient HC amount range, the fuel injection rate changing means 108A (the HC control means of the third embodiment) changes the current fuel injection rate to the A fuel injection rate where much medium molecualy size HC is generated to improve the NOx reduction rate of the lean NOx catalyst 18A.

Fourth Through Sixth Embodiments

Figure 26:
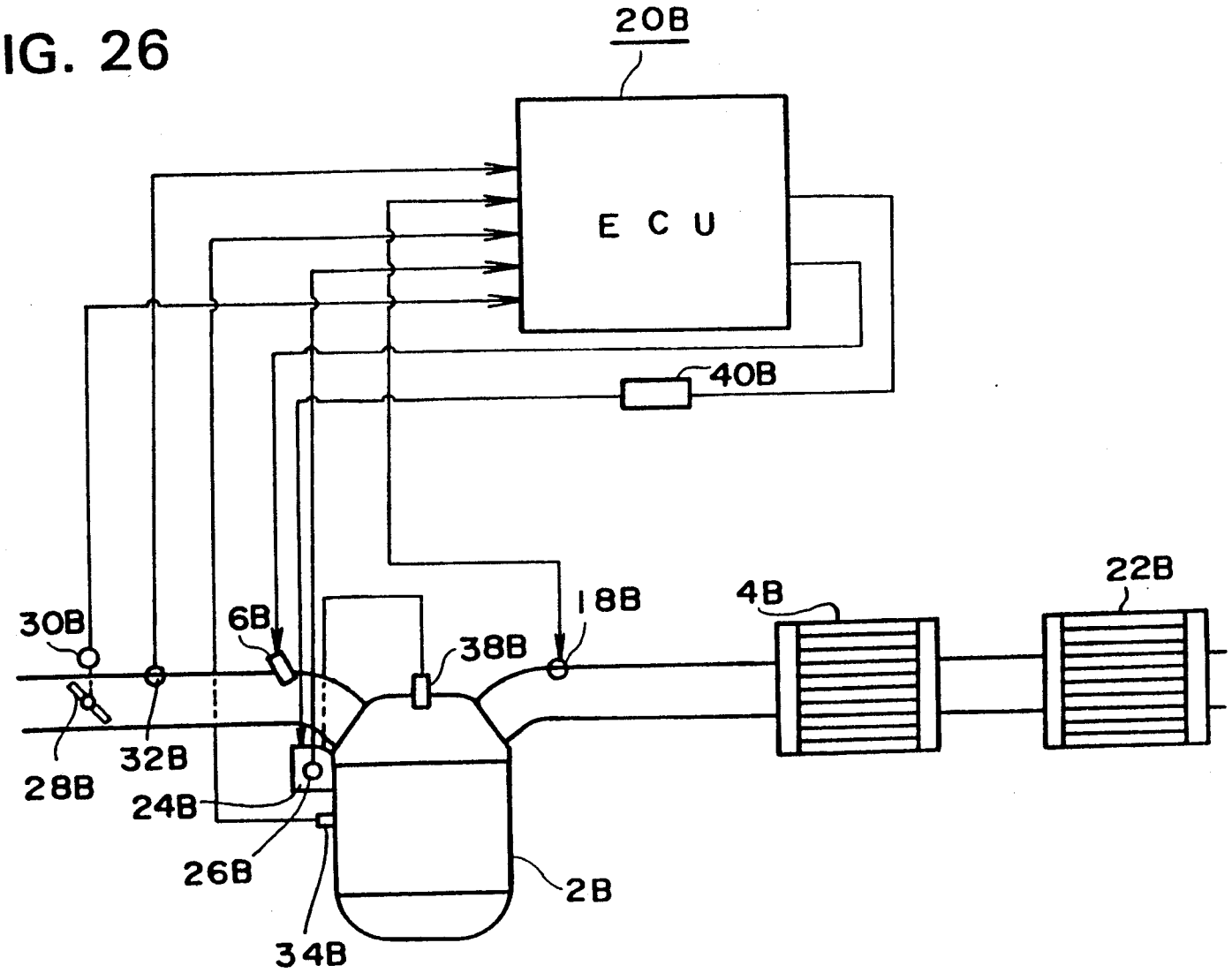
FIG. 26 is a schematic system diagram of an exhaust gas purification system for an internal combustion engine in accordance with fourth through sixth embodiments of the present invention.

FIGS. 26–39 illustrate the fourth embodiment through the sixth embodiment of the present invention wherein an internal combustion engine is provided with a fuel injection valve with a variable fuel injection rate and an HC amount is increased by forcibly changing the fuel injection rate to a high fuel injection rate. FIG. 36 corresponds to the fourth embodiment, FIG. 37 corresponds to the fifth embodiment, and FIG. 38 corresponds to the sixth embodiment. The remaining FIGS. 26–35 and 39 are applicable to any of the fourth and sixth embodiments. FIG. 26 illustrates a case where an engine comprises a gasoline engine, but the engine may comprise a diesel engine.

As illustrated in FIG. 26, an exhaust gas purification system for an internal combustion engine in accordance with the fourth through sixth embodiments includes an interal combustion engine 2B capable of fuel combustion at lean air-fuel ratios, a lean NOx catalyst 4B installed in an exhaust conduit of the engine, a fuel injection valve 6B capable of changing a fuel injection rate thereof, an engine operating condition detecting means for detecting the operating condition of the engine, an engine operating range determining means for determing whether the current engine operating condition is within an insufficient HC amount range, and a fuel injection rate changing means for forcibly changing the fuel injection rate of the fuel injection valve 6B to a high fuel injection rate when the engine operating range determining means determines that the current engine operating condition is within the insufficient HC amount range. The fuel injection rate changing means constitutes the HC amount control means for the fourth through sixth embodiments.

Also, in the exhaust conduit, an air-fuel ratio sensor 18B is installed upstream of the lean NOx catalyst 4B and a three-way catalyst 22B or an oxidation catalyst is installed downstream of the lean NOx catalyst 4B. In an intake conduit of the engine 2B, a throttle valve 28B is installed, and an opening degree of the throttle valve 28B is detected by a throttle sensor 30B. In the intake conduit, an intake pressure sensor 32B is installed downstream of the throttle valve 28B. In each intake port connected to each cylinder of the engine (in the case of a diesel engine, in each cylinder), the fuel injection valve 6B with a variable fuel injection rate is installed. In the case of a spark ignition engine, a spark plug 38B is installed in each cylinder. Reference numerals 40B and 24B illustrate an ignitor and a distributor for distributing electric current to each spark plug. A rotational shaft of the distributor 24B is operatively coupled to a crankshaft of the engine 2B, and a crank angle sensor 26B for calculation of engine speed is housed in the distributor 24B. Also, a cooling water detecting sensor 34B is installed on the engine 2B.

Figure 27:
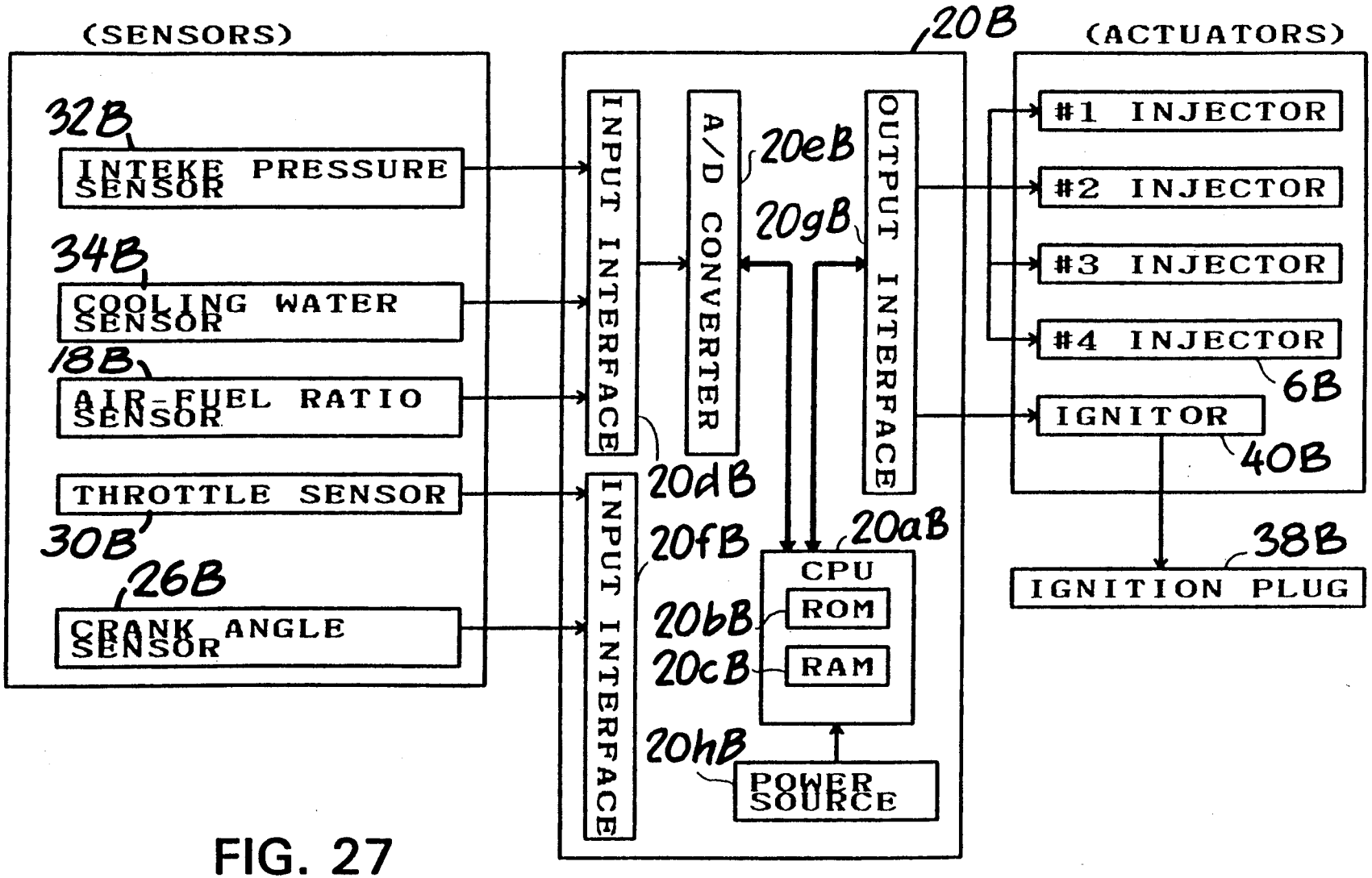
FIG. 27 is a block diagram of an ECU for the exhaust gas purification system for an internal combustion engine of FIG. 26.

The engine 2B is controlled by an electronic control unit (hereinafter, ECU) 20B which comprises a micro computer. FIG. 27 illustrates the structure of the ECU 20B. As illustrated in FIG. 27, the ECU 20B includes a central processor unit (CPU) 20*a*B for executing calculation, a read-only memory (ROM) 20*b*B, a random access memory (RAM) 20*c*B, an input interface 20*d*B for analog signals, an analog/digital converter 20*e*B for converting analog signals to digital signals, an input interface 20*f*B for digital signals, an output interface 20*g*B, and a power source 20*h*B.

Outputs of engine operating detecting means which includes the intake pressure sensor 32B, the cooling water temperature sensor 34B, and the air-fuel ratio sensor 18B are fed to the input interface 20*d*B, and outputs of the crank angle sensor 26B and throttle sensor (digital sensor) 30B are fed to the input interface 20*f*B. The outputs of the CPU 20*a*B are sent via the output interface 20*g*B to fuel injection valves 6B to drive actuators thereof.

Figure 28:
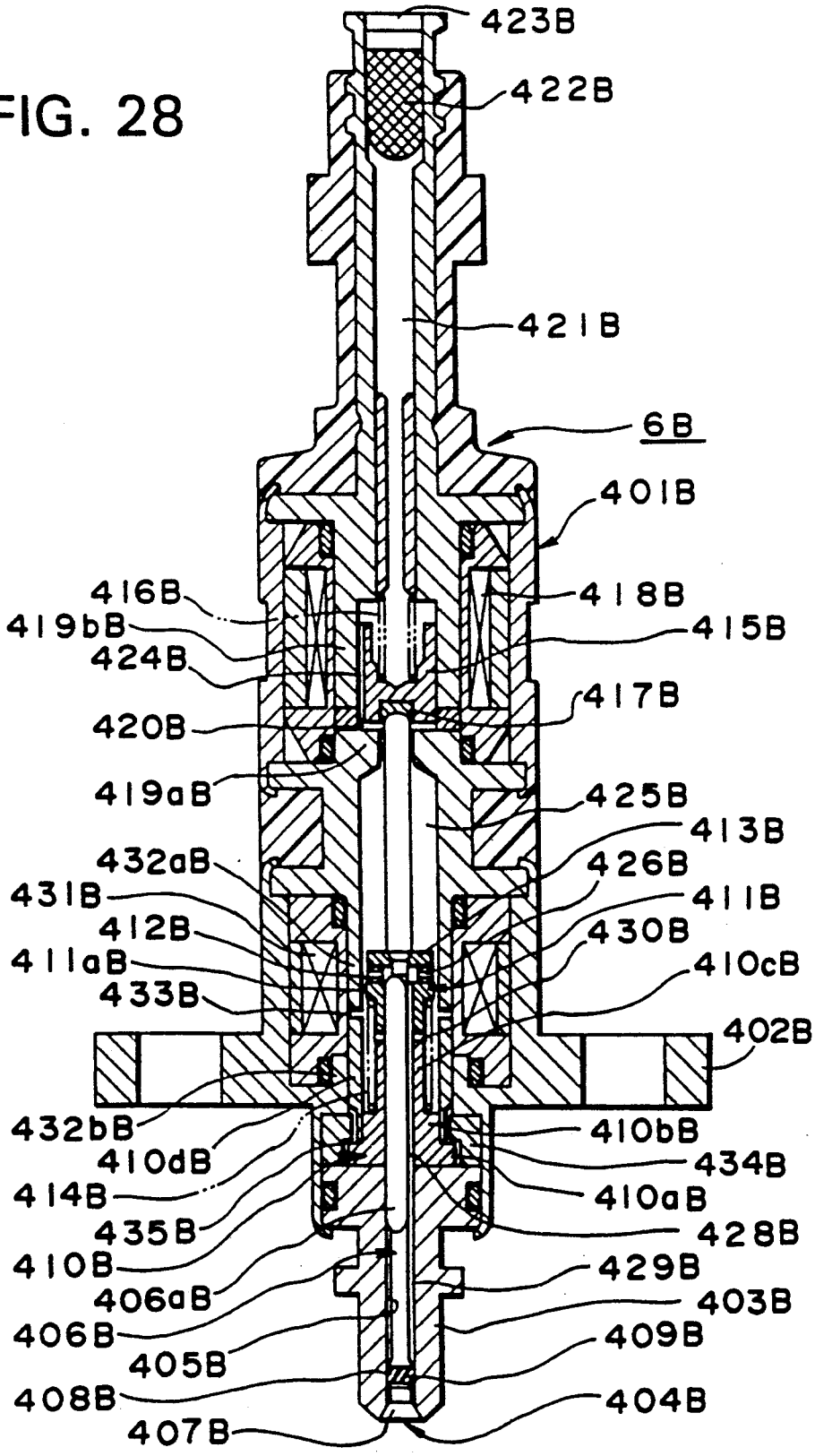
FIG. 28 is a cross-sectional view of a fuel injection valve with a variable fuel injection rate for the exhaust gas purification system for an internal combustion engine of FIG. 26.

FIG. 28 illustrates the detail of the fuel injection valve 6B with a variable fuel injection rate. As illustrated in FIG. 28, a valve main body 401B has a flange 402B for fixing the valve main body 401B to a cylinder head. A nozzle holder 403B is fixed to the end portion of the valve main body 401B, and a nozzle hole 404B is formed in an end portion of the nozzle holder 403B. A needle insertion hole 405B is formed in the nozzle holder 403B, and a needle 406B is slidably inserted in the needle insertion hole 405B. A cone valve portion 407B is formed at the end portion of the needle 406B, and a cylindrically protruded portion 408B is also formed in the needle 406B adjacent to the cone valve portion 407B. A spiral groove 409B is formed in a radially outer portion of the cylindrically protruded portion 408B. A stopper member 410B is slidably inserted in a space around the needle 406B so that the stopper member 410B can seat on an axially inboard surface of the nozzle holder 403B. The stopper member 410B includes a lower end portion 410*a*B with a large diameter, an intermediate portion 410*b*B with a medium diameter, an upper end portion 410*c*B with a small diameter, and a cylindrical core portion 410*d*B which is coaxial with respect to the upper end portion 410*c*B and is fixed to the intermediate portion 410*b*B. A spring retainer 411B is installed above the upper end portion 410*c*B of the stopper member 410B and around the needle 406B. A spacer 412B and a snap ring 413B fitted to a groove formed in the needle 406B are installed above the spring retainer 411B. A compression spring 414B is inserted between an enlarged head 411*a*B of the spring retainer 411B and the intermediate portion 41*b*B of the stopper member 410B. A spring force of the compression spring 414B is transmitted via the spring retainer 411B, the spacer 412B, and the snap ring 413B to the needle 406B. Therefore, the needle 406B is constantly biased upward by the spring force of the compression spring 414B so that the valve portion 407B of the needle 406B would close the nozzle hole 404B.

A movable core 415B is slidably inserted above an upper end portion of the needle 406B and is pressed against the upper end portion of the needle 406B by a spring 416B. The spring force of the spring 416B is smaller than the spring force of the compression spring 414B. An anti-abrasion member 417B is fitted to a lower end portion of the movable core 415B. A first exciting coil 418B which constitutes a first actuator is installed around the movable core 415B. When the first exciting coil 418B is magnetically excited, a magnetic path is formed so as to pass through a stator portion 419*a*B, a clearance 420B between the stator portion 419*a*B and the movable core 415B, the movable core 415B, and the stator portion 419*b*B, so that the movable core 415B is moved so as to decrease the clearance 420B. A fuel inlet passage 421B is formed above the movable core 415B, and the fuel inlet passage 421B is connected via a filter 422B to a fuel inlet 423B.

Fuel flows via the filter 422B into the fuel inlet passage 421B and flows through a fuel groove 424B formed in a radially outer portion of the movable core 415B to a fuel passage 425B formed around the needle 406B. Then, the fuel flows via a hole 426B formed in the spacer 412B to a space formed between the needle 406B and the spring retainer 411B. A portion of the needle 406B inside the spring retainer 411B and the stopper member 410B is formed with a triangular cross section having three flat sides 406*a*B and forming a fuel passage 428B between the needle portion and the spring retainer 411B. The fuel flows through the fuel passage 428B, then flows through an annular fuel passage 429B formed between the needle insertion hole 405B and the needle 406B, and then flows through the spiral groove 409B to a space behind the valve portion 407B. Since the movable core 415B moves so as to decrease the clearance 420B when the first exciting coil 418B is magnetically excited, the needle 406B is lowered to cause the valve portion 407B to open the nozzle hole 404B so that fuel is injected from the nozzle hole 404B.

As illustrated in FIG. 28, a clearance 430B is formed between the upper end portion 410*c*B of the stopper member 410B and the lower end portion of the spring retainer 411B. When the first exciting coil 418B is magnetically excited, the needle 406B is lowered so that the lower end portion of the spring retainer 411B contacts the upper end portion 410*c*B of the stopper member 410B. Since a maximum lift amount of the needle 406B is equal to the height of the clearance 430B, the needle lift can be adjusted by changing the height of the clearance 430B.

A second exciting coil 431B which constitutes a second actuator is installed around the cylindrical core portion 410*d*B of the stopper member 410B. When the second exciting coil 431B is excited, a magnetic path is formed so as to pass through a stator portion 432*a*B, a clearance 433B formed between the stator portion 432*a*B and the core portion 410*d*B, the core portion 410*d*B, and a stator portion 432*b*B so that the core portion 410*d*B is moved so as to decrease the clearance 433B. A position ring 434B for adjusting the movement amount of the stopper member 410B is fitted between the valve main body 401B and the nozzle holder 403B, and a clearance 435B is formed between the position ring 434B and the lower end portion 410*a*B of the stopper member 410B. This clearance 435B is set smaller than the clearance 433B defined between the stator portion 432*a*B and the core portion 410*d*B and the clearance 430B defined between the spring retainer 411B and the stopper member 410B. Since the core portion 410*d*B moves so as to decrease the clearance 433B when the second exciting coil 431B is excited, the stopper member 410B moves away from the nozzle holder 403B and moves upward so that the lower end portion 410*a*B finally contacts the position ring 434B. As a result, the clearance 430B between the spring retainer 411B and the stopper member 410B is decreased by an amount corresponding to the clearance 435B. Therefore, under this condition, the maximum lift amount of the needle 406B is decreased, when the first exciting coil 418B is excited.

Figure 29:
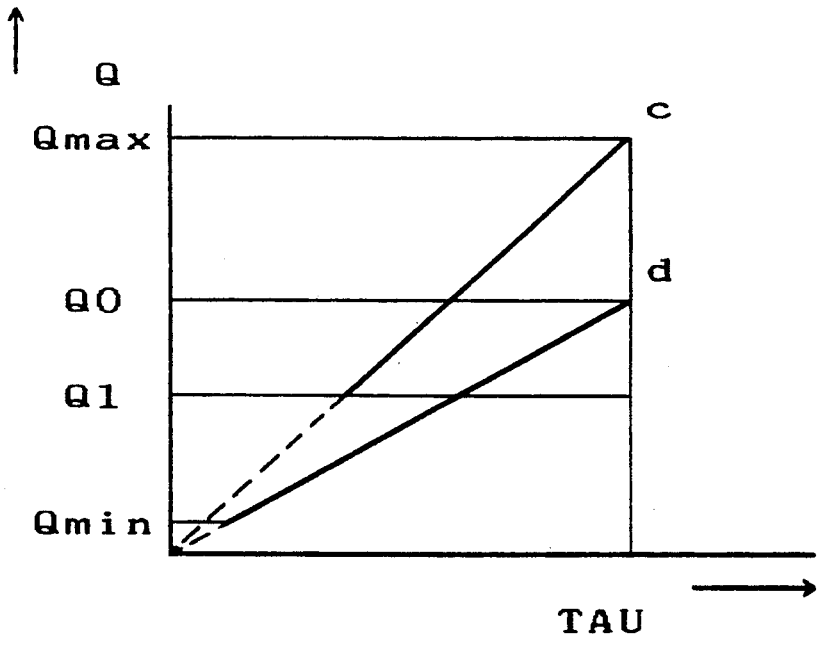
FIG. 29 is a graphical representation of a map of fuel injection amount versus fuel injection period of time for the fuel injection valve of FIG. 28.

FIG. 29 illustrated a relationship between a fuel injection amount Q and a fuel injection period of time TAU in the case where the maximum lift position of the needle 406B is changed by controlling the stopper member 410B. In FIG. 29, a line c illustrated a case where the second exciting coil 431B is not excited and a line d illustrates a case where the exciting coil 431B is excited. When the maximum lift amount of the needle 406B is small, the fuel injection amount per unit period of time is small. Therefore, the injection amount of the case of d is smaller than the injection amount of the case of c. In FIG. 29, when the fuel injection amount Q is smaller than a first predetermined injection amount Q0, the second exciting coil 431B is excited and the maximum lift amount of the needle 406B is decreased, and when the fuel injection amount Q is larger than a second predetermined injection amount Q1, the maximum lift amount of the needle 406B is increased. As a result, the injection amount can be changed over a wide range between the maximum injection amount and the minimum injection amount in a short period of time.

Figure 30:
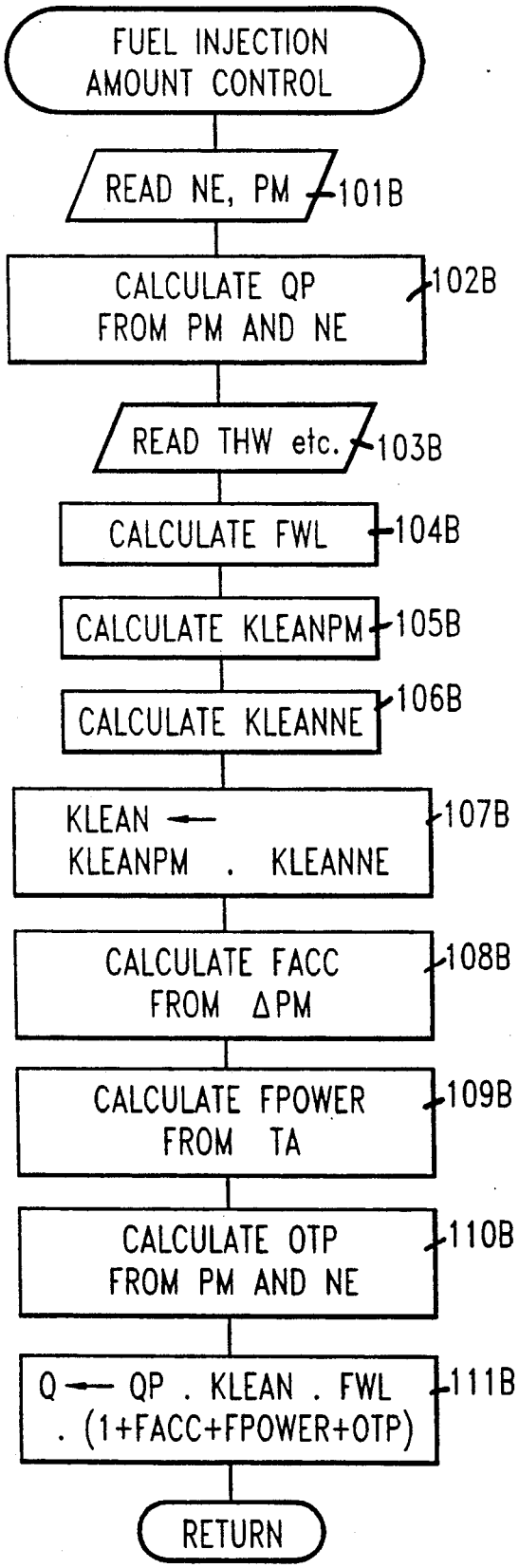
FIG. 30 is a flow chart of fuel injection control for the exhaust gas purification system for an internal combustion engine of FIG. 26.
Figure 31:
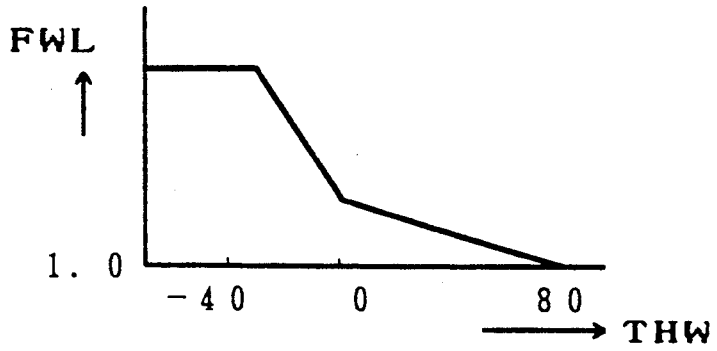
FIG. 31 is a graphical representation of a map of fuel injection amount modification factor versus cooling water temperature used in calculation by the flow chart of FIG. 30.
Figure 32:
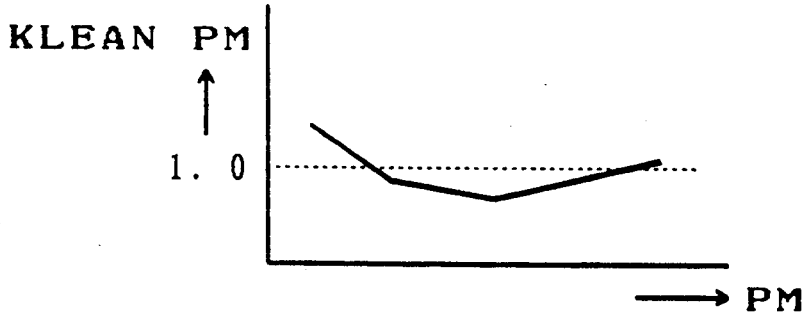
FIG. 32 is a graphical representation of a map of fuel injection amount modification factor versus intake pressure used in calculation by the flow chart of FIG. 30.
Figure 33:
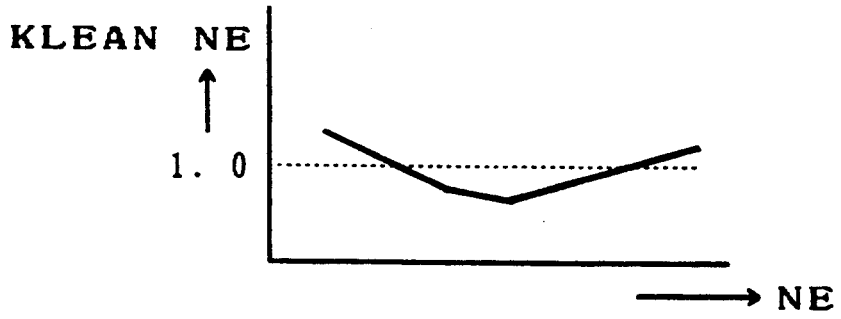
FIG. 33 is a graphical representation of a map of fuel injection amount modification factor versus engine speed used in calculation by the flow chart of FIG. 30.

FIG. 30 illustrated a routine for fuel injection control which is stored in the ROM 20*b*B and called by the CPU 20*a*B. The routine is entered at intervals of predetermined crank angles, for example at 180° crank angle intervals.

At step 101B, the current engine speed NE which is calculated from an output of the crank angle sensor 26B and the current intake pressure PM which is an output of the intake pressure sensor 32B are entered. Then, at step 102B, a basic fuel injection amount QP is calculated from the current PM and NE so that a calculated air-fuel ratio is equal to the theoretical air-fuel ratio.

Then, the basic fuel injection amount is modified. More particularly, at step 103B, the engine cooling water temperature THW which is an output of the cooling water temperature sensor 34B is entered. Then, at step 104B, a cooling water temperature increment factor FWL is calculated using a map of FIG. 31 of FWL versus THW.

The basic fuel injection amount QP also should be modified on the basis of the engine speed NE and the intake pressure PM. More particularly, at step 105B, a lean modification factor KLEANPM of a fuel injection amount due to an intake pressure is calculated using a KLEANPM versus PM map of FIG. 32. Also, at step 106B, a lean modification factor KLEANNE of a fuel injection amount due to an engine speed is calculated using a KLEANNE versus NE map of FIG. 33. Then, at step 107B, a lean modification factor KLEAN is calculated from KLEANPM and KLEANNE.

The basic fuel injection amount may be further modified for an acceleration time increment, a throttle full open time increment, and a catalyst over-heat protection increment. More particularly, at step 108B, the acceleration time increment factor FACC is calculated from a variance delta PM of the intake pressure. At step 109B, the throttle full open time increment factor FPOWER is calculated from a throttle opening degree TA. Also, at step 110B, the catalyst over-heat protection increment factor OTP is calculated from the intake pressure PM and the engine speed NE.

Then, at step 111B1 the fuel injection amount Q is calculated from the following equation:

$$Q = QP \times KLEAN \times FWL \times (1 + FACC + FPOWER + OTP)$$

Figure 34:
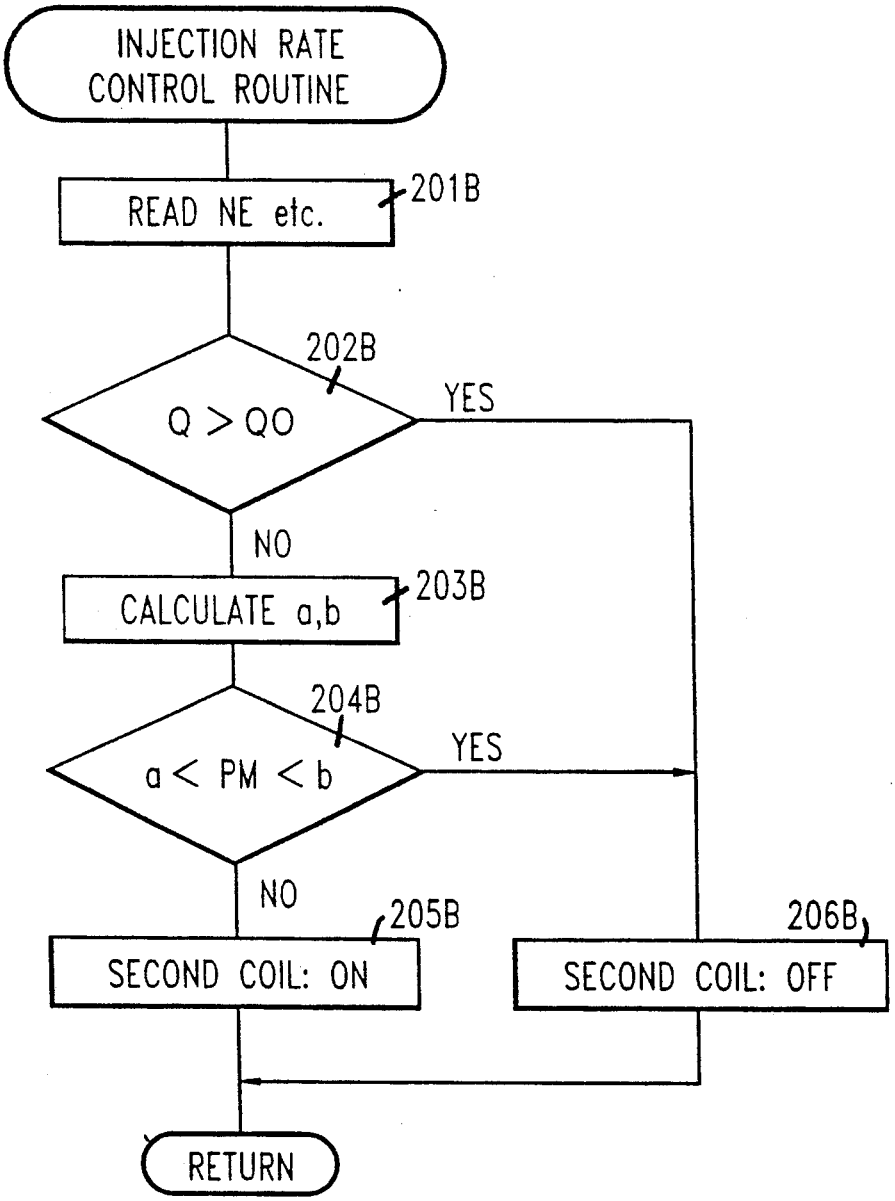
FIG. 34 is a flow chart of fuel injection rate changing control for the exhaust gas purification system for an internal combustion engine of FIG. 26.

Then, a routine of FIG. 34 for fuel injection rate control is entered. At step 201B, various data including the fuel injection amount Q, the engine speed NE, and the intake pressure PM are entered. Then, at step 202B, it is determined whether or not the fuel injection amount Q is larger than a predetermined fuel injection amount Q0. When Q is larger than Q0, the routine proceeds to step 206B and the second exciting coil is switched to "OFF" so that the fuel injection rate is changed to a high fuel injection rate. When Q is equal to or smaller than Q0 at step 202B, the routine proceeds to step 203B where an upper limit b and a lower limit a for defining a medium engine operating load range corresponding to the current engine speed are calculated from a map of FIG. 39. Then, the routine proceeds to 204B where it is determined whether or not the current PM between the calculated a and b. When PM is between a and b, the engine operating condition is at medium engine loads and is presumed to be in the insufficient HC amount range. So, the routine proceeds to 206B where the second exciting coil 431B is changed to "OFF" so that the fuel injection rate is changed to a high fuel injection rate. In the high fuel injection rate, atomization of the injected fuel is degraded, so that the amount of HC included in the exhaust gas is increased to increase the NOX purification rate of the lean NOx catalyst 4B.

When the PM is not between a and b at step 204, the routine proceeds to step 205B where the second exciting coil 431B is changed to "ON" so that the fuel injection rate is changed to a low fuel injection rate. In the case of a two step lift injection valve in the prior art, the fuel injection rate is set to a high injection rate when Q is larger than Q0 and to a low injection rate when Q is smaller than Q0. In contrast, in the fourth through sixth embodiments of the present invention, the steps 203B and 204B are newly added so that the fuel injection rate is controlled to a high injection rate at the medium engine loads which correspond to the hatched portion of FIG. 39. This means that, in the engine operating load range between Q0 and Q1 of FIG. 29, the engine is operated according to line c when the engine is at medium engine loads and is operated according to line d when the engine is not at medium engine loads.

In the routine of FIG. 34, the step 204B constitutes the engine operating range determining means for the fourth through sixth embodiments, and the step 206B constitutes fuel injection rate changing means, that is, the HC amount control means for the fourth through sixth embodiments of the present invention.

Figure 35:
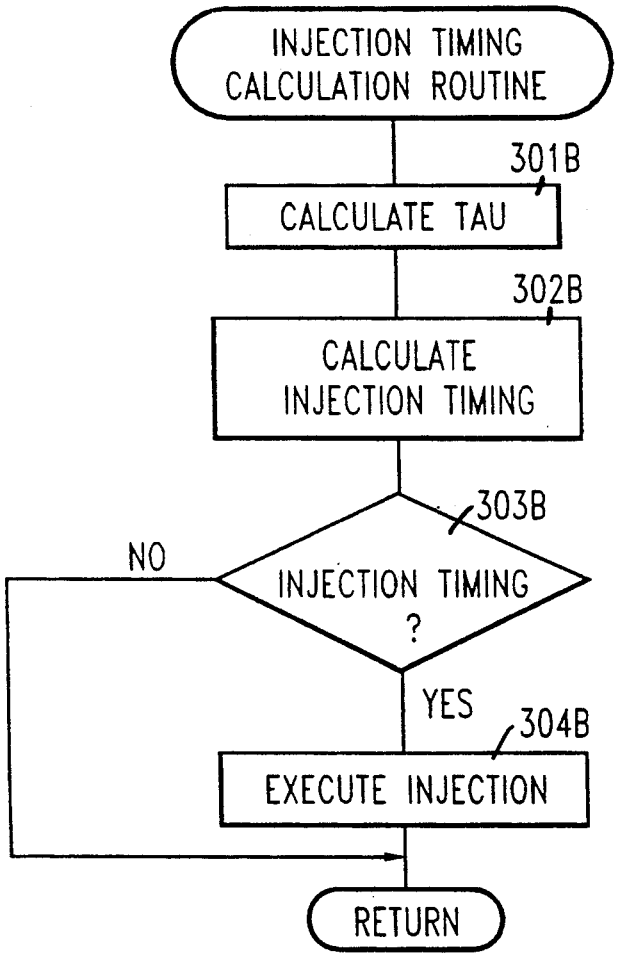
FIG. 35 is a flow chart of fuel injection operation for the exhaust gas purification system for an internal combustion engine of FIG. 26.
Figure 36:
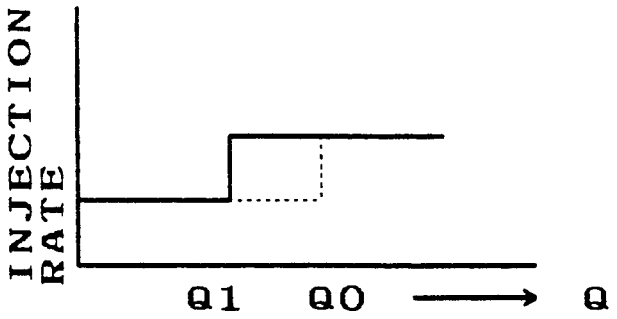
FIG. 36 is a graphical representation of a map of fuel injection rate versus fuel injection amount for the exhaust gas purification system for an internal combustion engine in accordance with the fourth embodiment of the present invention.

FIG. 35 illustrated a routine for fuel injection control. At step 301B, a fuel injection period of time TAU is calculated from the fuel injection amount Q using the map of FIG. 29. Then, at step 302B, an appropriate fuel injection timing is calculated so that fuel injection is executed at a later stage of an intake stroke of the engine. Then, at step 303B, it is determined whether or not the engine operating time has reached the fuel injection timing. When the engine operating time has reached the fuel injection timing, the routine proceeds to step 304 where the first exciting coil 418B is excited for the TAU period of time so that fuel injection is executed.

FIG. 36 illustrated a fuel injection rate versus fuel injection amount characteristic of the above-described fuel injection in accordance with the fourth embodiment. In FIG. 36, a full line illustrates the characteristic of the present invention where the injection rate is changed to a high fuel injection rate between Q1 and Q0, and a broken line illustrates the prior art characteristic for reference.

Figure 37:
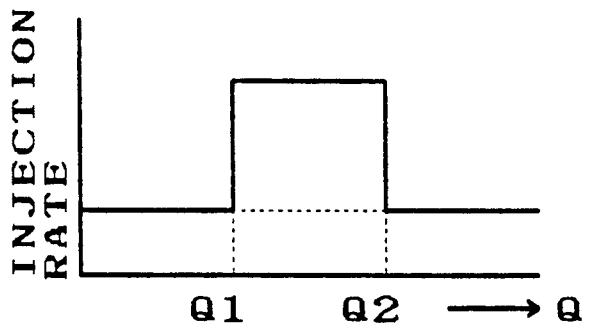
FIG. 37 is a graphical representation of a map of fuel injection rate versus fuel injection amount for the exhaust gas purification system for an internal combustion engine in accordance with the fifth embodiment of the present invention.

FIG. 37 illustrated a fuel injection rate versus fuel injection amount characteristic of the fifth embodiment where the fuel injection rate is changed to a high fuel injection rate only at medium engine loads. For obtaining such fuel injection characteristic, the step 202B has to be deleted from the flow chart of FIG. 34.

Figure 38:
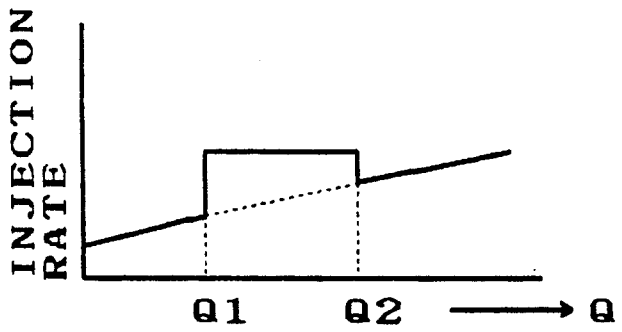
FIG. 38 is a graphical representation of a map of fuel injection rate versus fuel injection amount for the exhaust gas purification system for an internal combustion engine in accordance with the sixth embodiment of the present invention.
Figure 39:
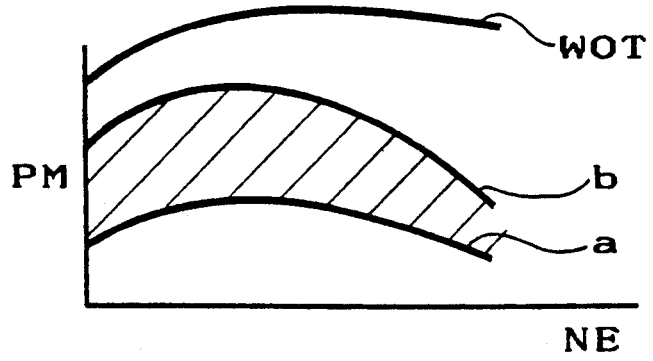
FIG. 39 is a graphical representation of a map of intake pressure versus engine speed used in calculation by the flow chart of FIG. 34.

FIG. 38 illustrated a fuel injection rate versus fuel injection amount characteristic of the sixth embodiment where the fuel injection rate can be changed linearly and is changed to a high fuel injection rate at medium engine loads.

Operation of the fourth through sixth embodiments will now be explained.

The fuel injection rate is forcibly changed to a high fuel injection rate at medium engine loads, fuel is injected in the form a lump in a shorter period of time than in the case of a low fuel injection rate. As a result, atomization of the injected fuel is degraded to generate unburned fuel which is exhausted into the exhaust conduit to form HC. This HC helps the lean NOx catalyst to effectively reduce NOx.

In accordance with the fourth through sixth embodiments, since the fuel injection rate changing means is provided, in a medium engine load condition an HC amount is increased to improve the NOx purification rate of the lean NOx catalyst.

Seventh and Eighth Embodiment

FIGS. 40–45 illustrate the seventh and eighth embodiments wherein a cooler for cooling an intake gas is provided and an HC amount is increased by causing the cooler to cool the intake gas to degrade atomization of injected fuel.

Figure 40:
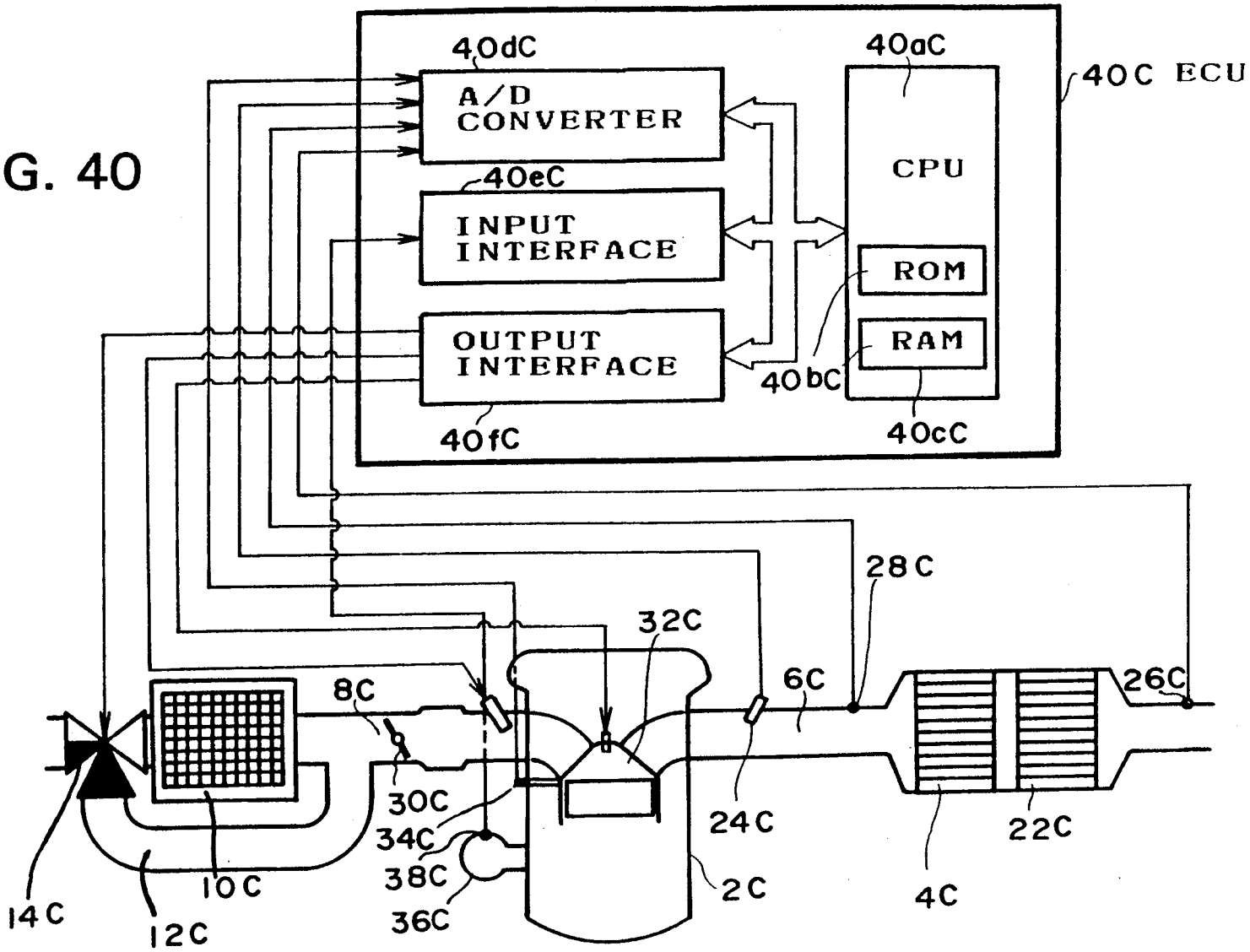
FIG. 40 is a schematic system diagram of an exhaust gas purification system for an internal combustion engine in accordance with seventh and eighth embodiments of the present invention.

As illustrated in FIG. 40, the exhaust gas purification system for an internal combustion engine of the seventh and eighth embodiments includes an internal combustion engine 2C capable of fuel combustion at lean air-fuel ratios, a lean NOx catalyst 4C installed in an exhaust conduit 6C of the engine, a cooler 10C which comprises an intercooler for cooling intake gas installed in an intake conduit 8C, a bypass conduit 12C bypassing the cooler 10C, and a switching valve (a vacuum switching valve) 14C for switching intake gas flow between the cooler 10C and the bypass conduit 12C. The exhaust gas purification system further includes engine operating condition detecting means for detecting the current engine operating condition, engine operating range determining means for determing whether or not the current engine operating condition is within an insufficient HC amount range, and switching valve control means for switching the switching valve so as to cause intake gas to flow through the cooler 10C when the engine operating range determining means determines that the engine operating condition is withing the insufficient HC amount range. In this instance, the switching valve control means constitutes the HC amount control means for the seventh and eighth embodiments.

In the exhaust conduit 6C, a three-way catalyst 22C may be installed downstream of the lean NOx catalyst 4C. An air-fuel ratio sensor (or an $O_2$ sensor) 24C and/or an HC sensor 26C are also installed in the exhaust conduit 6C. If necessary, an exhaust gas temperature sensor 28C is installed in the exhaust conduit 6C, and a combustion pressure sensor 34C is installed in a combustion chamber 32C of the engine 2C. A crank angle sensor 38C is housed in a distributor 36C provided on the engine 2C.

The engine operating condition detecting means includes at least one of the air-fuel ratio sensor 24C, the exhaust gas temperature sensor 28C, the combustion pressure sensor 34C, and the HC sensor 26C. The HC sensor 26C directly detects the HC amount of the exhaust gas, while the other sensors indirectly detect the HC amount.

An electronic control unit (ECU) 40C is provided for controlling the engine 2C. The ECU 40C includes a central processor unit (CPU) **40*a*C, a read-only memory (ROM) 40*b*C, a random access memory (RAM) 40*c*C, an analog/digital converter 40*d*C, an input interface 40*e*C, and an output interface 40*f*C**.

Figure 41:
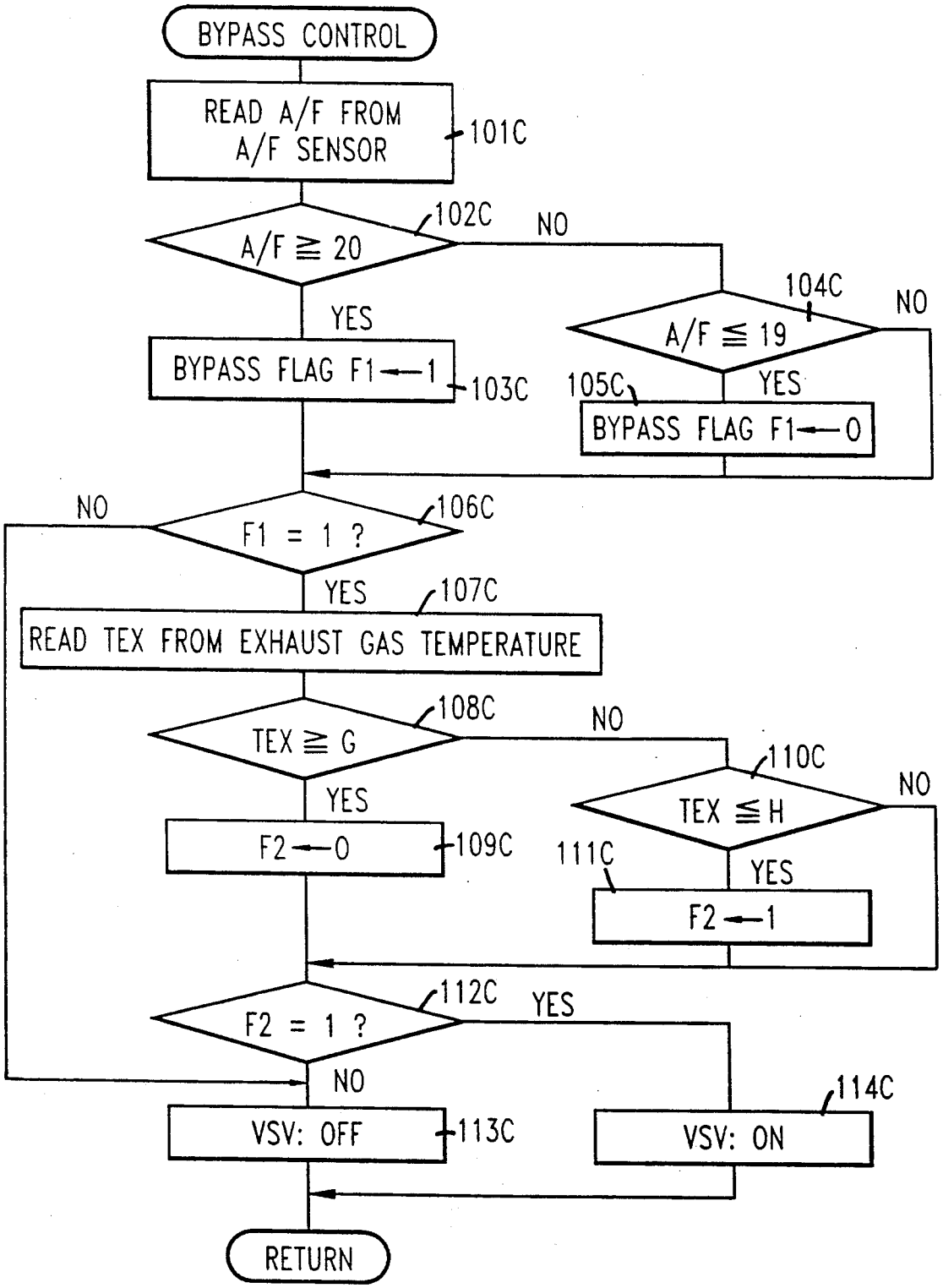
FIG. 41 is a control flow chart for the exhaust gas purification system for an internal combustion engine in accordance with the seventh embodiment of the present invention.
Figure 44:
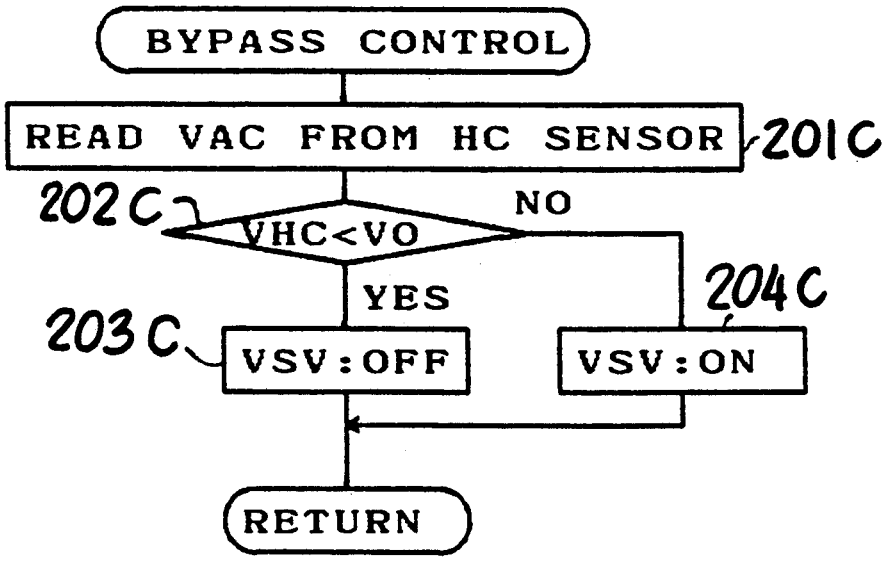
FIG. 44 is a control flow chart for the exhaust gas purification system for an internal combustion engine in accordance with the eighth embodiment of the present invention.

The programs of FIGS. 41 and 44 are stored in the ROM **40*b*C and called by the CPU 40*a*C where calculation is executed. The routine of FIG. 41 corresponds to the seventh embodiment where the HC amount is indirectly detected and determined on the basis of the air-fuel ratio and the exhaust gas temperature, and the routine of FIG. 44 corresponds to the eighth embodiment where the HC amount is directly detected by the HC sensor 26C. The routines of FIGS. 41 and 44** are entered at intervals of predetermined crank angles, for example, at 720° crank angle intervals.

In the seventh embodiment, as illustrated in FIG. 41, at step 101C, the current air-fuel ratio which is an output of the air-fuel ratio sensor 24C is entered. Then, at step 102C, it is determined whether or not the air-fuel ratio is excessively lean, for example, whether or not A/F is equal to or larger than 20. When A/F is equal to or larger than 20, the NOx generation amount is small and the HC amount is relatively large and the engine operation condition is determined to be not within the insufficient HC amount range, and when A/F is smaller than 20, the engine operating condition is determined to be within the insufficient HC amount range. Therefore, the step 102C constitutes the engine operating range determining means for the seventh embodiment.

Figure 42:
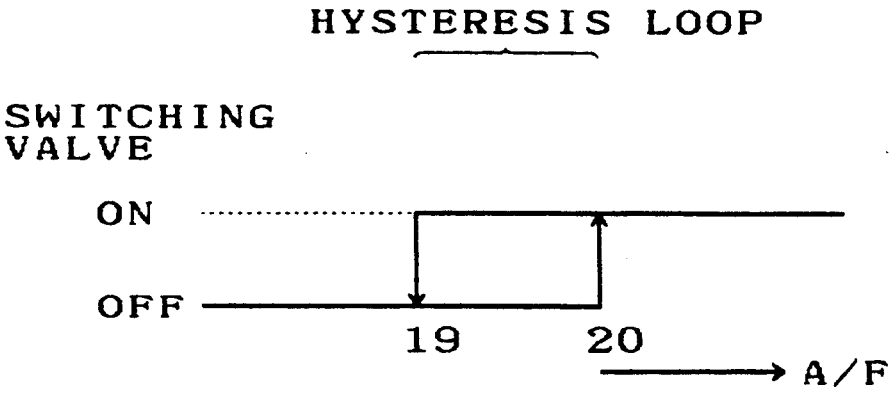
FIG. 42 is a hysteresis loop diagram drawn by steps 102C–105C of the flow chart of FIG. 41.

When A/F is equal to or larger than 20, the routine proceeds to step 103C, a bypass flag is set to "1" which means that the intake gas is flowing through the bypass conduit. When A/F is smaller than 20 at step 102C, the routine proceeds to step 104C where it is determined whether or not the A/F value is smaller than a predetermined air-fuel ratio (for example, "19") smaller than the air-fuel ratio ("20") used at step 102C. When the A/F is equal to or smaller than "19" at step 104C, the routine proceeds to step 105C where the bypass flag is set to "0" which means that the intake gas is flowing through the cooler 10C. When A/F is larger than "19" at step 104C, the bypass flag is maintained to be "1". By providing step 104, opening and closing of the switching valve 14C draws a hysteresis loop as illustrated in FIG. 42, and hunting of the switching valve 14C is prevented.

Even when the air-fuel ratio is outside the air-fuel range "19–20", there is a case where, when the exhaust gas temperature is high, the HC included in the exhaust gas is burned before it reaches the lean NOx catalyst 4C so that the HC amount is insufficient for the lean NOx catalyst to reduce NOx. Such a case will be determined by steps 106C–112C. Therefore, the steps 102C–105C and 106C–112C constitute the engine operating range determining means for the seventh embodiment for determining whether or not the engine operating condition is within the insufficient HC amount range.

Figure 43:
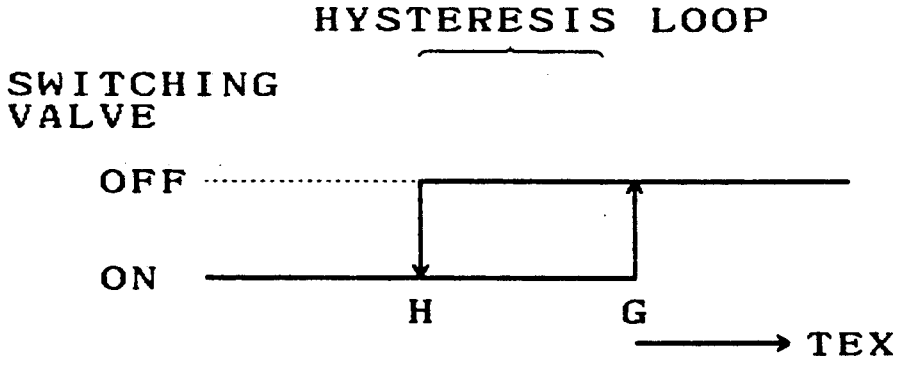
FIG. 43 is a hysteresis loop diagram drawn by steps 108C–111C of the flow chart of FIG. 41.

At step 106C, it is determined whether or not the bypass flag is "1" or not. When the bypass flag is determined to be "1", the routine proceeds to step 107C where the current exhaust gas temperature TEX which is an output of the exhaust gas temperature sensor 28C is entered. Then, at step 108C, it is determined whether or not the current exhaust gas temperature is equal to or higher than a predetermined exhaust gas temperature G (for example, 500° C.). When TEX is equal to or larger than G, the exhaust gas temperature is deemed to be excessively high so that the HC amount is insufficient. Then the routine proceeds to step 109C where another bypass flag F2 is set to "0" which means that the intake gas is flowing through the cooler 10C. When TEX is smaller than G at step 108C, the routine proceeds to step 110C where it is determined that the exhaust gas temperature TEX is equal to or lower than another predetermined exhaust gas temperature H (for example, 400° C.) which is smaller than G. When TEX is equal to or smaller than H, oxidation of the HC included in the exhaust gas is deemed not to be promoted. Then, the routine proceeds to step 111C, where the bypass flag F2 is set to "1" which means that the intake gas is flowing through the bypass conduit. When TEX is larger than H at step 110C, the bypass flag F2 is maintained to be "0". Due to the step 110C, opening and closing of the switching valve 14C draws a hysteresis loop as shown in FIG. 43 so that hunting is prevented.

The routine further proceeds to step 112C from one of steps 109C, 110C, and 111C. At step 112C, it is determined whether or not the bypass flag F2 is "1". When the bypass flag F2 is determined to be set at "1" at step 112C, the routine proceeds to step 114C where the switching valve 14C is switched to "ON" which corresponds to opening of the bypass conduit 12C so that the intake gas flows through the bypass conduit 12C. When F2 is determined to be "0" at step 112C, the routine proceeds to step 113C where the switching valve 14C is switched to "OFF" which corresponds to opening of the cooler conduit 8C so that the intake gas flows through the cooler 10C. When the bypass flag F1 is determined at step 106C to be not "1", it is not necessary for the routine to proceed through steps 107C–112C and the routine proceeds to step 113C where the switching valve 14C is set to "OFF". In the above, the steps 113C and 114C constitute the switching valve control means, that is, the HC amount control means for the seventh embodiment.

FIG. 44 illustrates a routine for the eighth embodiment. In FIG. 44, at step 201C, an HC concentration VHC which is an output of the HC sensor 26C is entered. Then, the routine proceeds to step 202C where it is determined whether or not the current HC concentration VHC is lower than a predetermined HC concentration V0. In this instance, the step 202C constitutes the engine operating range determining means for eighth embodiment.

When the VHC is determined to be smaller than V0 at step 202C, that is, when the engine operating condition is within the insufficient HC amount range, the routine proceeds to step 203C where the switching valve 14C is switched to "OFF" so that the intake gas flows through the cooler 10C. Also, when the VHC is determined to be equal to or larger than V0, the routine proceeds to step 204C where the switching valve 14C is switched to "ON" so that the intake gas flows through the bypass valve 12C. In this instance, the steps 203C and 204C constitute the switching valve control means, that is, the HC amount control means for the eighth embodiment.

Operation of the seventh and eighth embodiments will now be explained.

At low engine loads such as at normal engine speeds or at a slow accelerating time, the engine is usually operated at an air-fuel ratio of 20–24. In such operation, little NOx is generated and a relatively large amount of HC is generated. Therefore, the engine is not within the insufficient HC amount range. In such operation, in the seventh embodiment the switching valve 14C is switched to "ON" so that the intake gas flows through the bypass conduit 12C and good combustion is obtained. In the eighth embodiment, such operation corresponds to an insufficient HC amount range and the operation is detected by the HC sensor. Therefore, the switching valve 14C is switched to "ON" in the eighth embodiment also so that good combustion is obtained.

At medium and high engine loads such as at an accelerating time, the engine is usually operated at the air-fuel ratio of 16–19 for the purpose of obtaining a high torque. In such a condition, a large amount of NOx is generated from the engine and the HC amount is insufficient. In the seventh embodiment, the switching valve 14C is switched to "OFF" so that the intake gas flows through the cooler 10C and is cooled. Also, in the eighth embodiment, since VHC is smaller than V0 in such a condition, the switching valve 10C is switched to "OFF" and the intake gas is cooled. The cooled intake gas does not promote evaporation of the injected fuel so that the injected fuel adheres to a wall surface of the intake conduit and the combustion chamber. Atomization and evaporation of fuel are thus degraded, and unburned fuel (HC) is produced to increase the amount of HC included in the exhaust gas and to improve the NOx purification rate of the lean NOx catalyst 4C.

At extremely high engine loads, the air-fuel ratio is controlled to be lower than 15, a large amount of HC will be produced, and the HC emissions will be purified by the three-way catalyst 22C installed downstream of the lean NOx catalyst 4C.

In accordance with the seventh and eighth embodiments, the intake gas is cooled by the cooler in the insufficient HC amount range so that atomization and evaporation of injected fuel are suppressed to increase the HC amount and to improve the NOx purification of the lean NOx catalyst.

Ninth and Tenth Embodiments

FIGS. 46–53 illustrate the ninth and tenth embodiments of the invention wherein an internal combustion engine temperature can be controlled by controlling flow of engine cooling water and an HC amount is increased by cooling the engine temperature more strongly than usual to degrade atomization of injected fuel.

Figure 46:
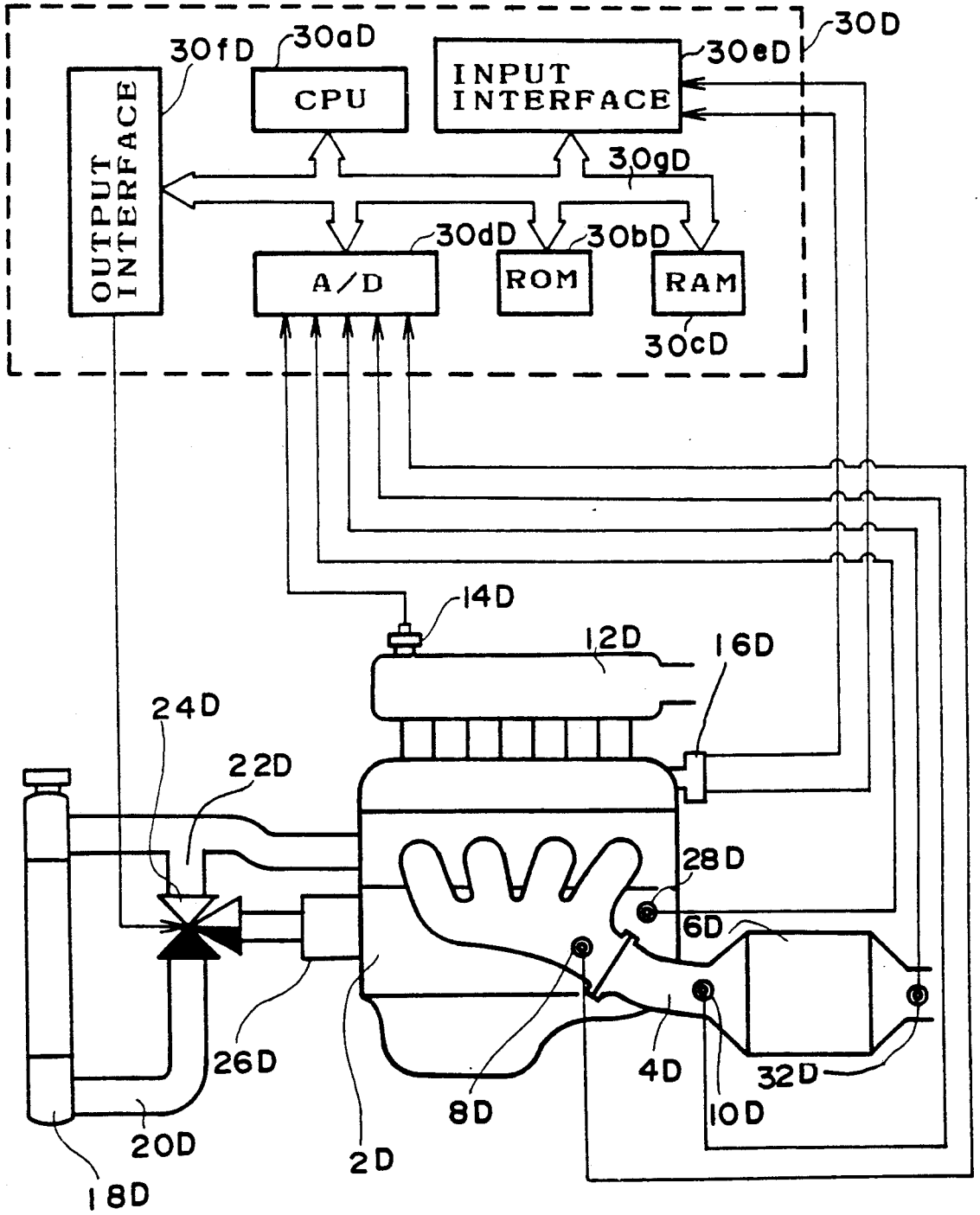
FIG. 46 is a schematic system diagram of an exhaust gas purification system for an internal combustion engine in accordance with ninth and tenth embodiments of the present invention.

As illustrated in FIG. 46, the exhaust gas purification system for an internal combustion engine in accordance with the ninth and tenth embodiments includes an internal combustion engine 2D capable of fuel combustion at lean air-fuel ratios, a lean NOx catalyst 6D installed in an exhaust conduit 4D of the engine 2D, a radiator 18D, a cooling water circulation conduit 20D connecting the engine 2D and the radiator 18D, a bypass conduit 22D bypassing the radiator 18D, a three-way solenoid valve 24D disposed at a connecting portion of the cooling water circulation conduit 20D and the bypass conduit 22D, engine operating condition detecting means for detecting the current engine operating condition, engine operating range determining means for determining whether or not the current engine operating condition is within an insufficient HC amount range, and cooling water temperature control means for controlling the cooling water temperature to a temperature lower than a usual cooling water temperature when the engine operating range determining means determines that the engine operating condition is within the insufficient HC amount range. In this instance, the cooling water temperature control means constitutes the HC amount control means for the ninth and tenth embodiments.

As illustrated in FIG. 46, an air-fuel ratio sensor 8D and an exhaust gas temperature sensor 10D are installed in the exhaust gas conduit 4D upstream of the lean NOx catalyst 6D. An intake pressure sensor 14D is installed in an intake conduit 12D of the engine. Also, a crank angle sensor 16D is housed in a distributor provided to the engine. A cooling water temperature sensor 28D is installed in a water jacket of the engine for detecting the temperature of the engine cooling water. These sensors constitute the engine operating condition detecting means.

An electronic control unit (ECU) 30D is provided to the engine 2D for controlling operation of the engine 2D. The ECU 30D includes a central processor unit (CPU) **30*a*D, a read-only memory (ROM) 30*b*D, a random access memory (RAM) 30*c*D, an analog/digital converter 30*d*D, an input interface 30*e*D, an output interface 30*f*D, and a connecting circuit 30*g*D. The output of the crank angle sensor 16D is fed to the input interface 30*e*D, and the outputs of the air-fuel ratio sensor 8D, the exhaust gas temperature sensor 10D, the intake pressure sensor 14C, and the cooling water temperature sensor 28C are fed to the analog/digital converter 30*d*D. The signals from the output interface 30*f*D is fed to the three-way solenoid valve 24D**.

Figure 47:
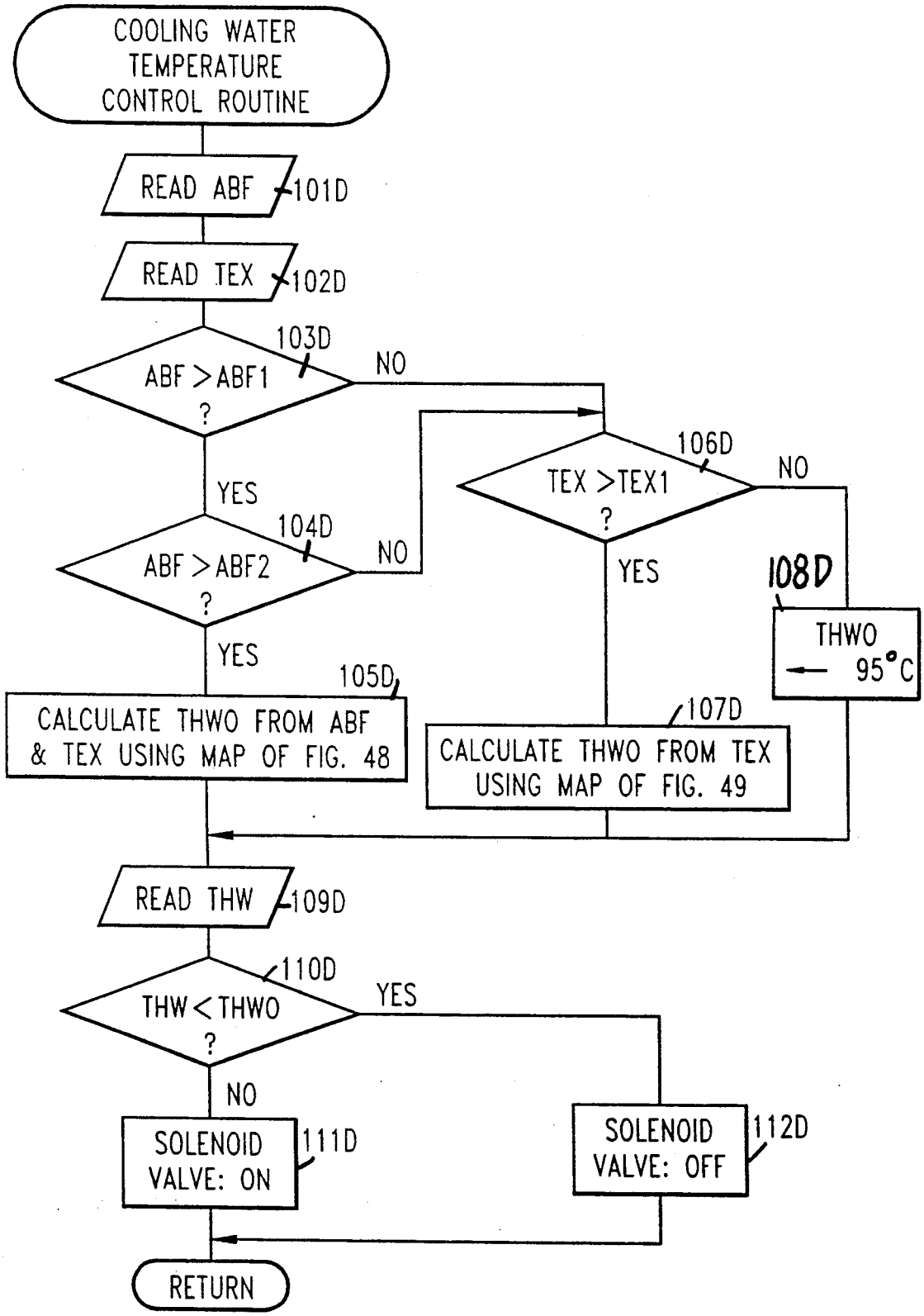
FIG. 47 is a control flow chart for the exhaust gas purification system for an internal combustion engine in accordance with the ninth embodiment of the present invention.
Figure 51:
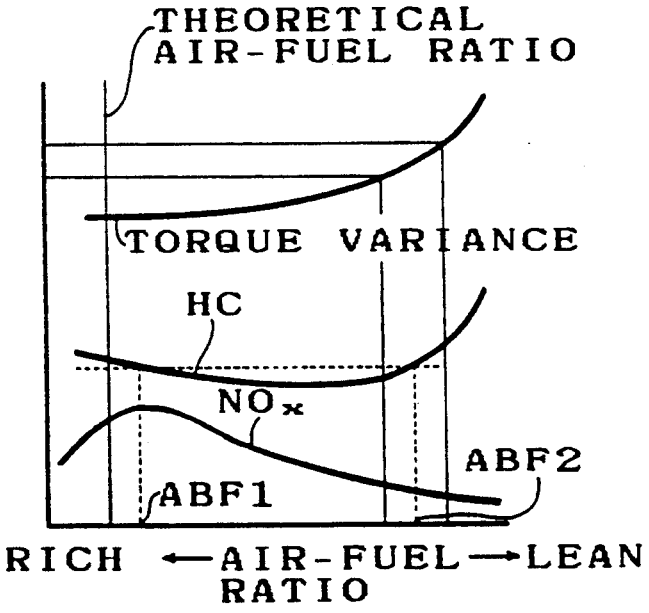
FIG. 51 is a graphical representation of a map of torque, HC concentration, and NOx concentration versus air-fuel ratio.

The routine of FIG. 47 corresponds to the ninth embodiment where it is indirectly determined whether or not the engine operating condition is within the insufficient HC amount range, and the routine of FIG. 51 corresponds to the tenth embodiment where it is directly determined whether or not the engine operating condition is within the insufficient HC amount range. These routines are stored by the ROM **30*b*D and called by the CPU 30*a*D** where calculation is executed at intervals of predetermined periods of time.

In the ninth embodiment, at steps 101D and 102D, the engine operating conditions are entered. More particularly, at step 101D, the current air-fuel ratio ABF which is the output of the air-fuel ratio sensor 8D is entered, and at step 102D, the current exhaust gas temperature TEX which is an output of the exhaust gas temperature sensor 10D is entered. Alternatively, the exhaust gas temperature may be calculated from the current intake pressure PM and the current engine speed NE.

Figure 50:
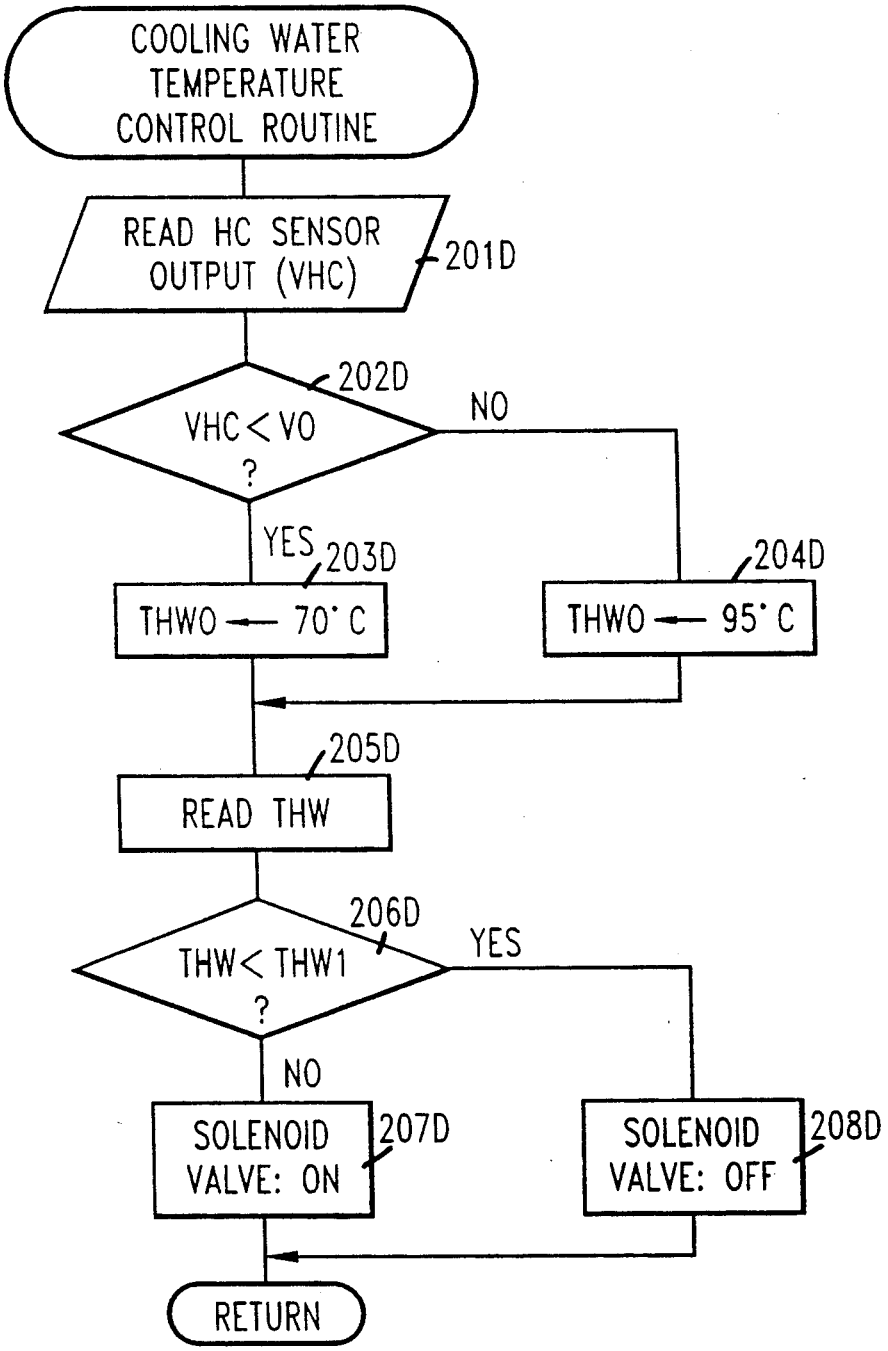
FIG. 50 is a control flow chart for the exhaust gas purification system for an internal combustion engine in accordance with the tenth embodiment of the present invention.

Then, the routine proceeds to steps 103D and 104D, where it is determined whether or not the current air-fuel ratio ABF is between a lower air-fuel ratio limit ABF1 and an upper air-fuel ratio limit ABF2, that is, within a small HC amount range between ABF1 and ABF2 in FIG. 50. When the air-fuel ratio is within the small HC amount range, the routine proceeds to step 105D, and when the air-fuel ratio is not within the small HC amount range, the routine proceeds to step 106D.

Figure 48:
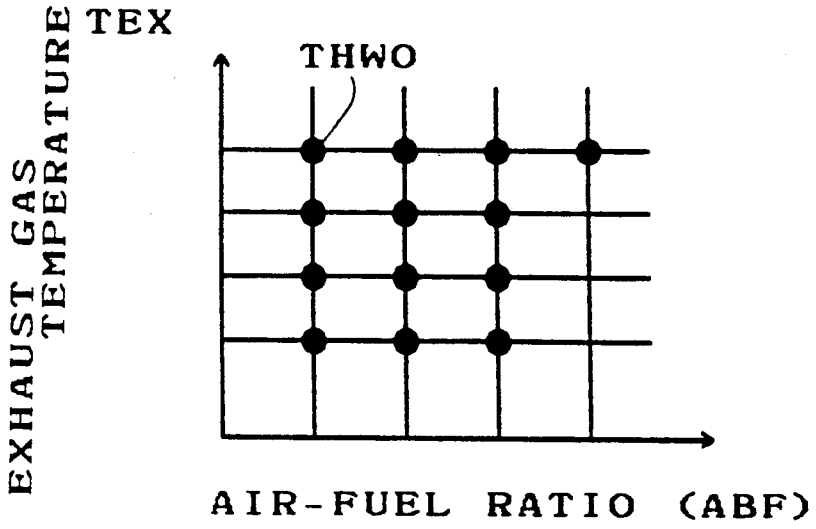
FIG. 48 is a graphical representation of a map of object cooling water temperature versus air-fuel ratio and exhaust gas temperature used in calculation by the flow chart of FIG. 47.
Figure 49:
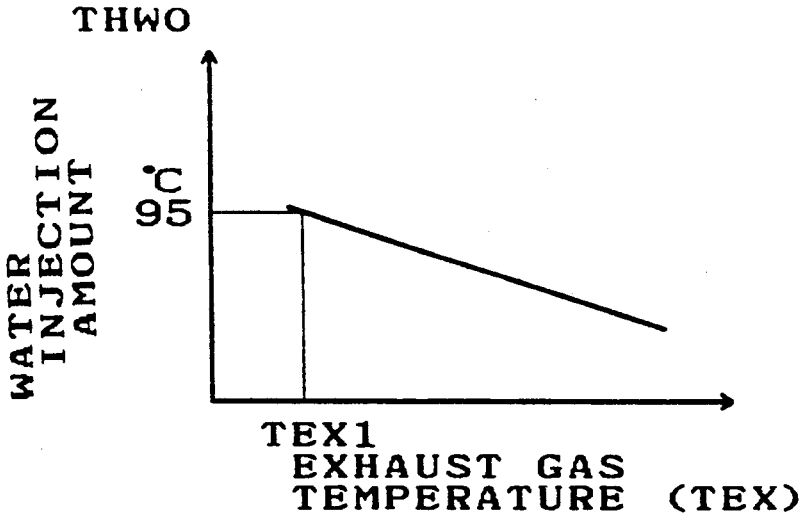
FIG. 49 is a graphical representation of a map of object cooling water temperature versus water injection amount and exhaust gas temperature used in calculation by the flow chart of FIG. 47.

When the routine proceeds to step 105D, an object cooling water temperature THW0 is calculated from a map of object cooling water temperature THWO versus exhaust gas temperature TEX and air-fuel ratio ABF of FIG. 48. The object cooling water temperature is predetermined so as to be lower than a usual cooling water temperature (for example, 95° C.). Therefore, when the cooling water temperature THW is controlled so as to approach the object cooling water temperature THW0 according to steps 109D–112D, the temperature of the engine 2D is controlled to be low.

When the routine proceeds to step 106D, it is determined at step 106D whether or not the exhaust gas temperature TEX is higher than a predetermined exhaust gas temperature TEX1 which corresponds to a temperature where the NOx purification rate suddenly decreases as shown in FIG, 52. When TEX is determined to be larger than TEX1, HC is deemed to be completely oxidized to $CO_2$ and $H_2O$ as shown in FIG. 45. So, the routine proceeds to step 107D where an object cooling water temperature THW0 is calculated from a map of THW0 versus TEX of FIG. 49. In this instance, THW0 also is lower than the usual cooling water temperature 95° C. Thus, the temperature of the engine 2D is controlled to be low.

When the exhaust gas temperature TEX is determined to be lower than TEX at step 106D, the HC amount is relatively sufficient and the engine operating range is within a range where direct oxidation of HC is not promoted. Therefore, the routine proceeds to step 108D where the object cooling water temperature THW0 is set to a usual cooling water temperature, for example 95° C. where good combustion is obtained. In the above, the steps 103D, 104D, and 106D constitute the engine operating range determining means for the ninth embodiment.

Then, from either one of steps 105D, 107D, and 108D, the routine proceeds to step 109D–112D where the current engine cooling water temperature THW is controlled to the object cooling water temperature THW0. More particularly, at step 109D, the current cooling water temperature THW which is an output of the cooling water temperature sensor 28D is entered. Then, the routine proceeds to step 110D where it is determined whether or not the current engine cooling water temperature THW is lower than the object engine cooling water temperature THW0. When THW is lower than THWO, the routine proceeds to step 112D where the three-way solenoid valve 24D is set to "OFF" so that the engine cooling water bypasses the radiator 18C and the engine cooling water temperature is raised. When THW is not lower than THW0, the routine proceeds to step lllD where the three-way solenoid valve 24D is set to "ON" so that the engine cooling water temperature is lowered. In the above, the steps 105D and 107D–112D constitute the cooling water temperature control means for the ninth embodiment.

FIG. 51 illustrates a routine for the tenth embodiment. In the tenth embodiment, an HC sensor 32D for detecting the HC concentration of the exhaust gas should be installed in the exhaust conduit.

At step 201D, the current HC concentration which is an output of the HC sensor 32D is entered. Then, at step 202D, it is determined whether or not the current VHC is smaller than a predetermined HC concentration V0. When the VHC is smaller than V0, the HC amount is insufficient, and the routine proceeds to step 203D where an object engine cooling water temperature THW0 is set to a temperature, for example 70° C., lower than a usual cooling water temperature, 95° C. Also, when the VHC is determined to be not smaller than V0 at step 202D, the routine proceeds to step 204D where an object cooling water temperature is set to the usual cooling water temperature, 95° C. In this instance, the step 202D constitutes the engine operating range determining means for the tenth embodiment.

Then, the routine proceeds to steps 205D–208D where the current engine cooling water temperature THW is controlled to the object engine cooling water temperature THW0. In this instance, the steps 203D–208D constitute the cooling water temperature control means, that is, the HC amount control means for the tenth embodiment.

Operation of the ninth and tenth embodiments will now be explained.

When the air-fuel ratio ABF is between ABF1 and ABF2, and also when the air-fuel ratio is not between ABF1 and ABF2 but the exhaust gas temperature TEX is higher than TEX1, and when the HC concentration VHC is lower than V0, the engine operating condition is deemed to be within the insufficient HC amount range and the object cooling water temperature THW0 is set to a temperature lower than a usual cooling water temperature so that the engine cooling water temperature is controlled to the low object temperature by opening and closing the three-way solenoid valve 24C.

Therefore, in the insufficient HC amount range, the engine temperature is controlled to be low. As a result, evaporation and atomization of fuel and combustion in the cylinder are degraded to increase unburned fuel and the HC amount in the exhaust gas.

When the engine operating condition is not within the insufficient HC amount range, the engine cooling water temperature is controlled to a usual temperature and therefore good evaporation or atomization of fuel is obtained.

In accordance with any one of the ninth and tenth embodiments, in the insufficient HC amount range, the engine cooling water temperature is controlled to be low so that atomization of fuel is suppressed to increase the HC amount in the exhaust gas and to improve the NOx purification rate of the lean NOx catalyst.

Eleventh and Twelfth Embodiments

FIGS. 54–59 illustrate the eleventh and twelfth embodiments wherein a water injecting device is provided and an HC amount is increased by causing the water injecting device to inject water into an intake conduit or a combustion chamber to degrade atomization of injected fuel.

Figure 54:
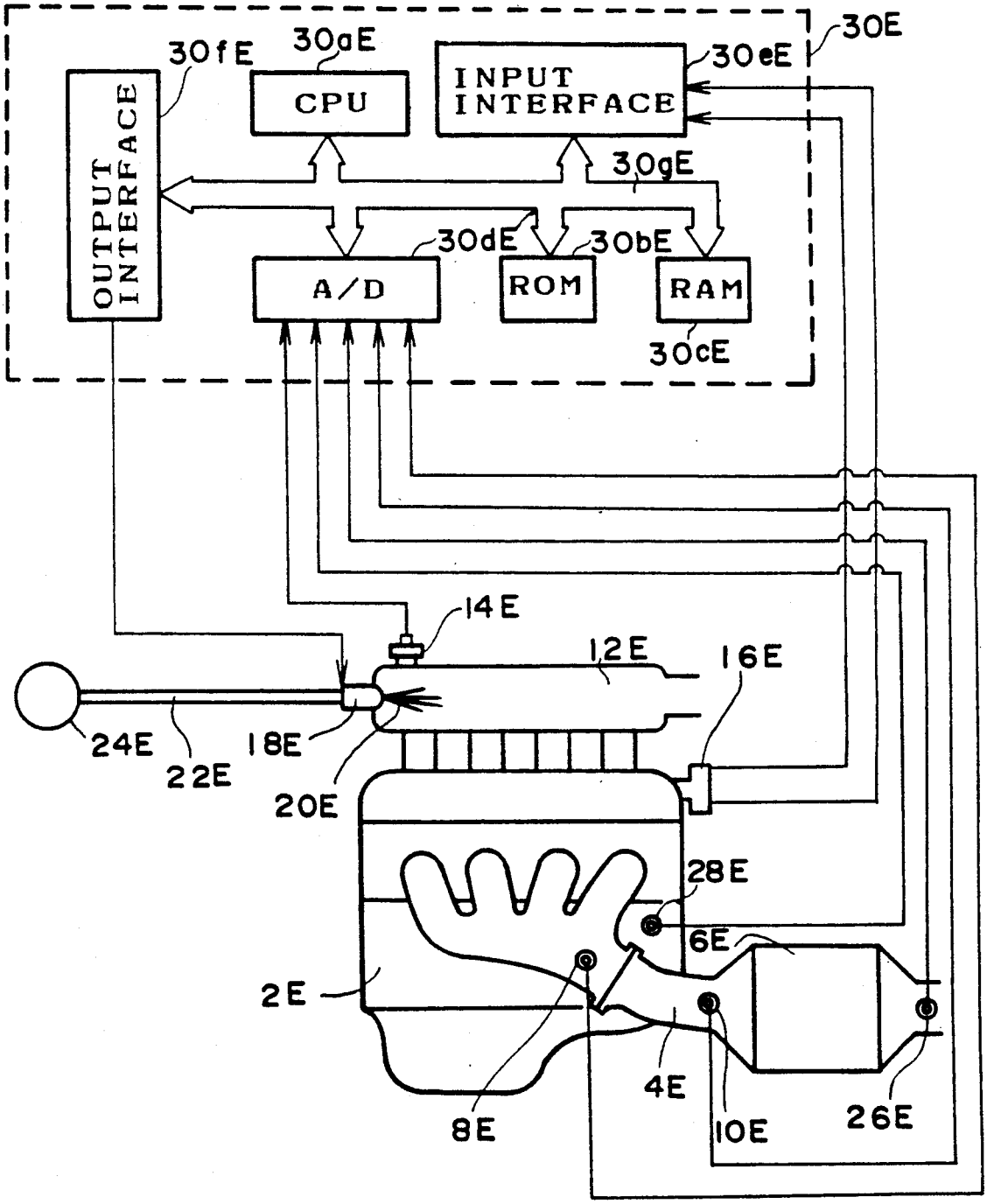
FIG. 54 is a schematic system diagram of an exhaust gas purification system for an internal combustion engine in accordance with eleventh and twelfth embodiments of the present invention.

As illustrated in FIG. 54, an exhaust gas purification system for an internal combustion engine in accordance with the eleventh and twelfth embodiments includes an internal combustion engine 2E, a lean NOx catalyst 6E installed in an exhaust conduit 4E of the engine, a water injecting device for injecting water into an intake conduit 12E or a combustion chamber of the engine and including a water injection valve 18E, engine operating condition detecting means for detecting the current engine operating condition, engine operating range determining means for determining whether or not the current engine operating condition is within an insufficient HC amount range, and water injection control means for causing the water injecting device to inject water when the engine operating range determining means determines that the engine operating condition is within the insufficient HC amount range. The water injection control means constitutes the HC amount control means for the eleventh and twelfth embodiments.

As illustrated in FIG. 54, an air-fuel ratio sensor 8E and an exhaust gas temperature sensor 10E are installed in the exhaust conduit 4E of the engine. Also, an intake pressure sensor 14E is installed in the intake conduit 12C of the engine. A crank angle sensor 16E is housed in a distributor operatively coupled to a crankshaft of the engine, and an engine speed signal is calculated from the output of the crank angle sensor. Further, a cooling water temperature sensor 28E for detecting the engine cooling water temperature is provided to the engine. These sensors constitute the engine operating condition detecting means. The water injecting device includes the water injection valve 20E, a water pump 24E, and a conduit 22E conducting water from the water pump 24E to the water injection valve 20E. The water injection valve 20E is constructed in the same way as a conventional fuel injection valve.

As illustrated in FIG. 54, an electronic control unit (ECU) 30E is provided for controlling operation of the engine. The ECU 30E which comprises a micro computer includes a central processor unit (CPU) 30*a*E, a read-only memory (ROM) 30*b*E, a random access memory (RAM) 30*c*E, an analog/digital converter 30*d*E for converting analog signals to digital signals, an input interface 30*e*E, an output interface 30*f*E, and a connecting circuit 30*g*E. The output of the crank angle sensor 16E is fed to the input interface 30*e*E, and the outputs of the air-fuel ratio sensor 8E, the exhaust gas temperature sensor 10E, the intake pressure sensor 14E, and the cooling water temperature sensor 28E are fed to the analog/digital converter 30*d*E. The output from the output interface 30*f*E is fed to the water injection valve 18E.

Figure 55:
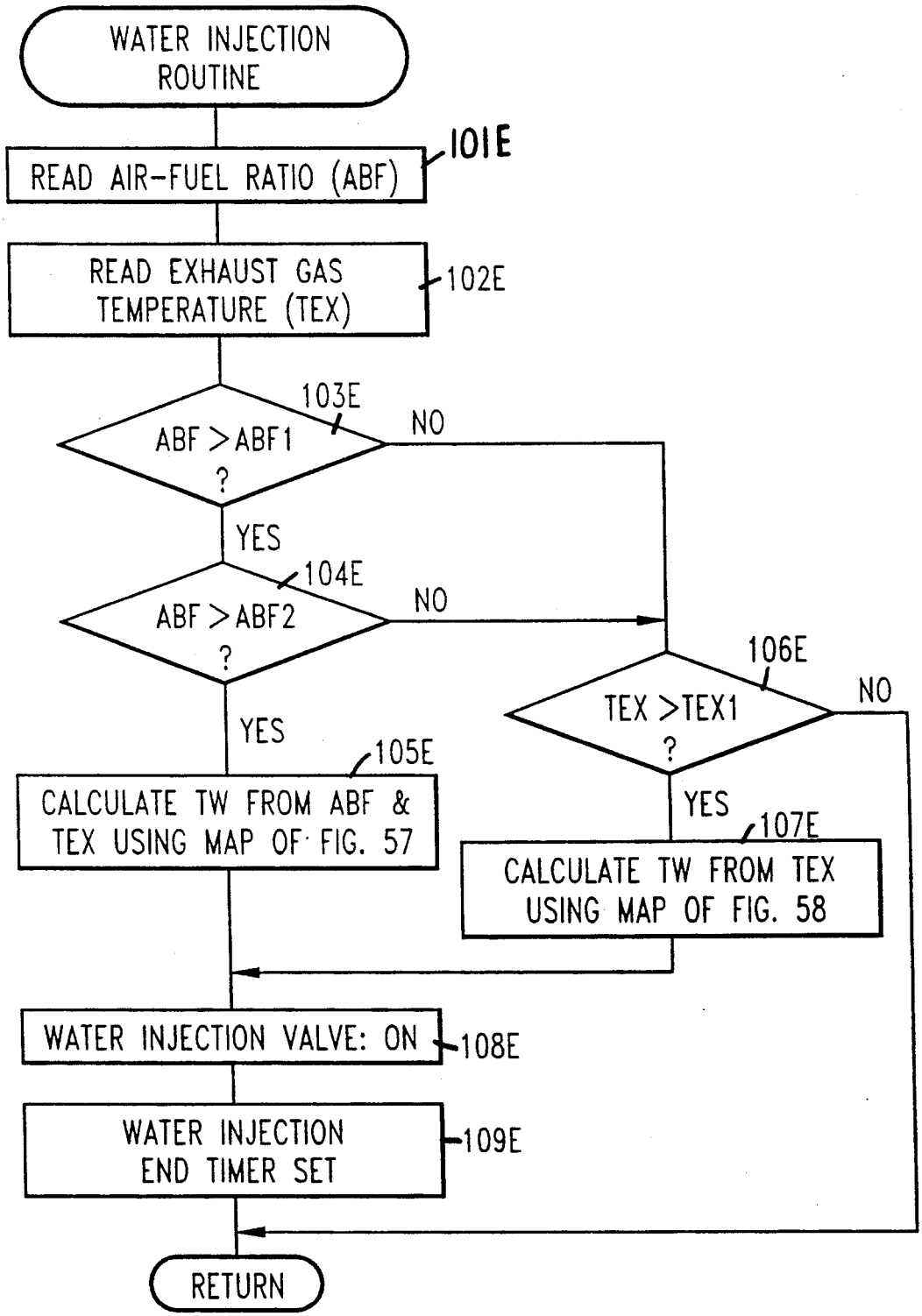
FIG. 55 is a control flow chart for the exhaust gas purification system for an internal combustion engine in accordance with the eleventh embodiment of the present invention.

FIGS. 55 and 59 illustrate water injection control routines for the eleventh and twelfth embodiments, respectively. The subroutine of FIG. 56 is applicable to both the eleventh and twelfth embodiments. In the eleventh embodiment, whether or not the engine operating condition is within the insufficient HC amount range is indirectly determined on the basis of the air-fuel ratio and the exhaust gas temperature, and in the twelfth embodiment, the engine operating condition is directly determined on the basis of the HC concentration of the exhaust gas. These routines are stored in the ROM 30*b*E and are called by the CPU 30*a*E where calculation is executed at intervals of predetermined periods of time.

In the eleventh embodiment, as illustrated in FIG. 55, the current engine operating conditions are entered at steps 101E and 102E. More particularly, at step 101E, the current air-fuel ratio ABF which is an output of the air-fuel ratio sensor 8E is entered, and step 102E, the current exhaust gas temperature TEX which is an output of the exhaust gas temperature sensor 10E is entered. Alternatively, the exhaust gas temperature may be calculated from the intake pressure PM and the engine speed NE.

Then, the routine proceeds to steps 103E and 104E where it is determined whether or not the air-fuel ratio ABF is between a lower air-fuel ratio limit ABF1 and an upper air-fuel ratio limit ABF2, that is, whether or not the air-fuel ratio ABF is within a small HC amount range (see FIG. 50). When the ABF is within the small HC amount range, the routine proceeds to step 105E, and when the ABF is not within the small amount range, the routine proceeds to step 106E.

Figure 57:
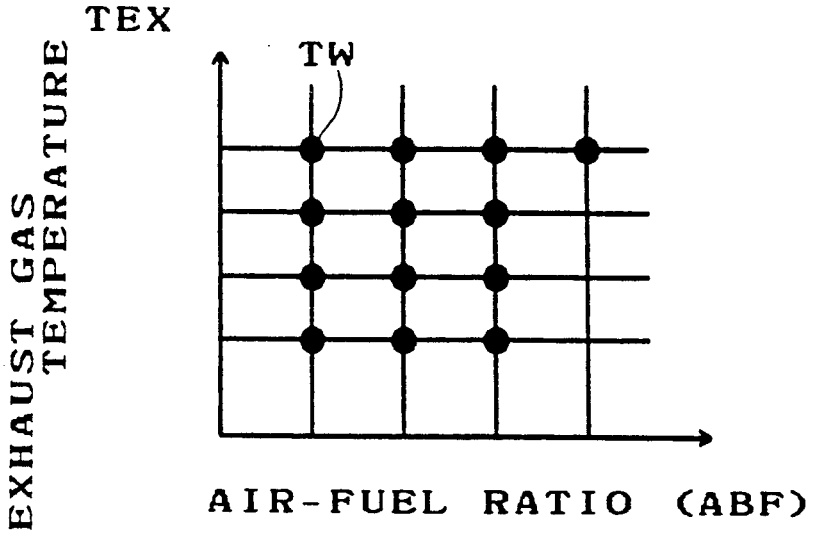
FIG. 57 is a graphical representation of a map of object water injection period of time versus air-fuel ratio and exhaust gas temperature used in the control by the flow chart of FIG. 55.

When the routine proceeds to step 105E, an object water injection period of time TW is calculated from using the map of water injection period of time TW versus air-fuel ratio ABF and exhaust gas temperature TEX of FIG. 57. In FIG. 57, the larger the air-fuel ratio ABF is and the higher the exhaust gas temperature TEX is, the longer is the water injection time TW.

Figure 52:
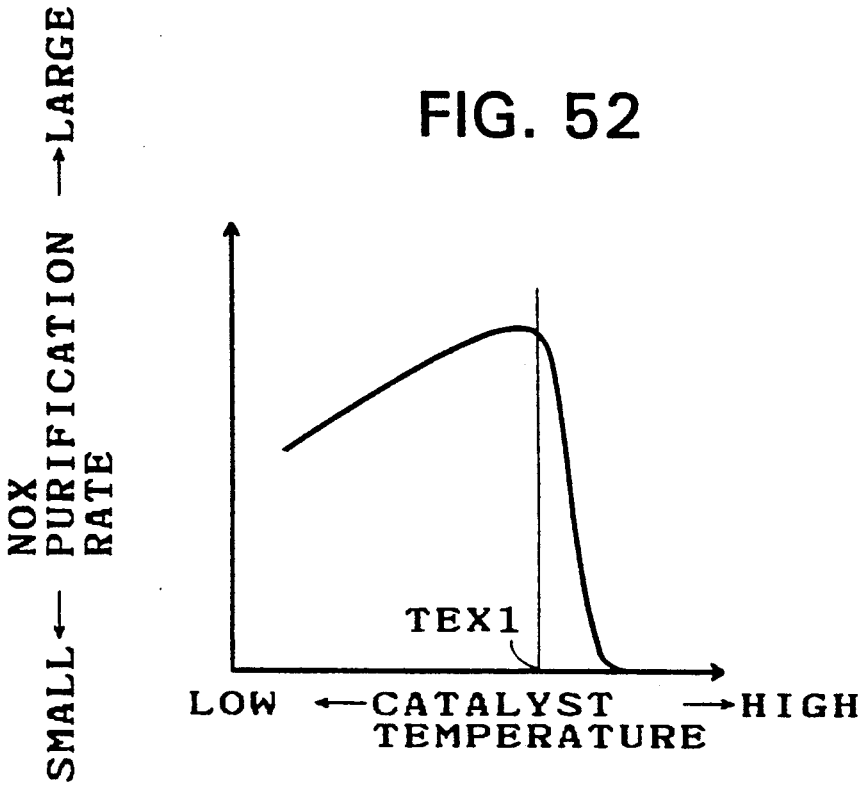
FIG. 52 is a graphical representation of a map of NOx purification rate versus catalyst temperature.
Figure 53:
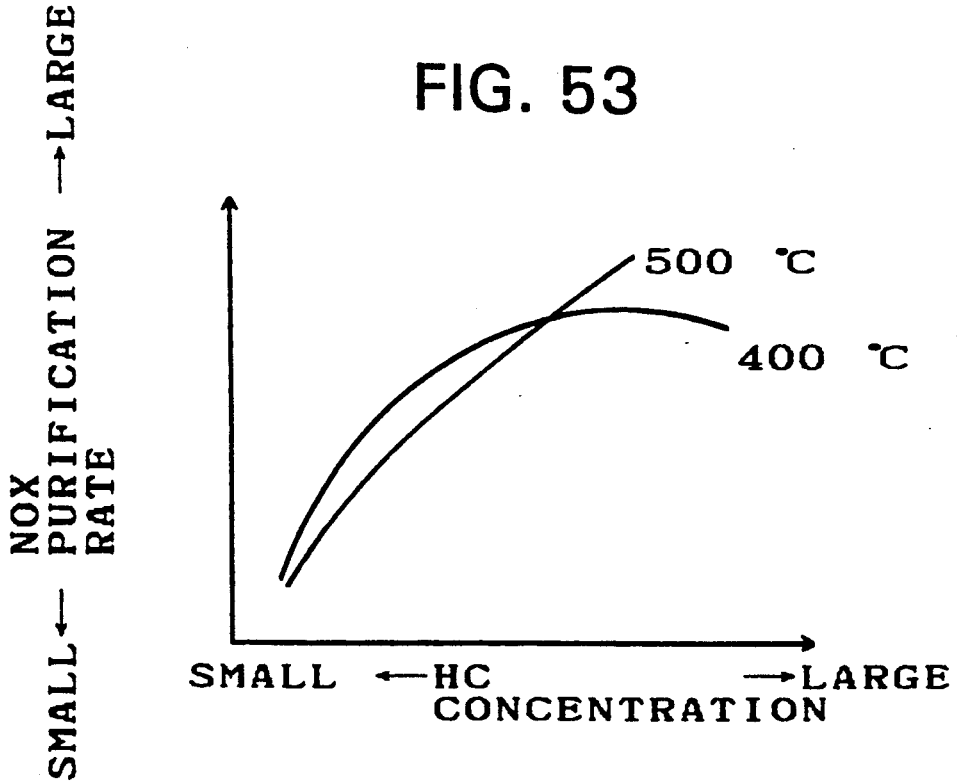
FIG. 53 is a graphical representation of a map of NOx purification rate versus HC concentration.
Figure 58:
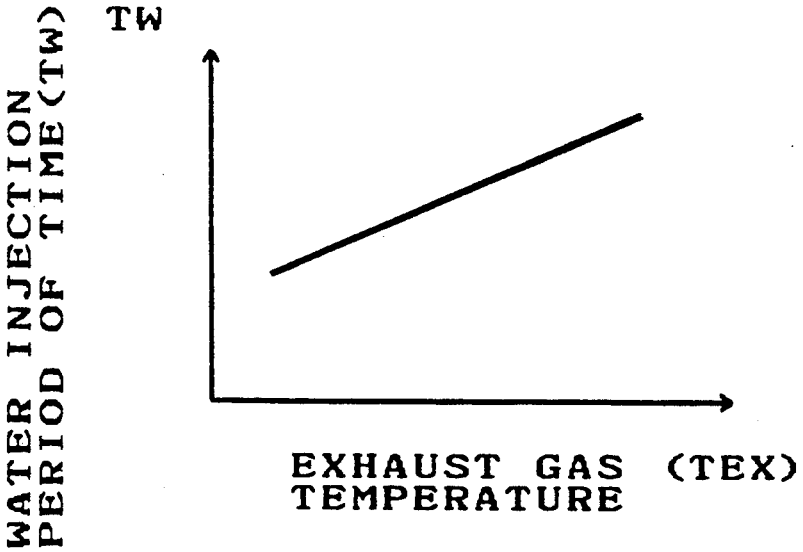
FIG. 58 is a graphical representation of a map of object water injection period of time versus exhaust gas temperature used in the control by the flow chart of FIG. 55.

When the routine proceeds to step 106E, it is determined whether or not the exhaust gas temperature TEX is higher than an exhaust gas temperature TEX1 where the NOx purification rate notably decreases (see FIG. 52). When TEX is larger than TEX1, the engine condition is deemed to be within the insufficient HC amount range because direct oxidation of HC to $CO_2$ and $H_2O$ is promoted (see FIG. 45). Therefore, the routine proceeds to step 107E where an object water injection period of time TW is calculated using a map of water injection period of time TW versus exhaust gas temperature TEX of FIG. 58. In FIG. 58, the higher the exhaust gas temperature TEX is, the longer is the water injection period of time TW. In the above, the steps 103E, 104E, and 106E constitute the engine operating range determining means for the eleventh embodiment for determining whether or not the current engine operating condition is within the insufficient HC amount range.

Then, the routine proceeds to step 108E and 109E where water is injected for the object injection period of time calculated at steps 103E–107E. More particularly, at step 108E, the water injection valve 18E is switched to "ON" to begin water injection. Then, at step 109E, a water injection end time is calculated by adding the object injection period of time TW to the current time and a timer is set. FIG. 56 is a sub-routine which is entered when the time reaches the water injection end time at step 109E. In the sub-routine, at step 301E, the water injection valve 18E is switched to "OFF" so that water injection ends. When water is being injected, a portion of combustion heat is used for evaporation of water so that the combustion temperature is decreased and complete combustion is suppressed to generate unburned fuel in the exhaust gas and to increase the HC amount in the exhaust gas. In contrast, when the water injection is stopped, the combustion temperature increases.

When the exhaust gas temperature TEX is equal to or lower than the predetermined exhaust gas temperature TEX1 at step 106E, water injection is not needed because there is a relatively large amount of HC in the exhaust gas and direct oxidation of HC is not promoted, and therefore the routine proceeds to a return step. In the above, the steps 105E and 107E–109E constitute the water injection control means, that is, the HC amount control means for the eleventh embodiment.

FIG. 59 illustrates the twelfth embodiment. In the twelfth embodiment, an HC sensor 26E should be installed in the exhaust conduit as shown in FIG. 54. An output of the HC sensor 26E is fed to the analog/digital converter 30*d*E.

In FIG. 59, at step 201E, an HC concentration which is an output of the HC sensor 26E is entered. Then, at step 202E, it is determined whether or not the current HC concentration VHC is lower than a predetermined HC concentration V0. When VHC is smaller than V0, that is, the HC amount is insufficient, the routine proceeds to step 203E where the water injection valve 18E is switched to "ON". Then, the routine proceeds to step 204E where the water injection end timer is set. The steps 203E and 204E correspond to the steps 108E and 109E of the eleventh embodiment. When VHC is not smaller than V0 at step 202E, water injection is not needed and therefore the routine proceeds to a return step. In the twelfth embodiment, the step 202E constitutes the engine operating range determining means, and the steps 203E and 204E constitute the water injection control means or the HC amount control means.

Operation of the eleventh and twelfth embodiments will be explained.

When the air-fuel ratio ABF is between ABF1 (for example, "16") and ABF2 (for example, "19), and also when the air-fuel ratio is not between ABF1 and ABF2 but the exhaust gas temperature TEX is higher than TEX1, and when HC concentration VHC is lower than V0, the HC amount is deemed to be insufficient and water injection is executed for a predetermined water injection period of time. Due to the water injection, the combustion temperature of the internal combustion engine 2E is decreased so that unburned fuel is generated to increase the amount of HC included in the exhaust gas. In contrast, when the HC amount is sufficient, the fuel injection is stopped so that good combustion is obtained.

In accordance with the eleventh and twelfth embodiments, when the HC amount is insufficient in the exhaust gas, water is injected into the intake conduit or the combustion chamber of the engine so that unburned fuel is generated to increase the HC amount and to improve the NOx purification rate of the lean NOx catalyst.

Although twelve embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. An exhaust gas purification system for an internal combustion engine comprising:

an internal combustion engine capable of fuel combustion at lean air-fuel ratios, the engine having a combustion chamber, an intake conduit, an exhaust conduit, and a fuel injection valve for injecting fuel into the intake conduit or the combustion chamber;

a catalyst installed in the exhaust conduit of the engine and constructed of zeolite carrying at least one kind of metal selected from transition metals and noble metals to reduce nitrogen oxides included in exhaust gas from the engine under oxidizing conditions and in the presence of hydrocarbons;

engine operating condition detecting means for detecting a current operating condition of the engine;

engine operating range determining means for determining whether or not the current engine operating condition detected by the engine operating condition detecting means is within an insufficient HC amount range where an amount of hydrocarbons included in the exhaust gas from the engine and supplied to the catalyst is insufficient for the catalyst to reduce the nitrogen oxides included in the exhaust gas; and HC amount control means for momentarily degrading atomization of fuel injected from the fuel injection valve to thereby increase the amount of hydrocarbons included in the exhaust gas from the engine when the engine operating range determining means determines that the current engine operating condition is within the insufficient HC amount range.

2. An exhaust gas purification system according to claim 1, wherein the fuel injection valve comprises an air assist-type fuel injection valve and means for supplying assist air to the fuel injection valve, said assist air supplying means including an assist air control valve, and the HC amount control means comprises assist air amount control means for decreasing the amount of the assist air or stopping supply of the assist air supplied to the air assist-type fuel injection valve when the engine operating range determining means determines that the current engine operating condition is within the insufficient HC amount range.

3. An exhaust gas purification system according to claim 2, wherein the engine operating range determining means comprises means to determine that the engine operating condition is within the HC amount insufficient range when the engine is at medium engine loads and medium engine speeds.

4. An exhaust gas purification system according to claim 3, wherein the assist air amount control means comprises delay means for delaying close of the assist air control valve by a predetermined period of time when the engine operating condition changes to the insufficient HC amount range from low engine loads and low engine speeds.

5. An exhaust gas purification system according to claim 2, wherein the engine further includes a throttle valve installed in the intake conduit, the air assist-type fuel injection valve being installed in the intake conduit downstream of the throttle valve, and the means for supplying assist air further comprises an assist air conduit having an upstream end connected to a portion of the intake conduit upstream of the throttle valve and a downstream end connected to the fuel injection valve, the assist air control valve being installed in the assist air conduit.

6. An exhaust gas purification system according to claim 2, wherein the air assist-type fuel injection valve includes a fuel injection portion and an air injection portion, and the air injection portion includes a nozzle hole, a needle for opening and closing the nozzle hole, a spring for biasing the needle in a closing direction, a solenoid, and a movable core for moving the needle in an opening direction when magnetically excited.

7. An exhaust gas purification system according to claim 1, wherein the internal combustion engine comprises a direct fuel injection two-stroke engine, the fuel injection valve comprises an air blast fuel injection valve having a variable fuel injection rate, and the HC amount control means comprises fuel injection rate changing means for changing the fuel injection rate of the air blast fuel injection valve to a fuel injection rate which promotes thermal cracking of fuel in a cylinder when the engine operating range determining means determines that the engine operating condition is within the insufficient HC amount range.

8. An exhaust gas purification system according to claim 7, wherein the HC amount control means comprises means for selectively actuating the air blast fuel injection valve according to one of a first injection pattern in which first fuel is injected and then air is injected and a second injection pattern in which fuel and air are injected at the same time, and the fuel injection rate changing means comprises means for contolling the actuating means to switch the injection pattern of the air blast fuel injection valve between the first injection pattern and the second injection pattern.

9. An exhaust gas purification system according to claim 8, wherein the means for controlling the actuating means comprises means for switching the injection pattern of the air blast fuel injection valve to the first injection pattern when the engine operating range determining means determines that the engine operating condition is within the insufficient HC amount range.

10. An exhaust gas purification system according to claim 7, wherein the engine operating range determining means comprises means for determining that the engine operating condition is within the insufficient HC amount range when the two-stroke engine is at medium engine loads and medium engine speeds.

11. An exhaust gas purification system according to claim 7, wherein the air blast fuel injection valve comprises a fuel injection portion and an air blast portion, and the air blast portion comprises a nozzle hole, a needle for opening and closing the nozzle hole, a spring for biasing the needle in a closing direction, a solenoid, and a movable core for moving the needle in a closing direction when magnetically excited.

12. An exhaust gas purification system according to claim 1, wherein the fuel injection valve has a variable fuel injection rate, and the HC amount control means comprises fuel injection rate changing means for changing the fuel injection rate of the fuel injection valve to a high fuel injection rate when the engine operating range determining means determines that the engine operating condition is within the insufficient HC amount range.

13. An exhaust gas purification system according to claim 12, wherein the fuel injection valve comprises a two stage fuel injection valve having a first exciting coil and a second exciting coil, the first exciting coil causing injection of fuel at "ON" and stopping the fuel injection at "OFF", and the second exciting coil causing the fuel injection rate to be low at "ON" and causing the fuel injection rate to be high at "OFF".

14. An exhaust gas purification system according to claim 12, wherein the engine operating range determining means comprises means for determining that the engine operating condition is within the insufficient HC amount range when the engine is at medium engine loads.

15. An exhaust gas purification system according to claim 12, wherein the fuel injection rate changing means comprises means for controlling the fuel injection rate so that the fuel injection rate is high at medium and high engine loads and the fuel injection rate is low at low engine loads.

16. An exhaust gas purification system according to claim 12, wherein the fuel injection rate changing means comprises means for controlling the fuel injection rate so that the fuel injection rate is high at medium engine loads and the fuel injection rate is low at low engine loads and high engine loads.

17. An exhaust gas purification system according to claim 1 and further comprising a cooler installed in the intake conduit of the internal combustion engine, a bypass conduit bypassing the cooler, and a switching valve for switching intake gas flow between the cooler and the bypass conduit, and wherein the HC amount control means comprises switching valve control means for switching the switching valve so as to cause intake gas to flow through the cooler when the engine operating range determining means determines that the engine operating condition is within the insufficient HC amount range.

18. An exhaust gas purification system according to claim 17, wherein the engine operating range determining means comprises means for determining that the engine operating condition is within the insufficient HC amount range when the air-fuel ratio is smaller than a predetermined air-fuel ratio and also when the air-fuel ratio is equal to or larger than the predetermined air-fuel ratio and the exhaust gas temperature is higher than a predetermined exhaust gas temperature.

19. An exhaust gas purification system according to claim 18, wherein the predetermined air-fuel ratio in a case where the air-fuel ratio increases is different from the predetermined air-fuel ratio in a case where the air-fuel ratio decreases, and the predetermined exhaust gas temperature in a case where the exhaust gas temperature increases is different from the predetermined exhaust gas temperature in a case where the exhaust gas temperature decreases.

20. An exhaust gas purification system according to claim 17, wherein the engine operating range determining means comprises means for determining that the engine operating condition is within the insufficient HC amount range when the HC concentration of exhaust gas is smaller than a predetermined HC concentration.

21. An exhaust gas purification system according to claim 17, wherein the engine further includes a throttle valve installed in the intake conduit, and the cooler comprises an air-cooled intercooler which is installed in the intake conduit upstream of the throttle valve.

22. An exhaust gas purification system according to claim 1 and further comprising a radiator, a cooling water circulation conduit connecting the engine and the radiator, a bypass conduit bypassing the radiator, and a three-way solenoid valve disposed at a connecting portion of the cooling water circulation conduit and the bypass conduit, and wherein the HC amount control means comprises cooling water temperature control means for controlling the three-way solenoid valve to lower the cooling water temperature to a temperature below a usual cooling water temperature when the engine operating range determining means determines that the engine operating condition is within the insufficient HC amount range.

23. An exhaust gas purification system according to claim 22, wherein the engine operating range determining means comprises means for determing that the engine operating condition is within the insufficient HC amount range when the air-fuel ratio is within a predetermined air-fuel ratio range, when the air-fuel ratio is outside the predetermined air-fuel ratio but the exhaust gas temperature is equal to or higher than a predetermined exhaust gas temperature, and when the cooling water temperature control means sets an object cooling water temperature to a low temperature and controls opening and closing of the three-way solenoid valve to adjust the cooling water temperature to the object temperature when the engine operating range determining means determines that the engine operating condition is within the insufficient HC amount range.

24. An exhaust gas purification system according to claim 22, wherein the engine operating range determining means comprises means for determining that the engine operating condition is within the insufficient HC amount range when the HC concentration of exhaust gas is lower than a predetermined HC concentration, and the cooling water temperature control means sets an object cooling water temperature to a low temperature and controls opening and closing of the three-way solenoid valve to adjust the cooling water temperature to the object temperature when the engine operating range determining means determines that the engine operating condition is within the insufficient HC amount range.

25. An exhaust gas purification system according to claim 1 and further comprising a water injecting device for injecting water into the intake conduit or the combustion chamber of the engine, and wherein the HC amount control means comprises water injection control means for causing the water injecting device to inject water when the engine operating range determining means determines that the engine operating condition is within the insufficient HC amount range.

26. An exhaust gas purification system according to claim 25, wherein the engine operating range determining means comprises means for determining that the engine operating condition is within the insufficient HC amount range when the air-fuel ratio is within a predetermined air-fuel ratio range and also when the air-fuel ratio is outside the predetermined air-fuel ratio range and the exhaust gas temperature is higher than a predetermined exhaust gas temperature.

27. An exhaust gas purification system according to claim 25, wherein the engine operating range determining means comprises means for determining that the engine operating condition is within the insufficient HC amount range when the HC concentration in the exhaust gas is lower than a predetermined HC concentration.

* * * * *